US007123156B2

(12) United States Patent
Sadjadi

(10) Patent No.: US 7,123,156 B2
(45) Date of Patent: Oct. 17, 2006

(54) LIGHTED STATUS INDICATOR CORRESPONDING TO THE POSITIONS OF CIRCUIT BREAKER, SWITCH OR FUSE

(75) Inventor: Leonard Sadjadi, Dallas, TX (US)

(73) Assignees: L.S. Unico, Inc., Dallas, TX (US); Micrin Technologies Corporation, Dallas, TX (US)

( * ) Notice: Subject to any disclaimer, the term of this patent is extended or adjusted under 35 U.S.C. 154(b) by 927 days.

(21) Appl. No.: 09/736,354

(22) Filed: Dec. 14, 2000

(65) Prior Publication Data

US 2002/0008628 A1 Jan. 24, 2002

Related U.S. Application Data

(60) Provisional application No. 60/172,187, filed on Dec. 17, 1999.

(51) Int. Cl.
*G08B 21/00* (2006.01)

(52) U.S. Cl. ..... 340/638; 348/815.4; 348/815.45; 361/93.1

(58) Field of Classification Search ..... 340/638, 340/815.4, 815.45, 644, 639, 662, 664; 361/93, 361/42, 79, 93.1; 200/310, 317; 335/17
See application file for complete search history.

(56) References Cited

U.S. PATENT DOCUMENTS 4,831,221 A * 5/1989 Yu et al. ..... 200/553
4,912,439 A * 3/1990 Nagy et al. ..... 335/132
4,969,063 A * 11/1990 Scott ..... 361/93
5,546,266 A * 8/1996 Mackenzie et al. ..... 361/93.4
5,552,755 A * 9/1996 Fello et al. ..... 335/18
5,847,913 A * 12/1998 Turner et al. ..... 361/93

* cited by examiner

*Primary Examiner*—Anh V. La

(57) ABSTRACT

A lighted status indicator for a contact (circuit breaker, switch or fuse) with a distinctive color associated with each position of the circuit breaker. The lighted status indicator is composed of a multi-color light source (usually an LED) together with an electronic circuit that changes the color of that light source, depending upon the status (or position) of the circuit breaker, switch, or fuse. Versions of the lighted status indicator circuit are detailed that can be: (1) used with AC, or DC (positive or negative ground) power supplies; (2) used in a wide supply voltage range; (3) either external to the circuit breaker (or switch or fuse) or incorporated into the circuit breaker (or switch or fuse); (4) used with, or without, an activated parallel circuit to a switch, circuit breaker or fuse, (double pole, double throw in the case of a switch, or auxiliary switch in the case of a circuit breaker); (5) used with, or without, a lower power dissipation option, and (6) used with, or without, a momentary test switch incorporated into the status indicator circuit, simulating a single circuit breaker, or a group of circuit breakers, being turned to a "TRIPPED" position, with an associated change in the color of the LED.

24 Claims, 51 Drawing Sheets

LIGHTED STATUS INDICATOR CORRESPONDING TO THE POSITIONS OF CIRCUIT BREAKER, SWITCH OR FUSE

This application claims priority on provisional application Ser. No. 60/172,187, filed Dec. 17, 1999.

TECHNICAL FIELD

This invention relates, in general, to circuit breakers, switches, and fuses used in electronic circuits, and in particular, to status indicators and momentary test switches for circuit breakers.

BACKGROUND ART

An evaluation of patents in this field (status indicators for circuit breakers, switches, or fuses) reveals that existing technology is significantly different from, and inferior to, that claimed by the applicant.

Relevant U.S. patents examined were: U.S. Pat. No. 4,056,816 (Guim), U.S. Pat. No. 4,652,867 (Masot), U.S. Pat. No. 4,672,351 (Cheng), U.S. Pat. No. 5,233,330 (Hase), U.S. Pat. No. 5,343,192 (Yenisey), U.S. Pat. No. 5,353,014 (Carroll et al.), U.S. Pat. No. 5,812,352 (Rokita et al.), and U.S. Pat. No. 5,920,451 (Fasano et al.)

Evaluation of relevant patents in this field has revealed that:

- All previously issued patents describe a circuit that uses a single indicator to indicate either the "OPEN/TRIPPED" or the "CLOSED" position, or uses multiple indicators (usually separate LEDs) to display multiple possible conditions. Existing technology does not allow a single lighted display element to indicate status for all possible breaker, switch, or fuse conditions.
- Some of the issued patents require that a parallel circuit or set of contacts be implemented together with the circuit breaker, switch, or fuse in order to activate the indicator light.
- Some patents in this area require active elements to monitor the status of the circuit breaker or switch. Such circuits are less reliable and more expensive than circuits that use only passive elements.
- Some of the previously issued patents apply only to AC or DC powered systems. Those used in DC systems may or may not function with both polarities.
- None of the technologies in existing patents incorporates a momentary test switch circuit that allows all circuit breaker, switch, or fuse status indicators to be simultaneously tested, using a single bi-color lighted status indicator per breaker/switch.
- Finally, all circuits described in related patents are designed to be used with specific supply voltages and will not function correctly outside that supply range.

The invention claimed by the applicants addresses all these problems. It describes a circuit breaker, switch, or fuse status indicator that incorporates a lighted visual display with a multi-color light source, eliminating the need for multiple light sources (such as LEDs or back-lit LCDs) to display the various possible positions of a breaker.

A circuit that uses a single multi-color light source for status display is superior to existing circuits with multiple light sources. Using of multiple light sources introduces extra expense and complexity to status indicator circuitry and can unnecessarily consume scarce room on the front of circuit breaker (or a panel adjacent to the circuit breaker).

The circuit breaker status indicator uses an inexpensive, passive electronic circuit that takes advantage of the status contact switch of the circuit breaker to change the color of that light source, depending upon the status (or position) of the circuit breaker. This circuit can also easily be configured to support a wide range of AC and DC (both positive and negative) voltages, and to include a momentary test switch circuit.

SUMMARY

A lighted status indicator for a contact (circuit breaker, switch or fuse) with a distinctive color associated with each position of the circuit breaker. The lighted status indicator is composed of a multi-color light source (usually an LED) together with an electronic circuit that changes the color of that light source, depending upon the status (or position) of the circuit breaker, switch, or fuse. This lighted status indicator features a number of innovations, including:

- Use of simple, non-active, and inexpensive electronic parts,
- Use of a single, bi-color light LED to indicate the "ON" and "OFF" conditions of a two-position circuit breaker or switch with two distinct colors (example: red and green), and
- Use of a single bi-color LED to indicate status in a circuit breaker with a mid-position feature (on/off/tripped–3 positions in all). This allows these three possible status conditions (positions) to be represented by two different colors in the "ON" and the "TRIPPED" positions, and by the LED being off in the manually set "OFF" condition. (A three-color light source could also be used with this technology, allowing the "ON," "TRIPPED," and "OFF" states to all be represented by a unique color.)

This technology also offers heretofore-unseen flexibility of implementation. The lighted status indicator may be:

- Used with AC, or DC (positive or negative ground) power supplies,
- Used in a wide supply voltage range,
- Either external to the circuit breaker (or switch or fuse) or incorporated into the circuit breaker (or switch or fuse),
- Used with, or without, an activated parallel circuit to a switch, circuit breaker or fuse, (double pole, double throw in the case of a switch, or auxiliary switch in the case of a circuit breaker),
- Used with, or without, a lower power dissipation option, and
- Used with, or without, a momentary test switch incorporated into the status indicator circuit, simulating a single circuit breaker, or a group of circuit breakers, being turned to a "TRIPPED" position, with an associated change in the color of the LED.

BRIEF DESCRIPTION OF THE DRAWINGS

FIG. 42 is the same as FIG. 41 except for alterations necessary to support multiple circuit breakers are connected to the same push-button test switch.

DETAILED DESCRIPTION OF THE INVENTION

Item 1: Switch placed on the positive line, before line reaching the load, negative ground system.

Figure 1:
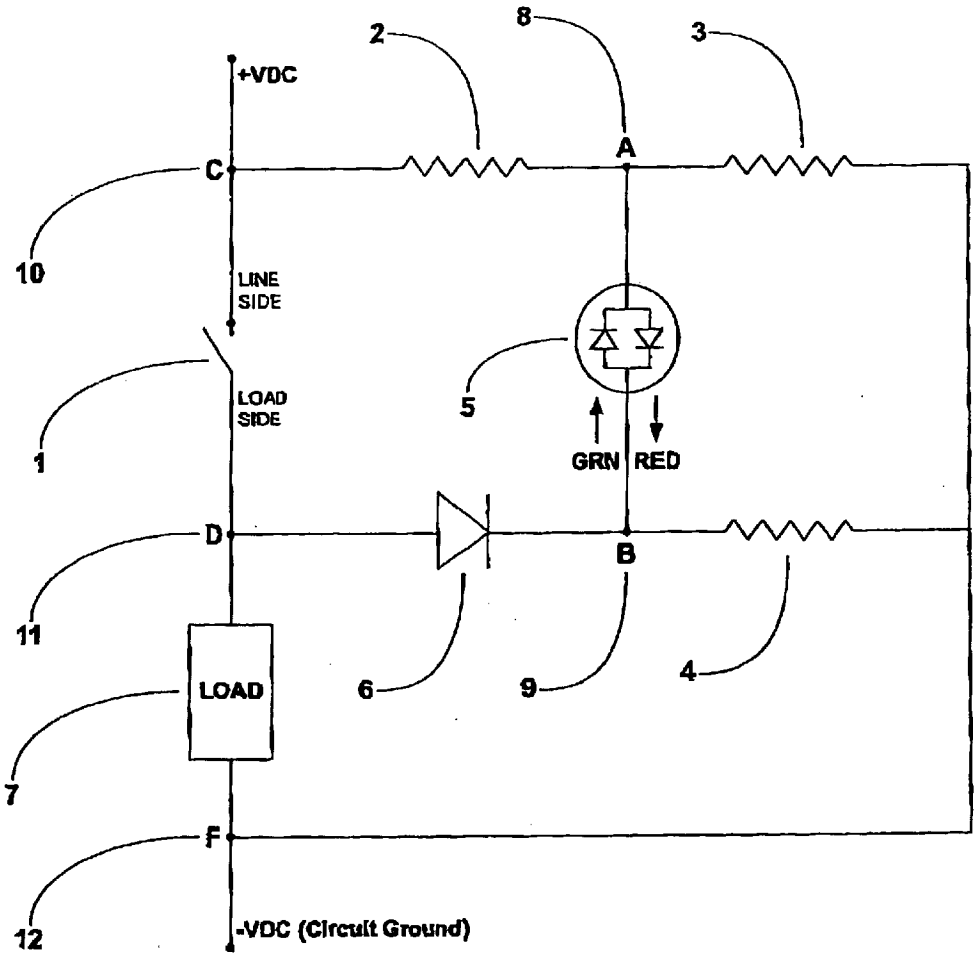
FIG. 1 is a circuit diagram of the Lighted Status Indicator circuit, where the switch is placed on the positive line, before line reaching the load, for a negative ground DC system.

Description:

The circuit in FIG. 1 consists of three resistors—4, 2, and 3, a diode—6, and a bi-color LED 5. The circuit is connected across the circuit breaker/switch/fuse 1, with resistor 2 connected to point C 10, and diode 6 connected to point D 11. The common connection point of resistors 4 and 3 is connected to the negative side of the DC supply at point F 12.

Elements of the FIG. 1 Circuit

| | |
|---|---|
| 1- | Switch |
| 2- | Resistor |
| 3- | Resistor |
| 4- | Resistor |
| 5- | Bi-Color LED |
| 6- | Diode |
| 7- | Load |
| 8- | Point "A" |
| 9- | Point "B" |
| 10- | Point "C" |
| 11- | Point "D" |
| 12- | Point "F" |

Function:

When the circuit breaker/switch/fuse 1 is CLOSED, current will flow through the diode 6, from point D 11 to point B 9, through the LED 5 from point B 9 to point A 8, and then through the resistor 3 from point A 8 to point F 12. Current flowing in this direction will cause the LED 5 to glow GREEN. (In FIG. 1—as in the rest of this document—GREEN is used as an example of an indicator color; other color LEDs or light sources could be substituted with no significant changes to the circuits described.)

A second path of current flows from point D 11 to point B 9 (passing through the diode 6), and then from point B 9 to point F 12 (passing through the resistor 4). A small amount of current will also run from point C 10 to point A 8 (passing through resistor 2), and then on to point F 12 (via the resistor 3). This current is equal to the voltage drop across points D 11 and A 8 (equal to 2 diode drops), divided by the value of the resistor 2. The values of resistors 4, 2, and 3 control the amount of the current flowing from point B 9 to point A 8, with a minimum value of 10 mA and a maximum value of 20 mA (typical functional current range for an LED).

When the circuit breaker/switch/fuse 1 is OPEN/TRIPPED, current will flow from point C 10 to point A 8, and then divide into two parts. A portion of that current flows from point A 8 to point B 9 (passing through the LED 5 ), and then from point B 9 to point F 12, (passing though the resistor 4). This current stream causes the bi-color LED 5 to glow RED. A second portion of the current will flow from point A 8 to point F 12 (passing through the resistor 3). The diode 6 will block any current flow from point B 9 to point D 11. (In FIG. 1—as in the rest of this document—RED is used as an example of an indicator color; other color LEDs or light sources could be substituted with no significant changes to the circuits described.)

The values of resistors 4, 2, and 3 control the amount of the current flowing through the LED 5 in the direction of point A 8 to point B 9. In this case, the minimum current flow will also be 10 mA and the maximum will be 20 mA, depending on the desired light intensity and amount of power dissipation.

Item 2: Switch placed on the positive line, before line reaching the load, with current-limiting diodes, for a negative ground DC system.

Figure 2:
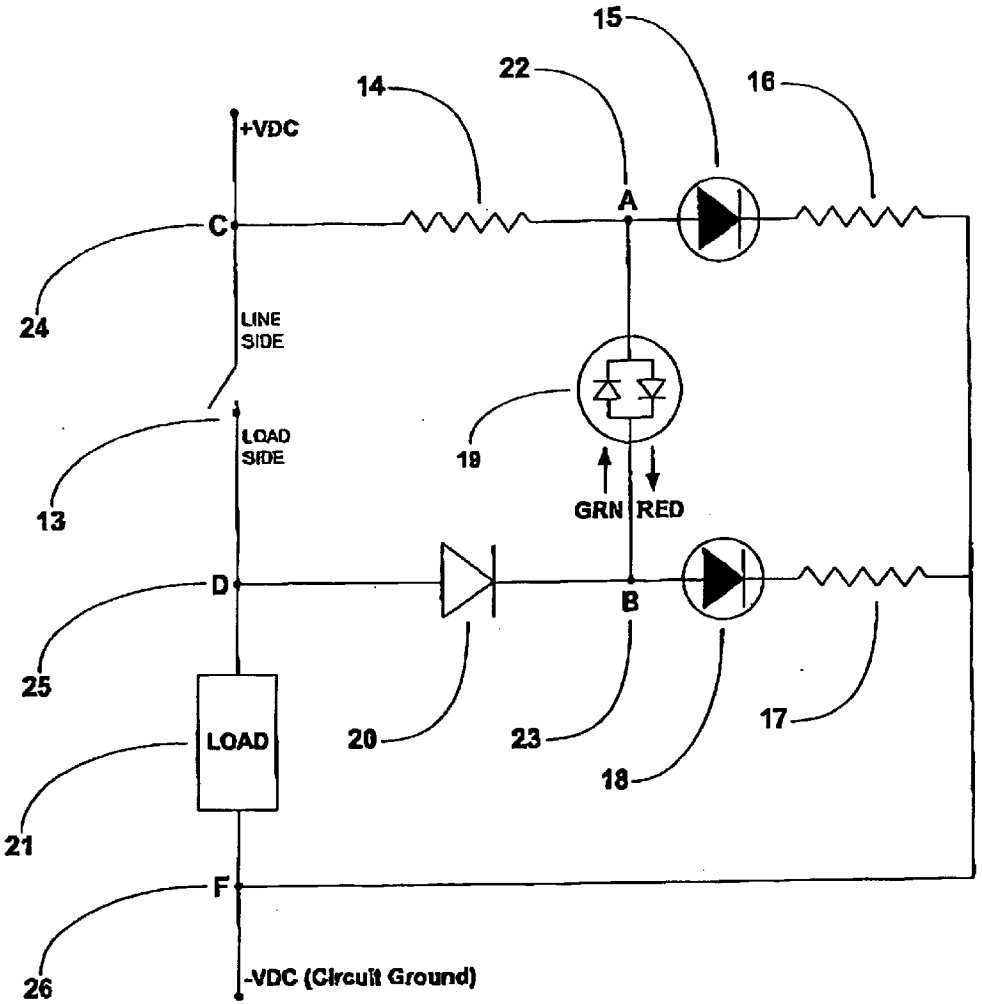
FIG. 2 is the same as FIG. 1, except that the circuit now includes current-limiting diodes.

Description:

FIG. 2 is identical to the FIG. 1 circuit, except that two current-limiting diodes (15 and 18) have been added in series with the resistors, 17 and 16. These diodes act to limit the current through the LED 19 to a maximum allowed by the diode specification (typically 10 to 15 mA).

Elements of the FIG. 2 Circuit

| | |
|---|---|
| 13- | Switch |
| 14- | Resistor |
| 15- | Current-limiting Diode |
| 16- | Resistor |
| 17- | Resistor |
| 18- | Current-limiting Diode |
| 19- | Bi-Color LED |
| 20- | Diode |
| 21- | Load |
| 22- | Point "A" |
| 23- | Point "B" |
| 24- | Point "C" |
| 25- | Point "D" |
| 26- | Point "F" |

Function:

Adding these current-limiting diodes allows the circuit to be used with a wide range of supply voltages. Current through the LED 19 will not exceed the regulating current of the diodes 15 or 18. Diode 15 regulates the LED current in the direction of point B 23 to point A 22 (LED is GREEN; breaker/switch/fuse is CLOSED), while diode 18 regulates the LED current in the direction of point A 22 to point B 23 (LED is RED; breaker/switch/fuse is OPEN/TRIPPED).

The maximum DC supply voltage tolerated by the circuit will depend on the maximum voltage allowed across the diode 15 or 18 (typically 50 VDC). It will be equal to the maximum voltage allowed across diode 15 (or 18) plus the voltage across the resistor 16 (or 17). Since the current through these resistors (16 or 17) is limited by the diodes 15 and 18, the voltages will also be limited The circuit in FIG. 2 can be easily modified for use at a higher DC supply voltages. To support increased voltages, it is necessary to add one or more additional current-limiting diodes in series with diode 15 and 18. Typically, each extra current-limiting diode added, in series, with the resistors 17 and 16 will increase the DC supply voltage limit by 50 VDC. This circuit will also function with just the two current-limiting diodes, and without the resistors, 17 and 16.

Item 3: Switch placed on the line, before line reaching the load, for use with AC power supply.

Figure 3:
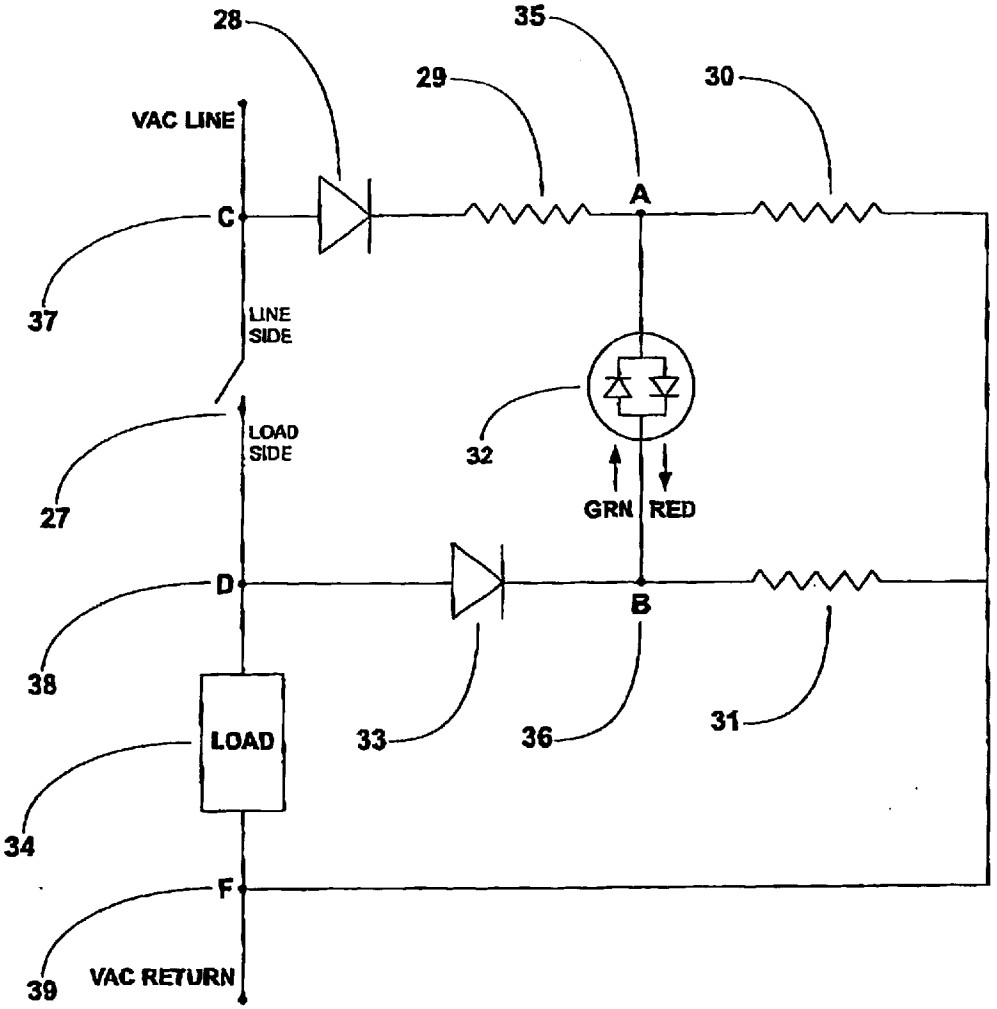
FIG. 3 is the same as FIG. 1, except that the circuit has been altered to work with an AC power supply.

Description:

Using the circuit shown in FIG. 1 as a base, a diode 28 (similar to the diode 33) is added on the path of junction point C 37 to resistor 29, resulting in the circuit in FIG. 3. Elements of the FIG. 3 Circuit:

| | |
|---|---|
| 27- | Switch |
| 28- | Diode |
| 29- | Resistor |
| 30- | Resistor |
| 31- | Resistor |
| 32- | Bi-Color LED |
| 33- | Diode |
| 34- | Load |
| 35- | Point "A" |
| 36- | Point "B" |
| 37- | Point "C" |
| 38- | Point "D" |
| 39- | Point "F" |

Function:

Adding the extra diode 28 allows the circuit to be used with an AC power supply, as well as with a negative ground DC power supply. The functionality of the circuit remains the same, except that the current will now flow in half cycles in either direction through the LED 32, depending on the position of the on/off switch.

Item 4: Switch placed on the line, before line reaching the load, with current-limiting diodes, for use with AC power supply.

Figure 4:
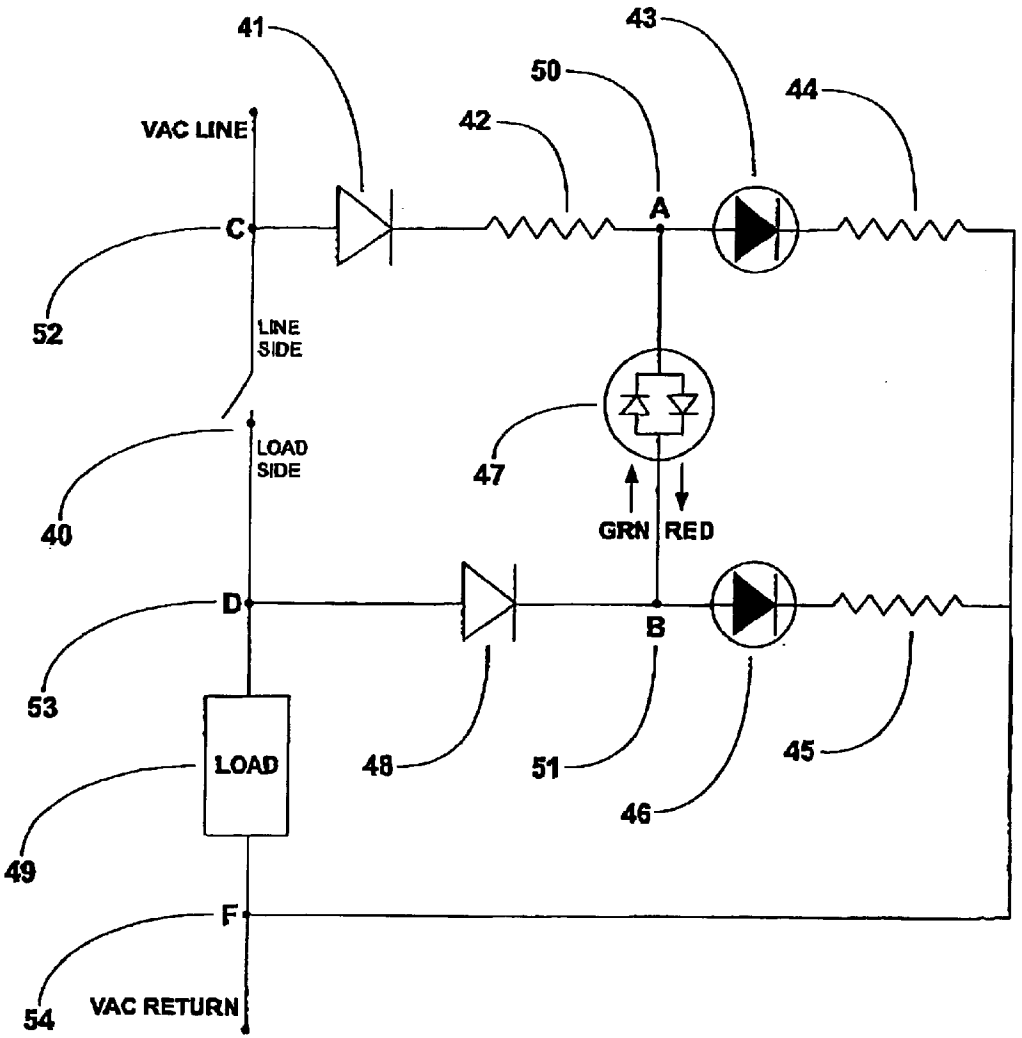
FIG. 4 is the same as FIG. 1, except that the circuit incorporates both the current-limiting diodes and AC power supply support.

Description:

Adding current-limiting diodes, 43 and 46, to the circuit in FIG. 3 allows a wider AC supply voltage range to be tolerated. FIG. 4 shows such a configuration.

Elements of the FIG. 4 Circuit:

| | |
|---|---|
| 40- | Switch |
| 41- | Diode |
| 42- | Resistor |
| 43- | Current-Limiting Diode |
| 44- | Resistor |
| 45- | Resistor |
| 46- | Current-Limiting Diode |
| 47- | Bi-Color LED |
| 48- | Diode |
| 49- | Load |
| 50- | Point "A" |
| 51- | Point "B" |
| 52- | Point "C" |
| 53- | Point "D" |
| 54- | Point "F" |

Function:

The addition of the current-limiting diodes, in series, with the diodes 43 and 46 increases the circuit's AC supply voltage limit, while not allowing the current through the LED 47 to exceed that LED's limits. The maximum voltage tolerated corresponds to the peak voltage of the positive half cycle of the AC power supply. This circuit could also be used with just the two current limiting diodes, 43 and 46, and without the two resistors, 44 and 45.

Item 5: Switch placed on the negative line, before line reaching the load, positive ground DC system.

Figure 5:
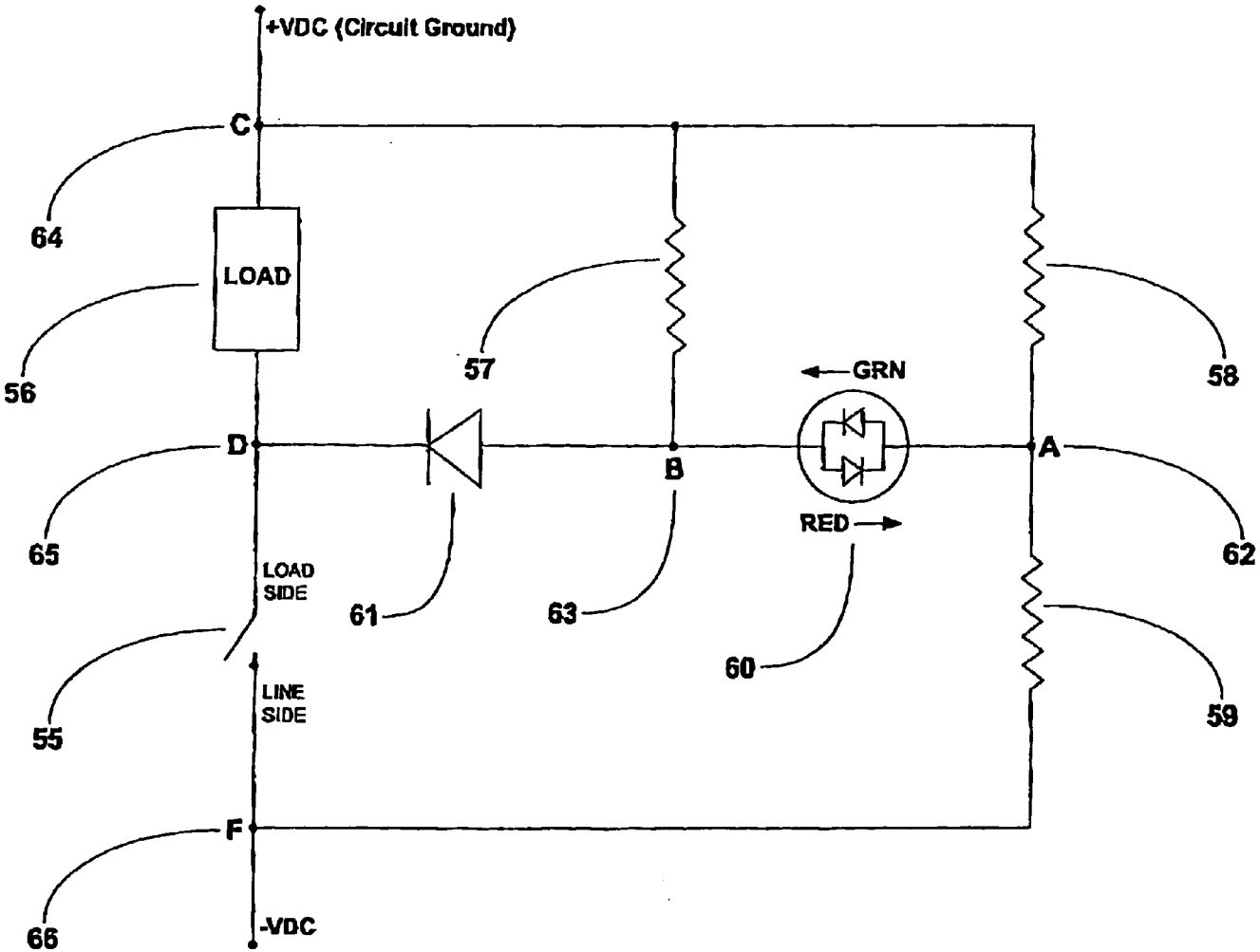
FIG. 5 is a circuit diagram of the Lighted Status Indicator circuit, where the switch is placed on the negative line, before line reaching the load, for a positive ground DC system.

Description:

The circuit in FIG. 5 consists of three resistors (57, 59, and 58), a diode (61), and a bi-color LED 60. The circuit is connected across the circuit breaker/switch/fuse 55, with resistor 59 connected to point F 66, and diode 61 connected between points B 63 and D 65. The common connection point of resistors 57 and 58 is connected to the positive side of the DC supply at point C 64.

Elements of the FIG. 5 Circuit:

| | |
|---|---|
| 55- | Switch |
| 56- | Load |
| 57- | Resistor |
| 58- | Resistor |
| 59- | Resistor |
| 60- | Bi-Color LED |
| 61- | Diode |
| 62- | Point "A" |
| 63- | Point "B" |
| 64- | Point "C" |
| 65- | Point "D" |
| 66- | Point "F" |

Function:

When the circuit breaker/switch/fuse 55 is CLOSED, a current will flow through the resistor 58, the LED 60, the diode 61, and through the switch 55 to point F 66. This current stream causes the LED 60 to glow GREEN.

A second path of current will run from point C 64 to point F 66 (passing through the resistor 57, the diode 61, and the switch 55). A small amount of current will also run from point A 62 to point F 66 (passing through resistor 59). This current is equal to the voltage drop across the LED 60 and the diode 61 (equal to 2 diode drops), divided by the value of the resistor 59.

The values of resistors 57, 59, and 58 will control the amount of the current flowing from point A 62 to point B 63, with a minimum value of 10 mA and a maximum value of 20 mA (typical functional current range for an LED).

When the circuit breaker/switch/fuse is OPEN/TRIPPED, current will flow from point C 64 to point B 63, and then from point B 63 to point A 62 (passing though the LED 60), and then from point A 62 to point F 66. This current will cause the bi-color LED 60 to glow RED. A second path of current will flow from point C 64 to point A 62 (passing though the resistor 58, and then through the resistor 59) to point F 66.

The values of resistors 57, 59, and 58 will control the amount of the current flowing through the LED 60 in the direction of point B 63 to point A 62. The minimum current will be 10 mA and the maximum will be 20 mA, depending on the desired light intensity and amount of power dissipation.

Item 6: Switch placed on the negative line, before line reaching the load, with current-limiting diodes, for a positive ground DC system.

Figure 6:
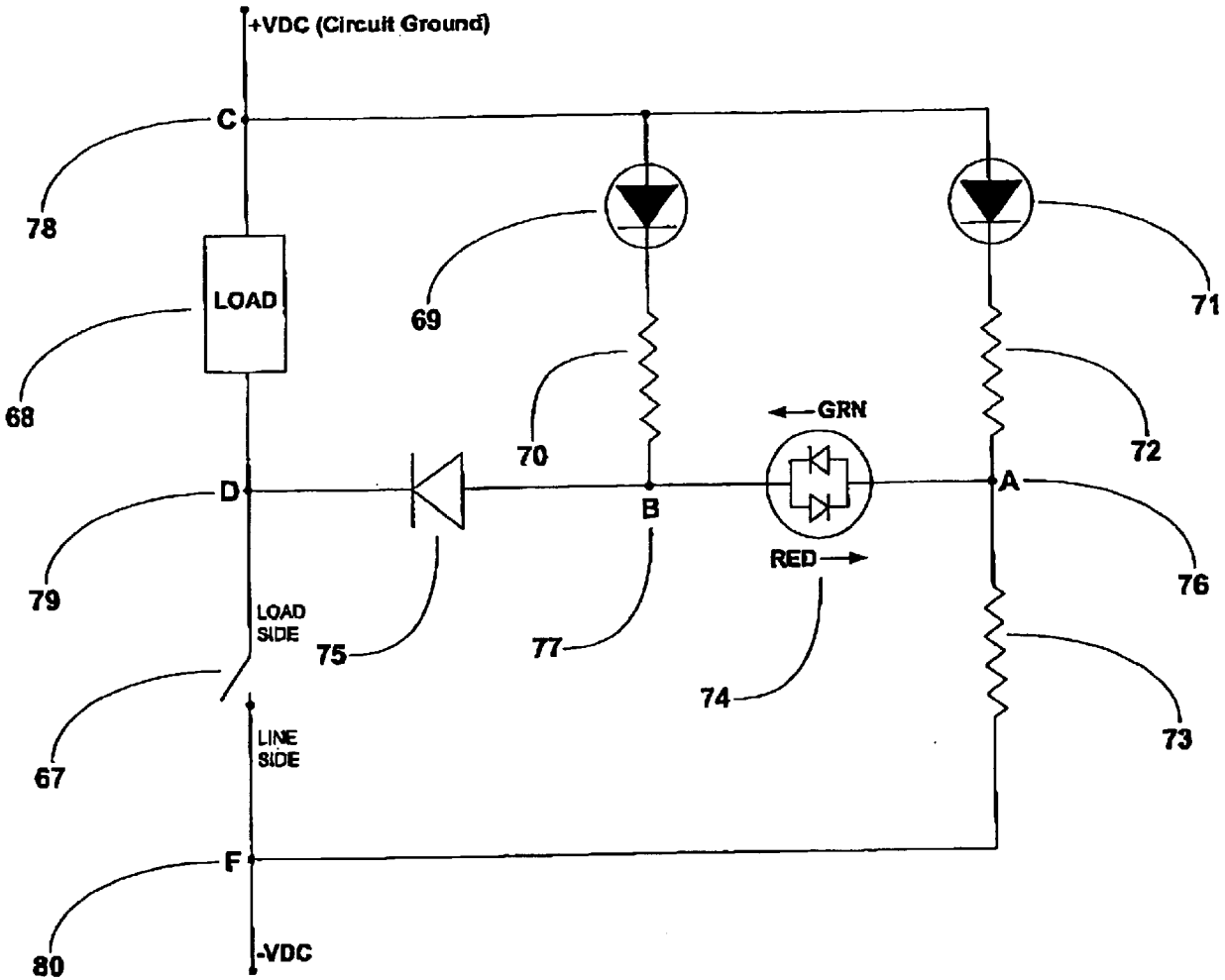
FIG. 6 is the same as FIG. 5, except that the circuit now includes current-limiting diodes.

Description:

The circuit in FIG. 6 is identical to that shown in FIG. 5, except that two current-limiting diodes, 71 and 69, have been added in series with the resistors, 70 and 72.

Elements of the FIG. 6 Circuit

| | |
|---|---|
| 67- | Switch |
| 68- | Load |
| 69- | Current-Limiting Diode |
| 70- | Resistor |
| 71- | Current-Limiting Diode |
| 72- | Resistor |
| 73- | Resistor |
| 74- | Bi-Color LED |
| 75- | Diode |
| 76- | Point "A" |
| 77- | Point "B" |
| 78- | Point "C" |
| 79- | Point "D" |
| 80- | Point "F" |

Function:

As previously explained under Item 2, the addition of current-limiting diodes (69 and 71) regulates the maximum current flow, and increases the range of DC supply voltages that the circuit will tolerate.

The circuit in FIG. 6 could be easily modified to support higher DC supply voltages. Placing additional current-limiting diodes, in series with the diodes 71 and 69, will further increase the DC supply voltage limit. This circuit could also be used with just the two current-limiting diodes, and without the two resistors, 70 and 72.

Item 7: Switch placed on the line, before line reaching the load, for use with AC power supply.

Figure 7:
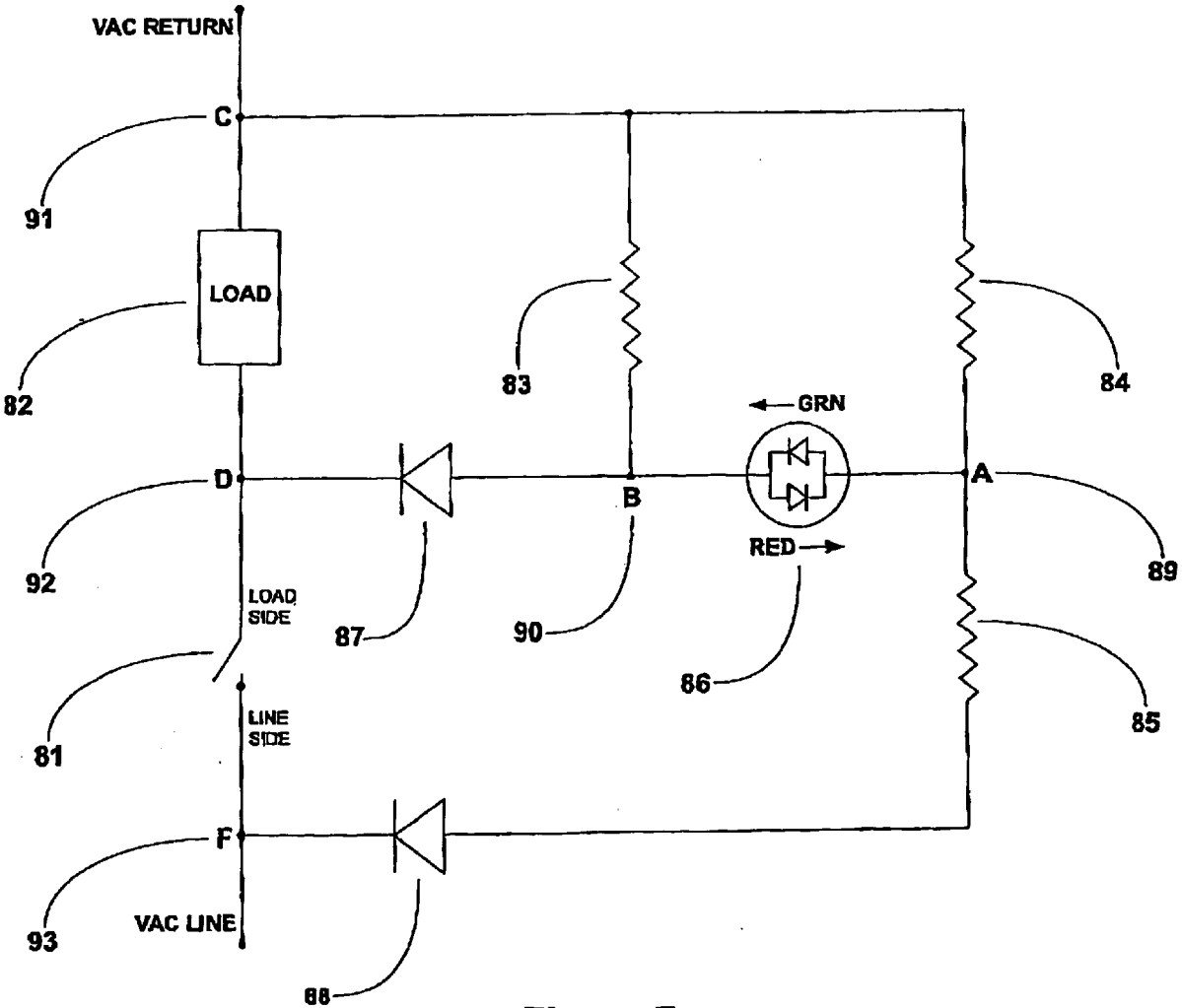
FIG. 7 is the same as FIG. 5, except that the circuit has been altered to work with an AC power supply.

Description:

FIG. 7 shows the addition a diode 88 (similar to the diode 87) on the path of junction point F 93 to the resistor 85, to the circuit diagrammed in FIG. 5

Elements of the FIG. 7 Circuit:

| | |
|---|---|
| 81- | Switch |
| 82- | Load |
| 83- | Resistor |
| 84- | Resistor |
| 85- | Resistor |
| 86- | Bi-Color LED |
| 87- | Diode |
| 88- | Diode |
| 89- | Point "A" |
| 90- | Point "B" |
| 91- | Point "C" |
| 92- | Point "D" |
| 93- | Point "F" |

Function:

By adding this additional diode 88, the FIG. 7 circuit can be used with either an AC power supply or positive ground DC power supply (as described under Item 3).

Figure 8:
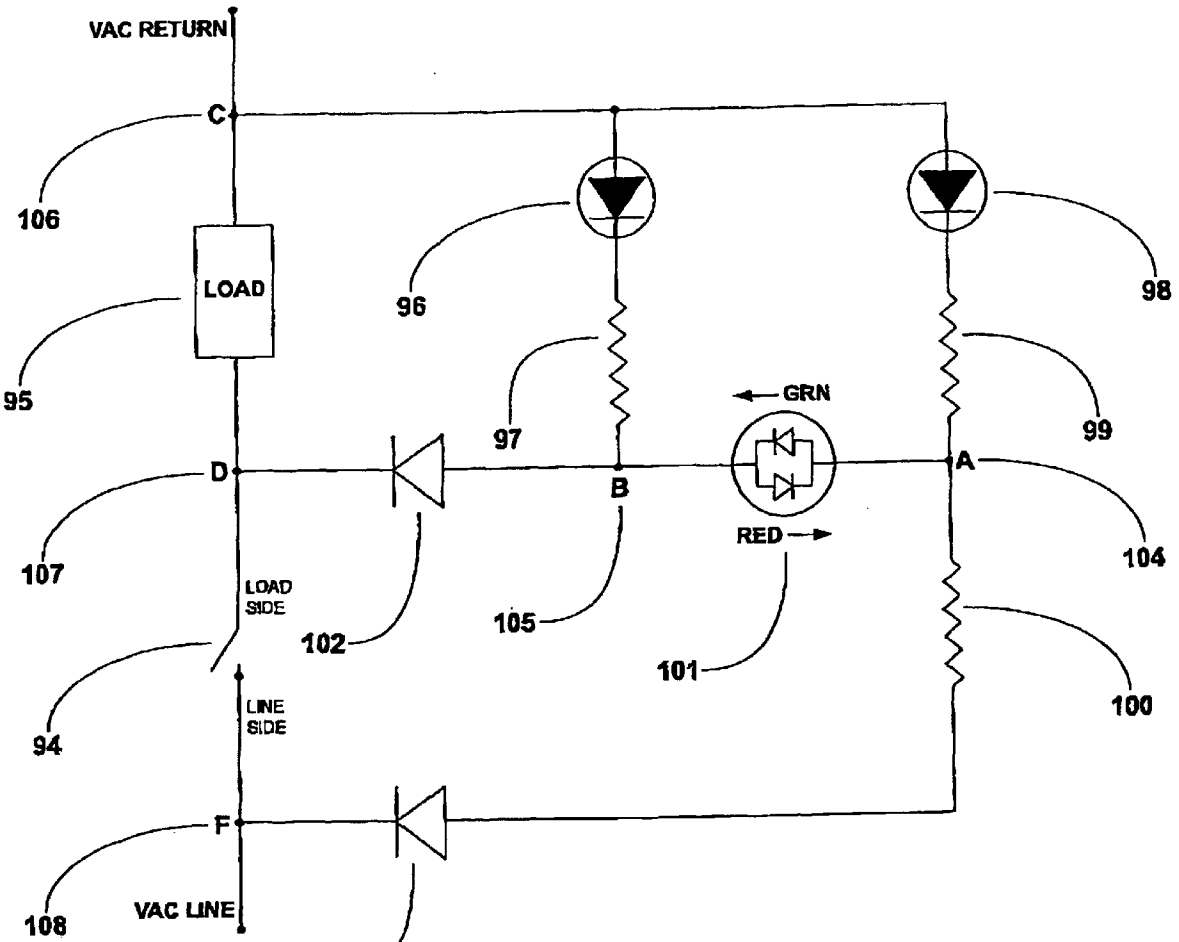
FIG. 8 is the same as FIG. 5, except that the circuit incorporates both the current-limiting diodes and AC power supply support.

Item 8: Switch placed on the line, before line reaching the load, with current-limiting diodes, for use with AC power supply Description:

Adding current-limiting diodes, 98 and 96, to the circuit shown in FIG. 7 allows a wider AC supply voltage range to be tolerated. FIG. 8 shows such a configuration.

Elements of the FIG. 8 Circuit:

| | |
|---|---|
| 94- | Switch |
| 95- | Load |

-continued

| | |
|---|---|
| 96- | Current-Limiting Diode |
| 97- | Resistor |
| 98- | Current-Limiting Diode |
| 99- | Resistor |
| 100- | Resistor |
| 101- | Bi-Color LED |
| 102- | Diode |
| 103- | Diode |
| 104- | Point "A" |
| 105- | Point "B" |
| 106- | Point "C" |
| 107- | Point "D" |
| 108- | Point "F" |

Function:

The addition of more current-limiting diodes, in series, with the diodes, 98 and 96, increases the AC supply voltage limit (as explained under Item 4). This circuit could also be used with just the two current-limiting diodes, 98 and 96, and without the resistors, 97 and 99.

Item 9: Lighted position/status indicator for a mid-trip circuit breaker with built-in auxiliary switch, using a bi-color LED, positive ground system.

Description:

A mid-trip circuit breaker is a switch that automatically opens up when the current passing through the switch contacts exceeds a pre-set value. Included in the circuit breaker structure is a separate auxiliary switch—a STDT (single pole, double throw) switch. This auxiliary switch only changes status when the circuit breaker is in a TRIPPED state. Manually opening or closing the circuit breaker does not change the status of the auxiliary switch. Depending upon the application, this auxiliary switch is either used to remotely monitor the status of the circuit breaker, or to remotely activate other devices.

Figure 9:
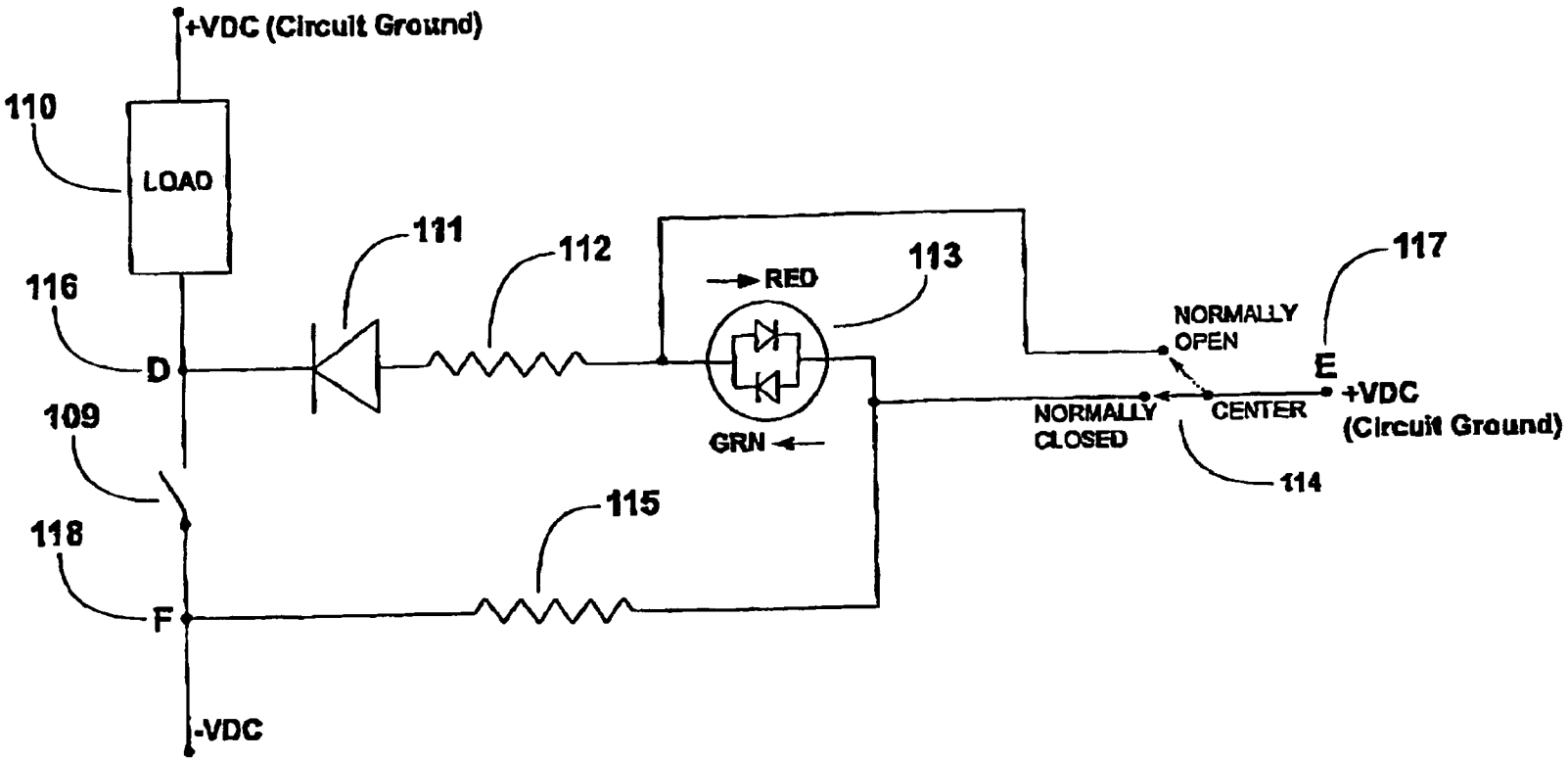
FIG. 9 is a circuit diagram of the Lighted Status Indicator circuit, where the circuit supports a lighted position/status indicator for a mid-trip circuit breaker, with built-in auxiliary switch, using bi-color LED, for a positive ground DC system.

The circuit in FIG. 9 contains two resistors (112 and 115), a diode (111), and a bi-color LED 113 that indicates the status of the circuit breaker. This LED 113 either glows GREEN or RED, or is OFF, depending upon the status of the circuit breaker.

The diode 111 and the resistor 115 are connected, respectively, to points D 116 and F 118 of the circuit breaker. Point F 118 is also connected to the negative point of the DC power supply, while point D 116 is connected to the negative input of the load 110. One side of the LED 113 is connected to resistor 112 and to the "normally open" side of the auxiliary switch 114. The other side of the LED 113 is connected to the resistor 115 and to the "normally closed" side of the auxiliary switch 114. The center position of the auxiliary switch 114 is connected to the positive side of the power supply.

Elements of the FIG. 9 Circuit:

| | |
|---|---|
| 109- | Circuit Breaker |
| 110- | Load |
| 111- | Diode |
| 112- | Resistor |
| 113- | Bi-Color LED |
| 114- | Auxiliary Switch |
| 115- | Resistor |
| 116- | Point "D" |
| 117- | Point "E" |
| 118- | Point "F" |

Function:

Under normal conditions (when the circuit breaker is in the CLOSED state), a current flows from point E 117 (+VDC), through the "normally closed" contact of the auxiliary switch 114, the LED 113, the resistor 112, the diode 111, the circuit breaker 109, point F 118, and on to the negative of the power supply). This current will cause the bi-color LED 113 to glow GREEN. A second path of current will also run through the auxiliary switch 114 to point F 118 (passing through the resistor 115).

When the circuit breaker 109 is manually turned to the OFF position, no current will flow through the LED 113, and the LED 113 will be in OFF state. In this condition, current will still flow through the auxiliary switch 114 to point F 118 (passing through resistor 115), and on to the negative side of the power supply. (In FIG. 9—as in the rest of this document—the OFF state is used as an example of an indicator "color." A three-state LED, using any three colors—or any two colors and an OFF state—could be substituted with no significant changes to the circuits described.)

When the circuit breaker 109 is TRIPPED (in an over limit current condition), it will automatically open the circuit breaker main contact, and also activate the auxiliary switch 114. When that happens, a current will flow from point E 117 (+VDC circuit ground) through the auxiliary switch 114 (from the "center" to "normally open" points) to point F 118 (passing through the LED 113, and the resistor 115). This current flow will cause the LED to turn RED, indicating an alarm condition.

The values selected for the resistors 112 and 115 depend on the desired light intensity for the LED 113 (for both GREEN and RED states), and power dissipation considerations.

Item 10: Lighted position/status indicator for a mid-trip circuit breaker, with built-in auxiliary switch, using bi-color LED, with current-limiting diodes, for a positive ground DC system.

Figure 10:
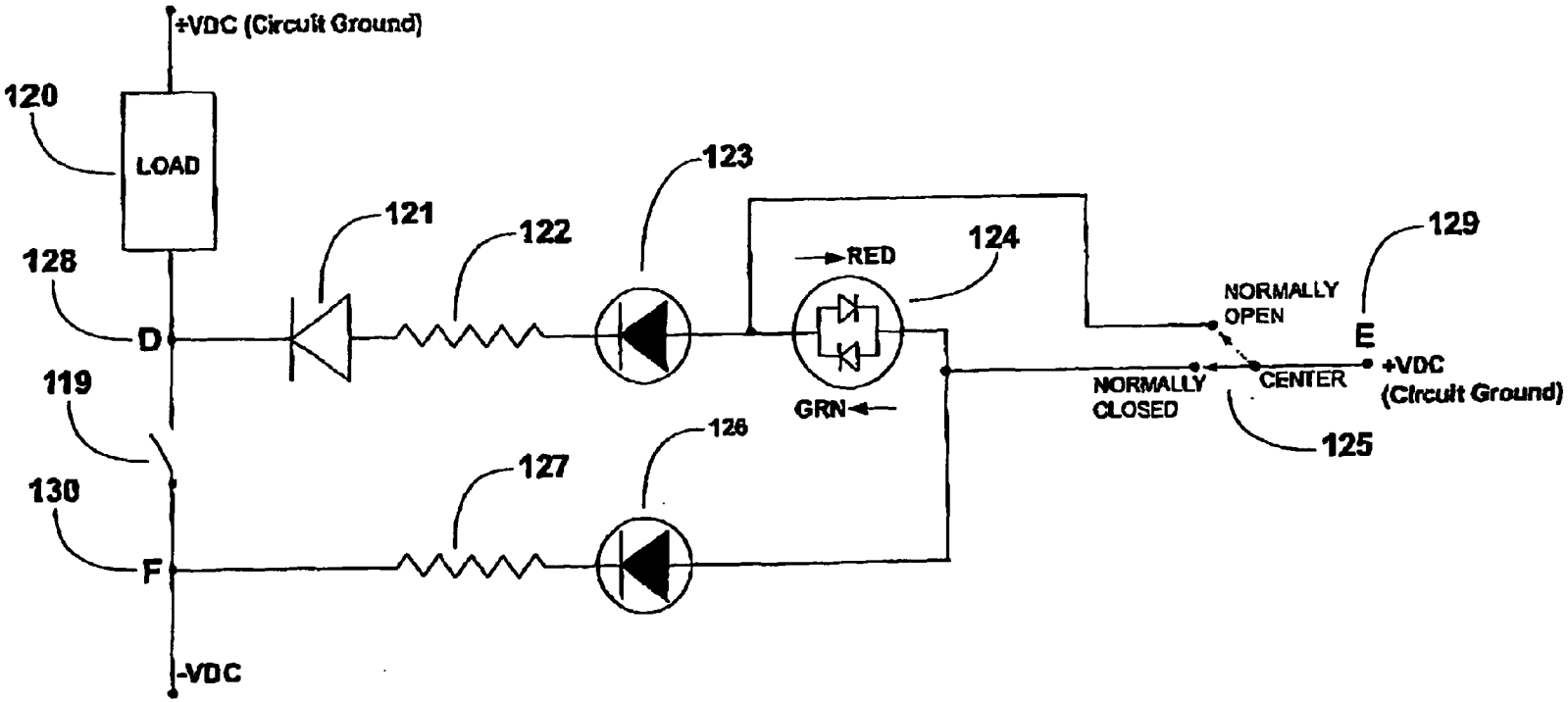
FIG. 10 is the same as FIG. 9, except that the circuit now includes current-limiting diodes.

Description:

FIG. 10 is identical to the FIG. 9 circuit, except that two current-limiting diodes (123 and 126) have been added in series with the resistors (122 and 127). These diodes restrict the current through the LED 124 to a maximum allowed by the diode specifications.

Elements of the FIG. 10 Circuit:

| | |
|---|---|
| 125- | Auxiliary Switch |
| 126- | Current-Limiting Diode |
| 127- | Resistor |
| 128- | Point "D" |
| 129- | Point "E" |
| 130- | Point "F" |
| 119- | Breaker |
| 120- | Load |
| 121- | Diode |
| 122- | Resistor |
| 123- | Current-Limiting Diode |
| 124- | Bi-Color LED |

Function:

A dding the current-limiting diodes will allow the circuit to be used with a wider DC supply voltage range. In this configuration, the current through the LED 124 can not exceed the regulating current of the diodes, 123 and 126.

The circuit could also be used with just the two current-limiting diodes, 123 and 126, and without the two resistors, 122 and 127. Adding additional current-limiting diodes, in series, will further increase the DC supply voltage tolerated.

Item 11: Lighted position/status indicator for a mid-trip circuit breaker, with built-in auxiliary switch, using bi-color LED, for use with AC power supply.

Figure 11:
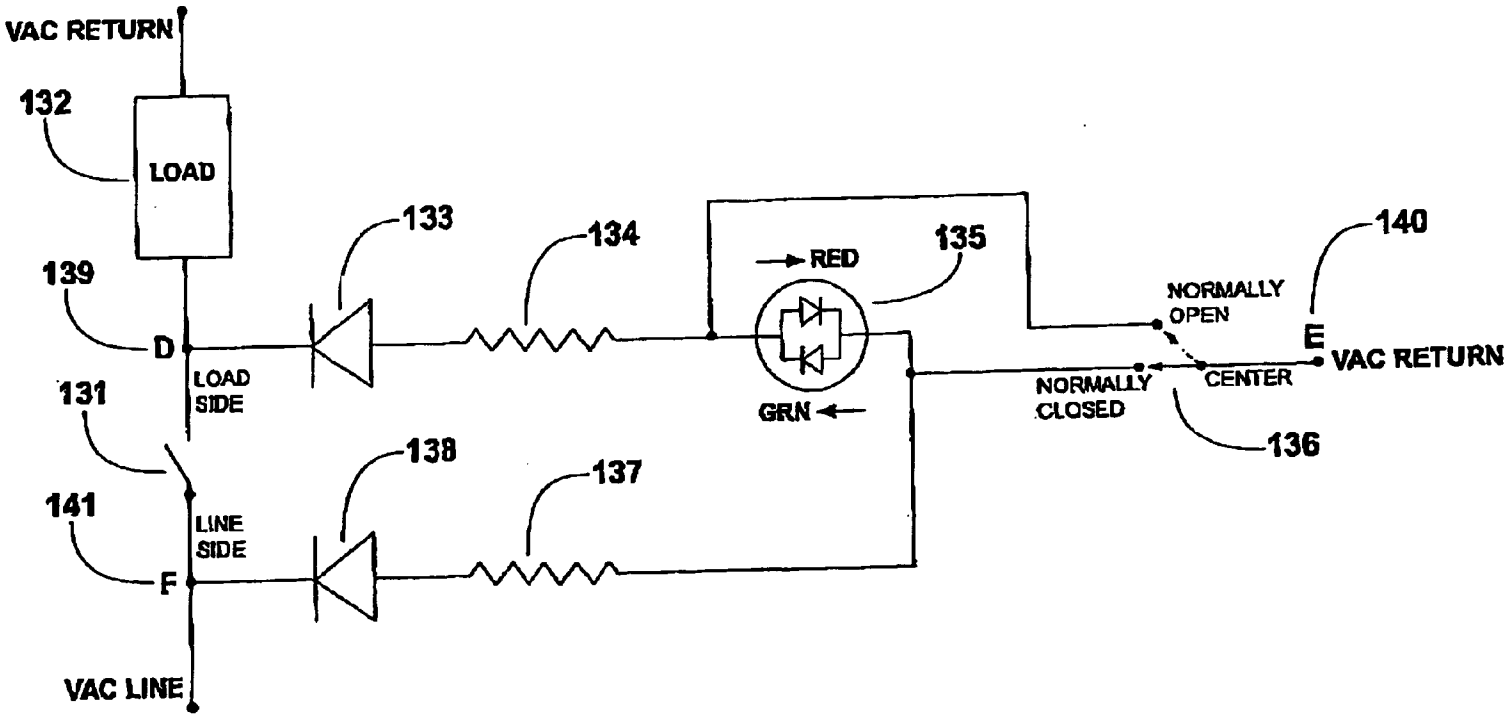
FIG. 11 is the same as FIG. 9, except that the circuit has been altered to work with an AC power supply.

Description:

In FIG. 11, the circuit shown in FIG. 9 is modified by the addition of a diode 138 (similar to the diode CR 133) on the path of junction point F 141 to resistor 137.

Elements of the FIG. 11 Circuit:

| | |
|---|---|
| 131- | Circuit Breaker |
| 132- | Load |
| 133- | Diode |
| 134- | Resistor |
| 135- | Bi-Color LED |
| 136- | Auxiliary Switch |
| 137- | Resistor |
| 138- | Diode |
| 139- | Point "D" |
| 140- | Point "E" |
| 141- | Point "F" |

Function:

Adding the diode 138 allows the circuit to be used with AC power supplies, as well as with DC power supplies (for positive ground systems). The functionality of the circuit remains the same, except that the current will now flow in half cycles in either direction through the LED 135.

Item 12: Lighted position/status indicator for a mid-trip circuit breaker, with built-in auxiliary switch, using bi-color LED, with current-limiting diodes, for use with AC power supply.

Figure 12:
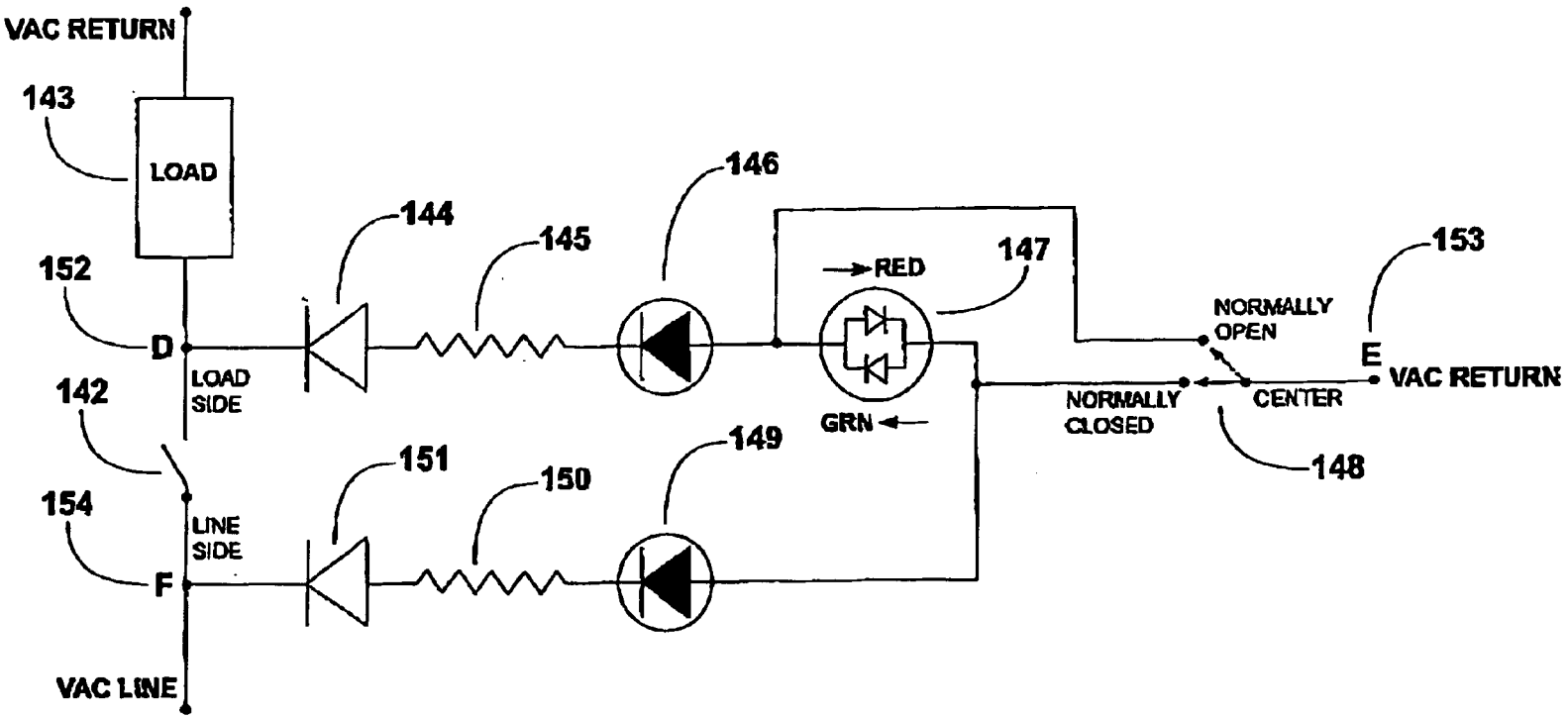
FIG. 12 is the same as FIG. 9, except that the circuit incorporates both the current-limiting diodes and AC power supply support.

Description:

By adding current-limiting diodes, 146 and 149, to the circuit shown in FIG. 11, a wider AC supply voltage range can be tolerated. FIG. 12 shows this configuration.

Elements of the FIG. 12 Circuit:

| | |
|---|---|
| 142- | Circuit Breaker |
| 143- | Load |
| 144- | Diode |
| 145- | Resistor |
| 146- | Current-Limiting Diode |
| 147- | Bi-Color LED |
| 148- | Auxiliary Switch |
| 149- | Current-Limiting Diode |
| 150- | Resistor |
| 151- | Diode |
| 152- | Point "D" |
| 153- | Point "E" |
| 154- | Point "F" |

Function:

The addition of more current-limiting diodes, in series, with the diodes, 146 and 149, increases the AC supply voltage limit (as explained under Item 4).

This circuit could also be used with just the two current-limiting diodes, 146 and 149, and without the resistors, 145 and 150.

Item 13: Lighted position/status indicator for a mid-trip circuit breaker (located between the +VDC and the load) with built-in auxiliary switch, using a bi-color LED, negative ground system.

Figure 13:
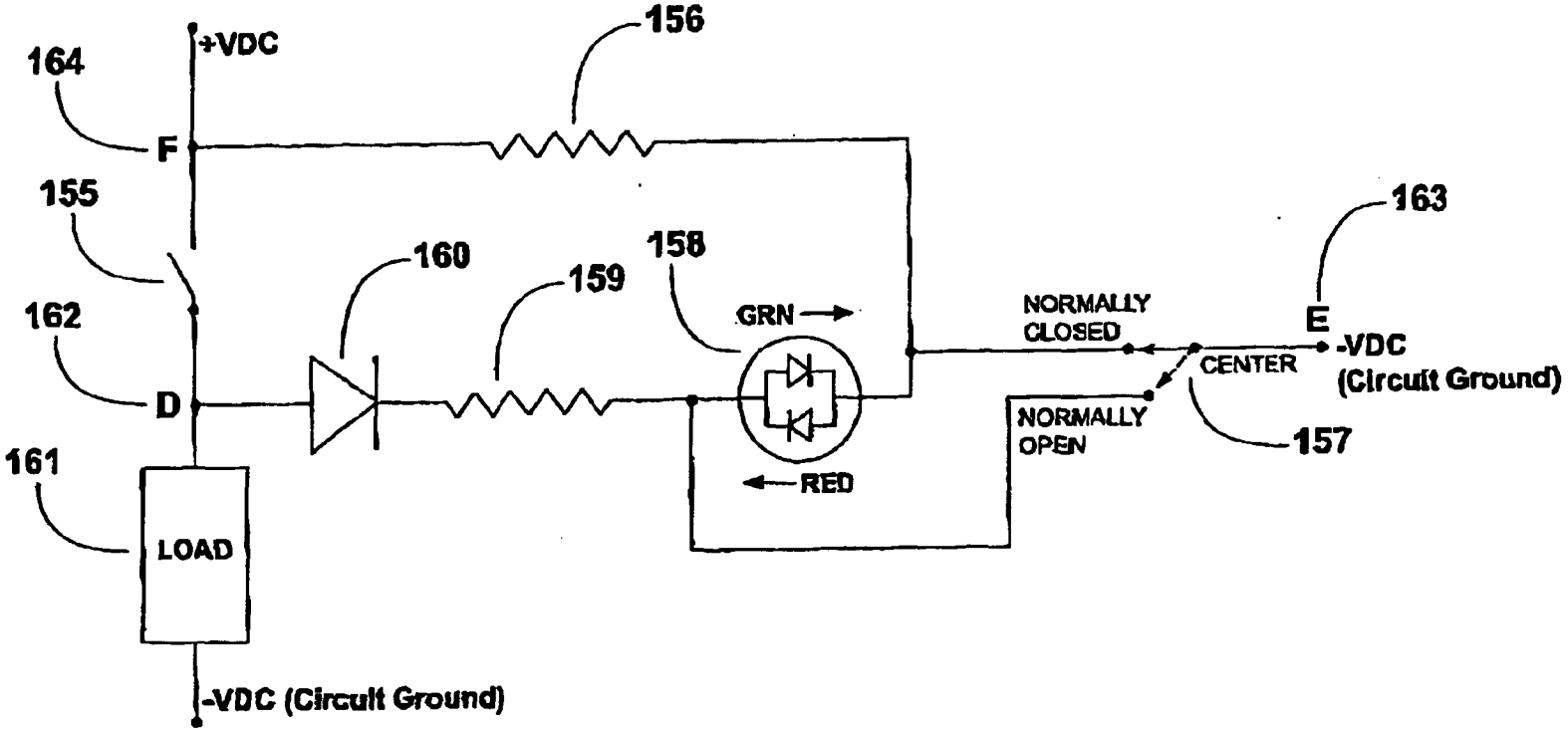
FIG. 13 is a circuit diagram of the Lighted Status Indicator circuit, where the circuit supports a lighted position/status indicator for a mid-trip circuit breaker, with a built-in auxiliary switch. This circuit uses a bi-color LED, with the circuit breaker located between the positive side of power supply and load, and is designed for a negative ground DC system.

Description:

FIG. 13 illustrates how the status indicator circuit in FIG. 9 can be modified for use in a negative ground DC system.

Elements of the FIG. 13 Circuit:

| | |
|---|---|
| 155- | Circuit Breaker |
| 156- | Resistor |
| 157- | Auxiliary Switch |
| 158- | Bi-Color LED |
| 159- | Resistor |
| 160- | Diode |
| 161- | Load |
| 162- | Point "D" |
| 163- | Point "E" |
| 164- | Point "F" |

Function:

The circuit in FIG. 13 functions identically to the circuit in FIG. 9, except that the current now flows from points D 162 and F 164 to point E 163 (passing through the components on each of the paths).

Item 14: Lighted position/status indicator for a mid-trip circuit breaker, with built-in auxiliary switch, using bi-color LED, circuit breaker located between the positive side of power supply and load, with current limiting diodes, for a negative ground DC system.

Figure 14:
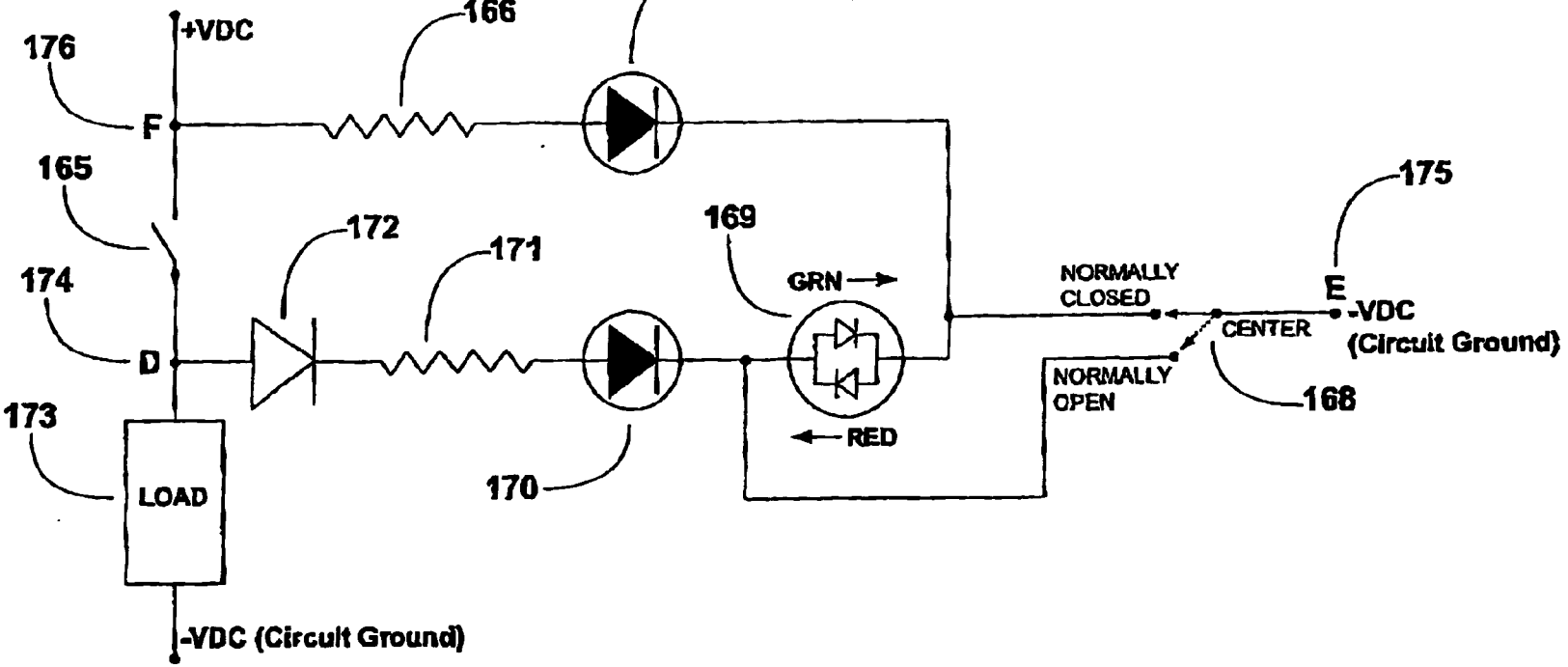
FIG. 14 is the same as FIG. 13, except that the circuit now incorporates current limiting diodes. This circuit is designed for a negative ground DC system.

Description:

The circuit in FIG. 14 adds two current-limiting diodes, 170 and 167, in series with the resistors, 171 and 166, to the circuit diagrammed in FIG. 13.

Elements of the FIG. 14 Circuit:

| | |
|---|---|
| 165- | Circuit Breaker |
| 166- | Resistor |
| 167- | Current-Limiting Diode |
| 168- | Auxiliary Switch |
| 169- | Bi-Color LED |
| 170- | Current-Limiting Diode |
| 171- | Resistor |
| 172- | Diode |
| 173- | Load |
| 174- | Point "D" |
| 175- | Point "E" |
| 176- | Point "F" |

Function:

The circuit in FIG. 14 functions identically to the circuit in FIG. 10, except that the current now flows from points D 174 and F 176 to point E 175 (passing through the components on each of the paths).

Item 15: Lighted position/status indicator for a mid-trip circuit breaker, with built-in auxiliary switch, using bi-color LED, circuit breaker located between line and the load, for use with an AC power supply.

Figure 15:
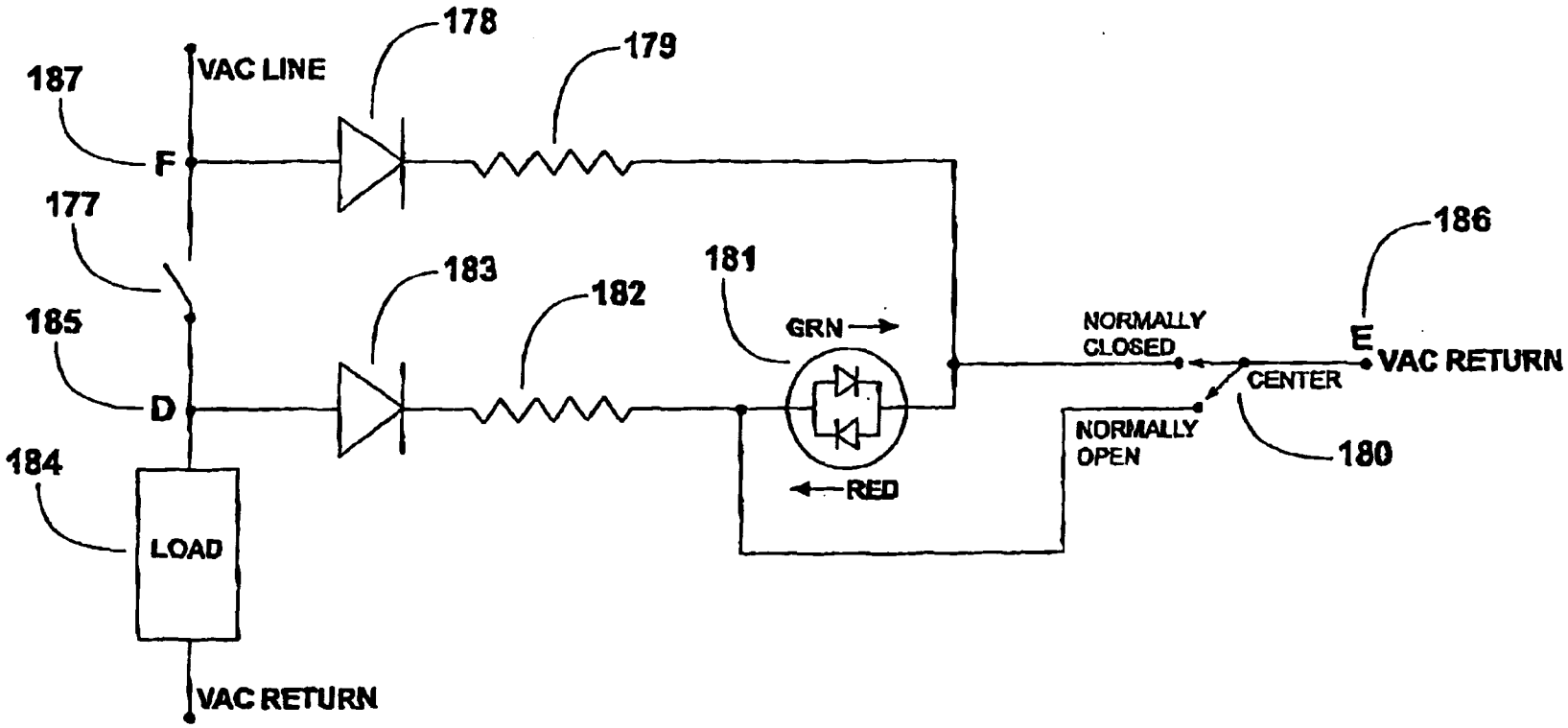
FIG. 15 is the same as FIG. 13, except that the circuit has been altered to also work with an AC power supply.

Description:

FIG. 15 adds a diode, 178 (similar to the diode 183), between junction point F 187 and resistor 179, to the circuit diagrammed in FIG. 13.

Elements of the FIG. 15 Circuit:

| | |
|---|---|
| 177- | Circuit Breaker |
| 178- | Diode |
| 179- | Resistor |
| 180- | Auxiliary Switch |
| 181- | Bi-Color LED |
| 182- | Resistor |
| 183- | Diode |
| 184- | Load |
| 185- | Point "D" |

-continued

| | |
|---|---|
| 186- | Point "E" |
| 187- | Point "F" |

Function:

The addition of this diode 178 allows the circuit to be used with AC power supplies, as well as with DC power supplies (negative ground systems). The functionality of the circuit remains the same, except that the current will now flow in half cycles in either direction through the LED 181.

Item 16: Lighted position/status indicator for a mid-trip circuit breaker, with built-in auxiliary switch, using bi-color LED, circuit breaker located between line and the load, for use with an AC power supply, with current-limiting diodes.

Figure 16:
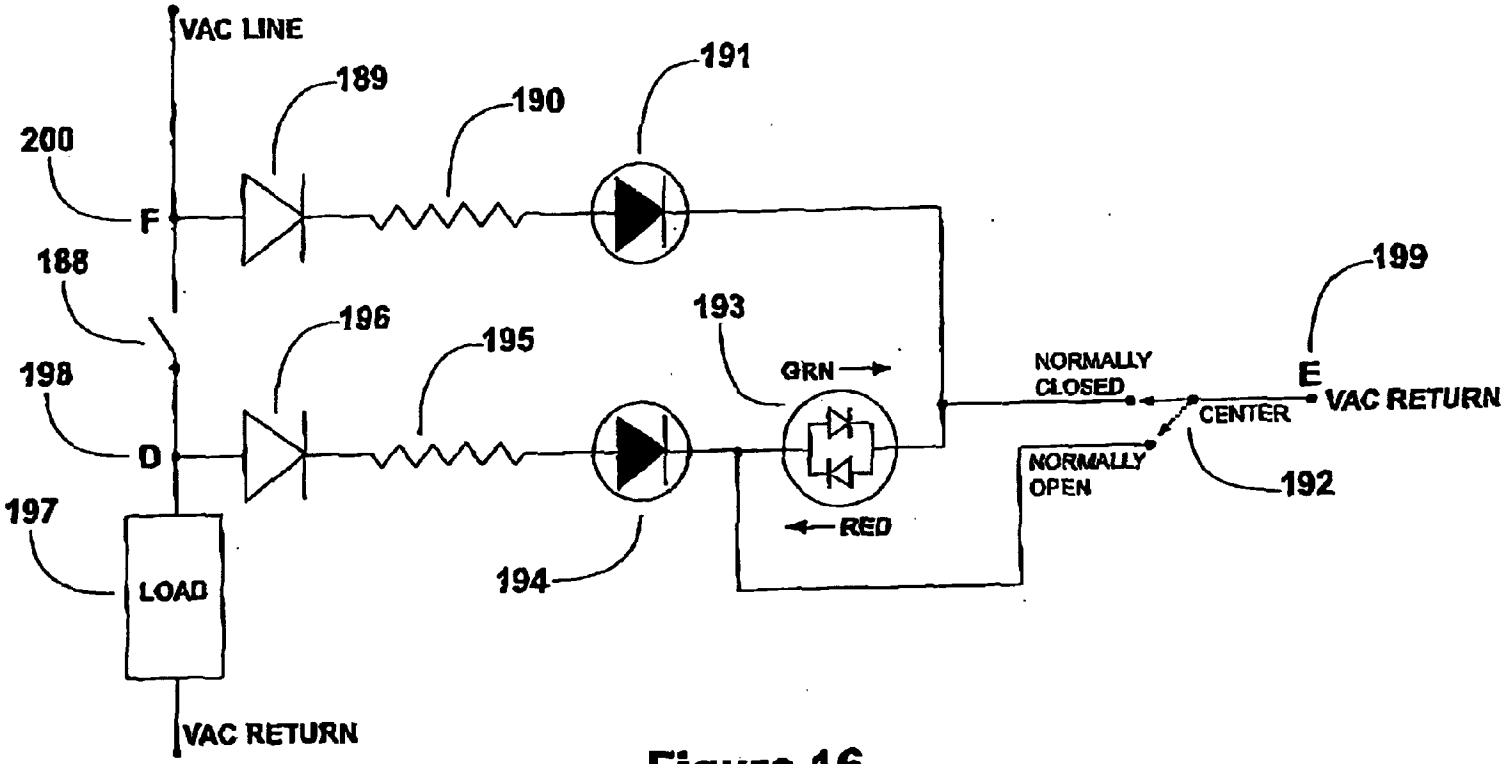
FIG. 16 is the same as FIG. 13, except that the circuit incorporates both the current-limiting diodes and AC power supply support.

Description:

By adding the current-limiting diodes, 194 and 191, to the circuit shown on FIG. 15, a wider AC supply voltage range will be obtained. FIG. 16 shows this configuration.

Elements of the FIG. 16 Circuit

| | |
|---|---|
| 188- | Circuit Breaker |
| 189- | Diode |
| 190- | Resistor |
| 191- | Current-Limiting Diode |
| 192- | Auxiliary Switch |
| 193- | Bi-Color LED |
| 194- | Current-Limiting Diode |
| 195- | Resistor |
| 196- | Diode |
| 197- | Load |
| 198- | Point "D" |
| 199- | Point "E" |
| 200- | Point "F" |

Function:

The addition of more current-limiting diodes, in series, with the diodes, 194 and 191, will increase the AC supply voltage limit (as explained under Item 4).

This circuit would also function with just the two current-limiting diodes, 194 and 191, and without the resistors, 195 and 190.

Item 17: Lighted position/status indicator for a mid-trip circuit breaker (located between the +VDC and the load) with built-in auxiliary switch, using a bi-color LED, for a positive ground system, lower power dissipation option.

Figure 17:
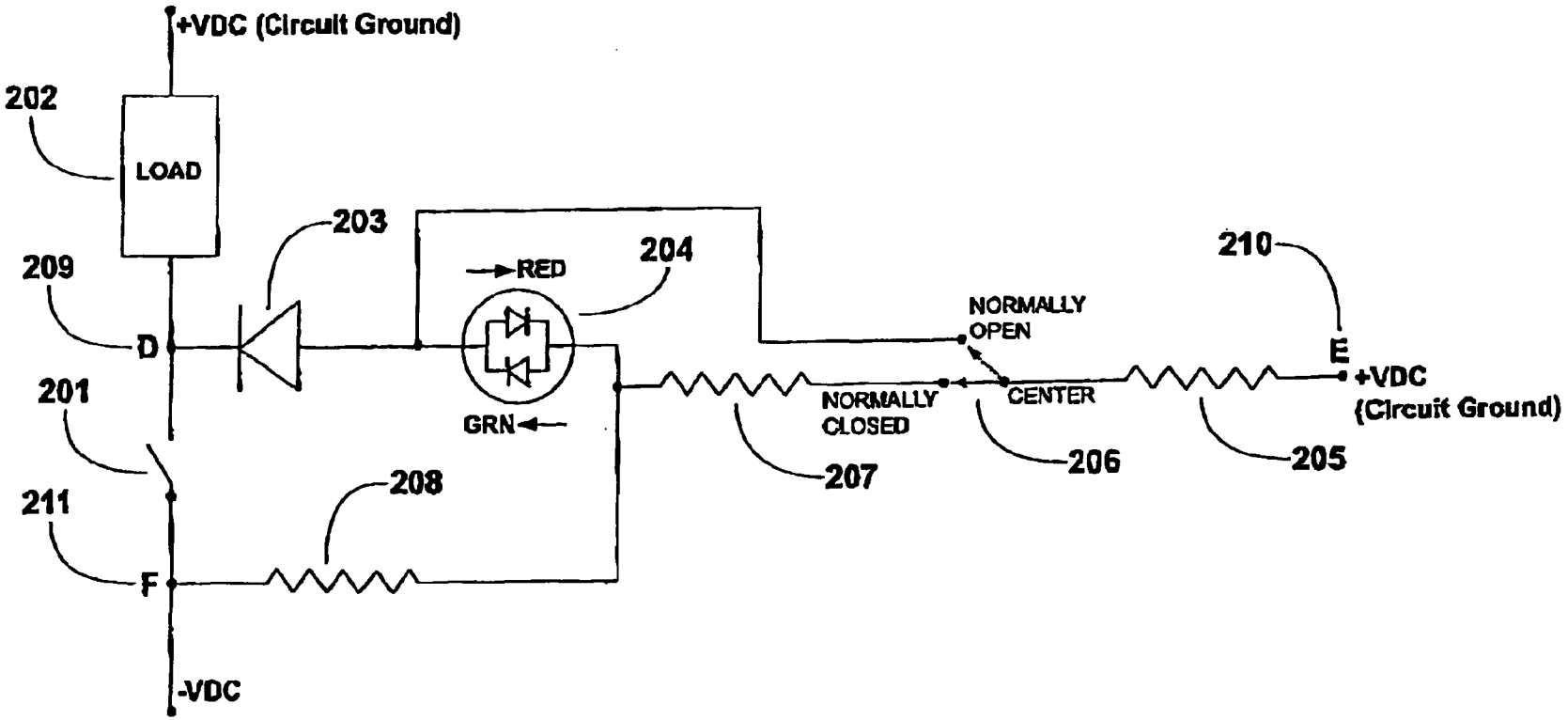
FIG. 17 is a circuit diagram of the Lighted Status Indicator circuit where the circuit supports a lighted position/status indicator for a mid-trip circuit breaker, with built-in auxiliary switch, using bi-color LED, for a positive ground DC system. This circuit represents a lower power dissipation option than that shown in FIG. 9.

Description:

The circuit in FIG. 17 contains three resistors (207, 208, and 205), a diode (203), and a bi-color LED 204 that indicates the status of the circuit breaker. The FIG. 17 circuit modifies the FIG. 9 circuit by moving the resistor 207 to a point between resistor 208 and the "normally closed" contact of the auxiliary switch 206, and adding a third resistor 205 to between the auxiliary switch 206 and point E 210 (+VDC supply). When using the FIG. 17 circuit in different applications, one side of the resistor 205 should always remain connected to the +VDC supply.

Elements of the FIG. 17 Circuit:

| | |
|---|---|
| 201- | Circuit Breaker |
| 202- | Load |
| 203- | Diode |
| 204- | Bi-Color LED |

-continued

| | |
|---|---|
| 205- | Resistor |
| 206- | Auxiliary Switch |
| 207- | Resistor |
| 208- | Resistor |
| 209- | Point "D" |
| 210- | Point "E" |
| 211- | Point "F" |

Function:

This circuit dissipates less power than the circuit in FIG. 9, for the same LED current. Lower power dissipation is implemented via the addition of the third resistor 205. When the auxiliary switch 206 is in the "normally closed" position, the current flow is from point E 210 through the resistors 205 and 207, through the LED 204, the diode 203, the circuit breaker 201, and into the negative side of the power supply. Because the voltage drop across the LED 204 and the diode 203 is very low in comparison to the VDC, the current that flows through the resistor 208 to the negative side of the supply is minimal.

When the auxiliary switch 206 is in the "normally open" position, the current flow will be from point E 210, through the resistor 205, the LED 204, and the resistor 208, and into the negative side of the power supply.

If resistor values are chosen so that resistor 207=resistor 208, for an optimum current value, the current levels through the LED 204 at both conditions ("RED" and "GREEN") will be very close to each other. Current flow is less when the breaker is manually set to the OFF position (resistors 207, 208, and 205 are in series).

Item 18: Lighted position/status indicator for a mid-trip circuit breaker, with built-in auxiliary switch, using bi-color LED, lower power dissipation option, with a current-limiting diode, for a positive ground DC system.

Figure 18:
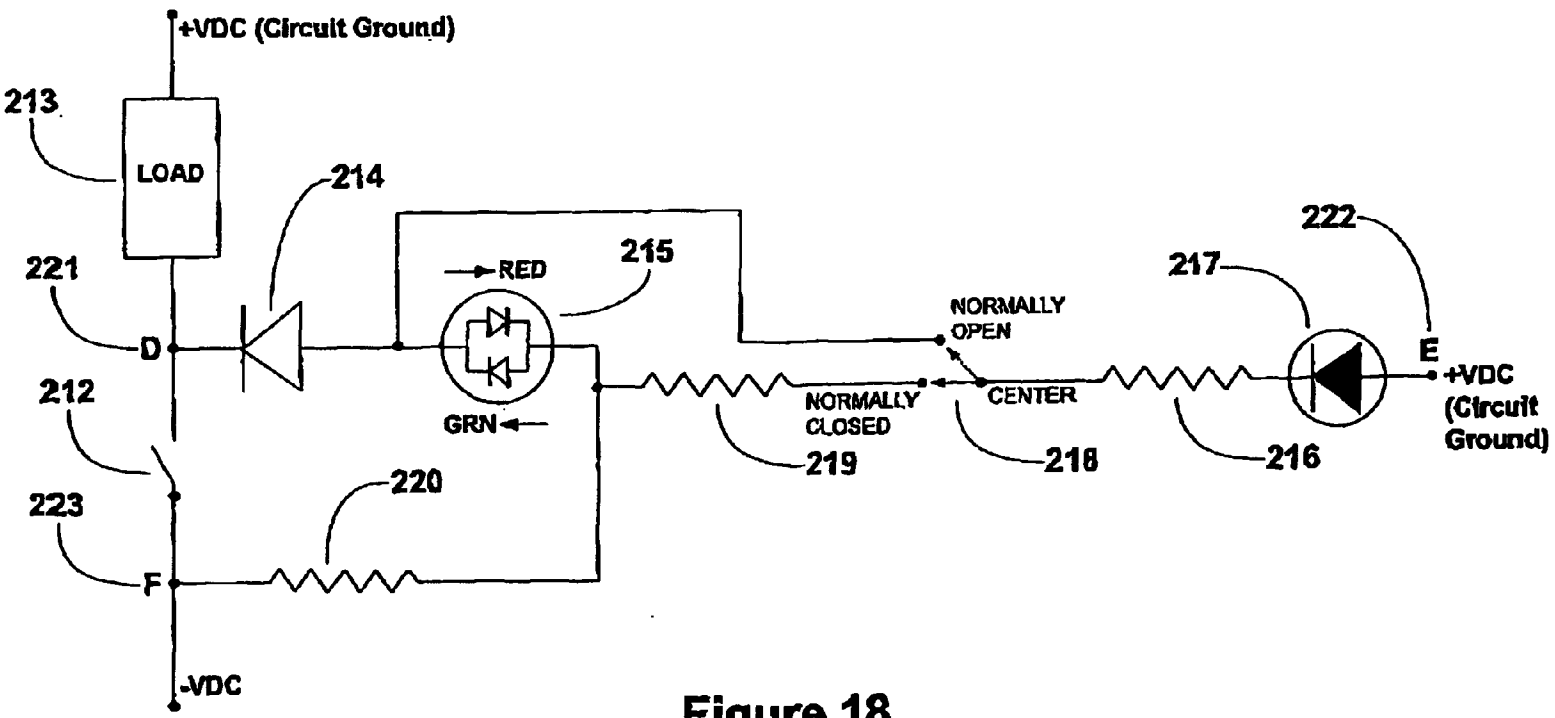
FIG. 18 is the same as FIG. 17, except that the circuit now includes a current-limiting diode.

Description:

The circuit in FIG. 18 adds a current-limiting diode 217, in series, between the resistor 216 and point E 222, to the circuit diagrammed in FIG. 17.

Elements of the FIG. 18 Circuit:

| | |
|---|---|
| 212- | Circuit Breaker |
| 213- | Load |
| 214- | Diode |
| 215- | Bi-Color LED |
| 216- | Resistor |
| 217- | Current-Limiting Diode |
| 218- | Auxiliary Switch |
| 219- | Resistor |
| 220- | Resistor |
| 221- | Point "D" |
| 222- | Point "E" |
| 223- | Point "F" |

Function:

Adding the diode 217 increases the DC power supply voltage tolerated, while keeping the current through the LED 215 within the desired limits.

The FIG. 18 circuit could also be modified to function without the resistor 216, and with the resistor 219 replaced with a jumper wire (a zero ohm resistor).

Item 19: Lighted position/status indicator for a mid-trip circuit breaker, with built-in auxiliary switch, using bi-color LED, lower power dissipation option, for use with AC power supplies.

Figure 19:
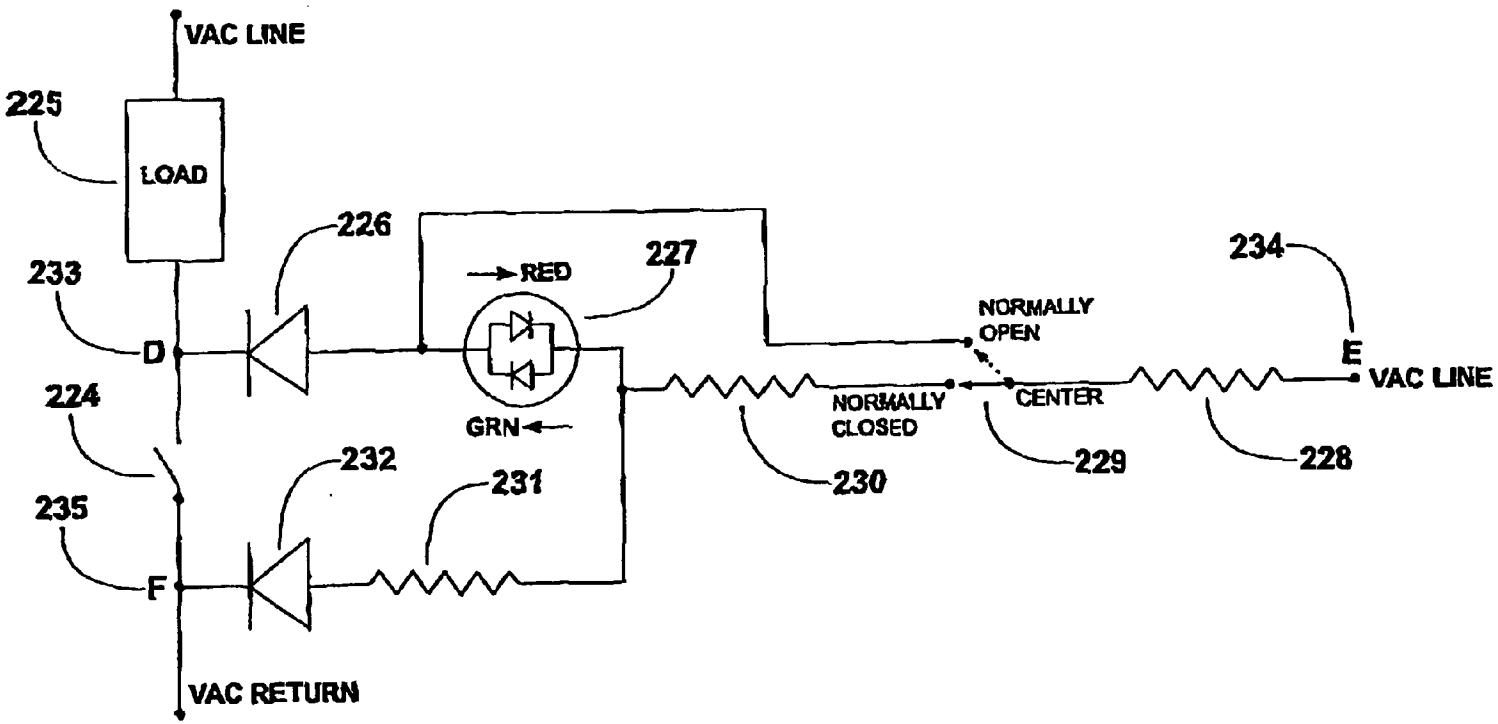
FIG. 19 is the same as FIG. 17, except that the circuit has been altered to also work with an AC power supply.

Description:

FIG. 19 modifies the circuit shown in FIG. 17, adding an additional diode 232 (similar to the diode CR 226) between point F 235 and the resistor 231.

Elements of the FIG. 19 Circuit:

| | |
|---|---|
| 224- | Circuit Breaker |
| 225- | Load |
| 226- | Diode |
| 227- | Bi-Color LED |
| 228- | Resistor |
| 229- | Auxiliary Switch |
| 230- | Resistor |
| 231- | Resistor |
| 232- | Diode |
| 233- | Point "D" |
| 234- | Point "E" |
| 235- | Point "F" |

Function:

Adding the extra diode 232 allows the circuit to be used with both AC and positive ground DC power supplies.

Item 20: Lighted position/status indicator for a mid-trip circuit breaker, with built-in auxiliary switch, using bi-color LED, with current-limiting diode, incorporating the lower power dissipation option, for use with AC power supplies.

Figure 20:
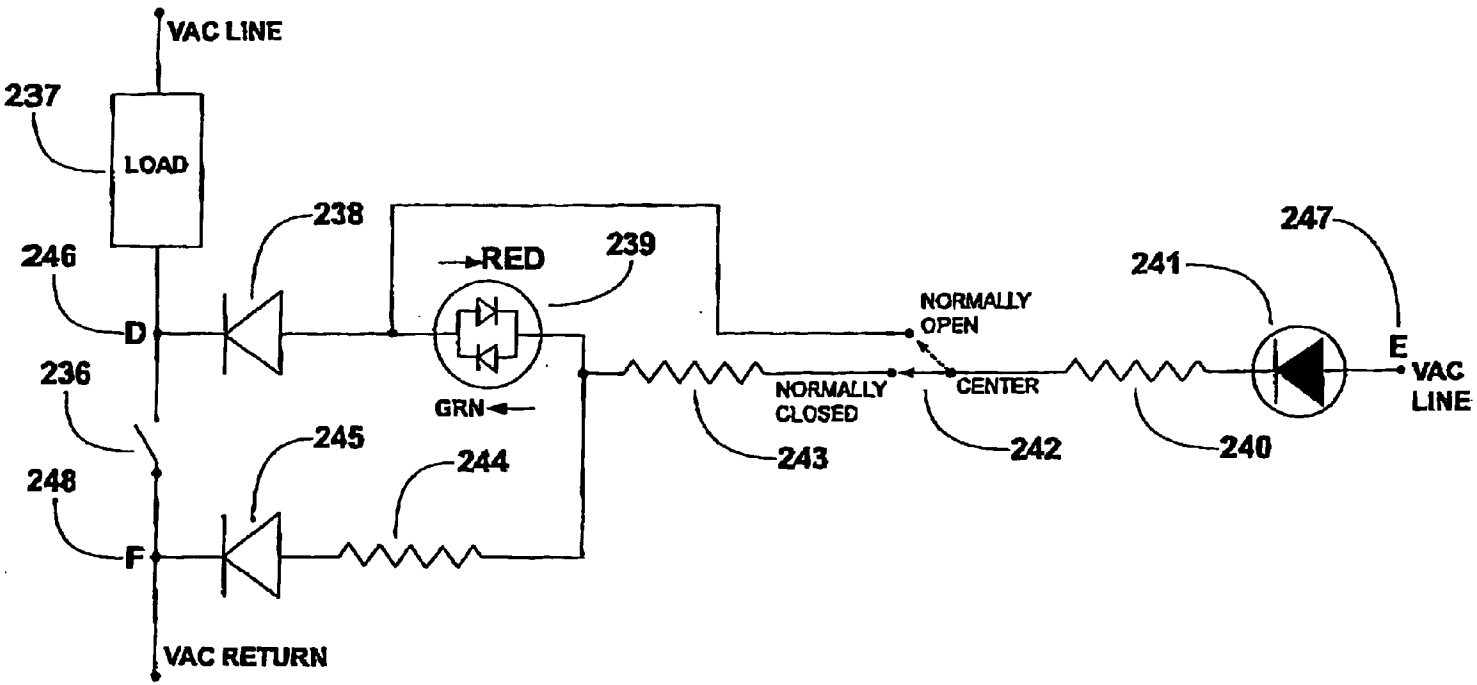
FIG. 20 is the same as FIG. 17, except that the circuit incorporates both the current-limiting diode and AC power supply support.

Description:

The circuit shown in FIG. 20 is identical to that in FIG. 19, except that a current-limiting diode 241 has been added between the resistor 240 and point E 247 (VAC Return).

Elements of the FIG. 20 Circuit:

| | |
|---|---|
| 236- | Circuit Breaker |
| 237- | Load |
| 238- | Diode |
| 239- | Bi-Color LED |
| 240- | Resistor |
| 241- | Current-Limiting Diode |
| 242- | Auxiliary Switch |
| 243- | Resistor |
| 244- | Resistor |
| 245- | Diode |
| 246- | Point "D" |
| 247- | Point "E" |
| 248- | Point "F" |

Function:

The addition of the current-limiting diode 241 allows a wider AC (or positive DC ground) supply voltage range to be tolerated.

Item 21: Lighted position/status indicator for a mid-trip circuit breaker with built-in auxiliary switch, using bi-color LED, with the circuit breaker located between the positive side of power supply and load, for a negative ground DC system, lower power dissipation option.

Figure 21:
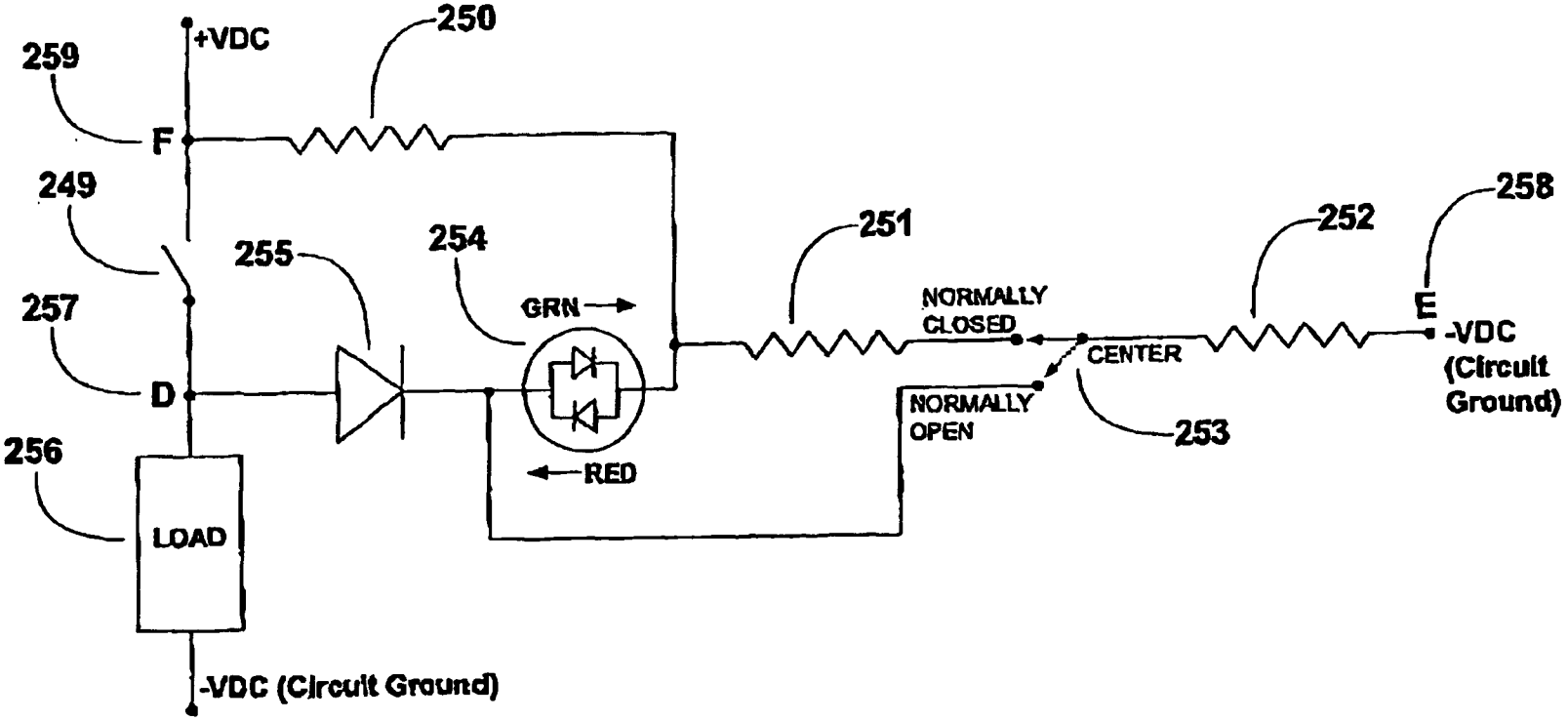
FIG. 21 is a circuit diagram of the of the Lighted Status Indicator circuit where the circuit breaker is located between the positive side of power supply and load, for a negative ground DC system, that incorporates the lower power dissipation option.

Description:

The circuit in FIG. 21 shows how the FIG. 17 circuit can be altered to accommodate a negative ground DC system. In the FIG. 21 circuit, the circuit breaker 249 is located between the positive side of power supply and load 256. This version of the lighted status indicator circuit still supports a mid-trip circuit breaker with a built-in auxiliary switch 253, and incorporates the lower power dissipation option.

Elements of the FIG. 21 Circuit:

| | |
|---|---|
| 249- | Circuit Breaker |
| 250- | Resistor |
| 251- | Resistor |

-continued

| | |
|---|---|
| 252- | Resistor |
| 253- | Auxiliary Switch |
| 254- | Bi-Color LED |
| 255- | Diode |
| 256- | Load |
| 257- | Point "D" |
| 258- | Point "E" |
| 259- | Point "F" |

Function:

Except for the changes required to support a negative ground DC system, the circuit in FIG. 21 functions identically to the FIG. 17 circuit, dissipating less power than the standard lighted status indicator circuit (negative ground) for a mid-trip breaker (shown in FIG. 13).

Item 22: Lighted position/status indicator for a mid-trip circuit breaker with built-in auxiliary switch, using bi-color LED, with the circuit breaker located between the positive side of power supply and load, for a negative ground DC system, with current-limiting diode, lower power dissipation option.

Figure 22:
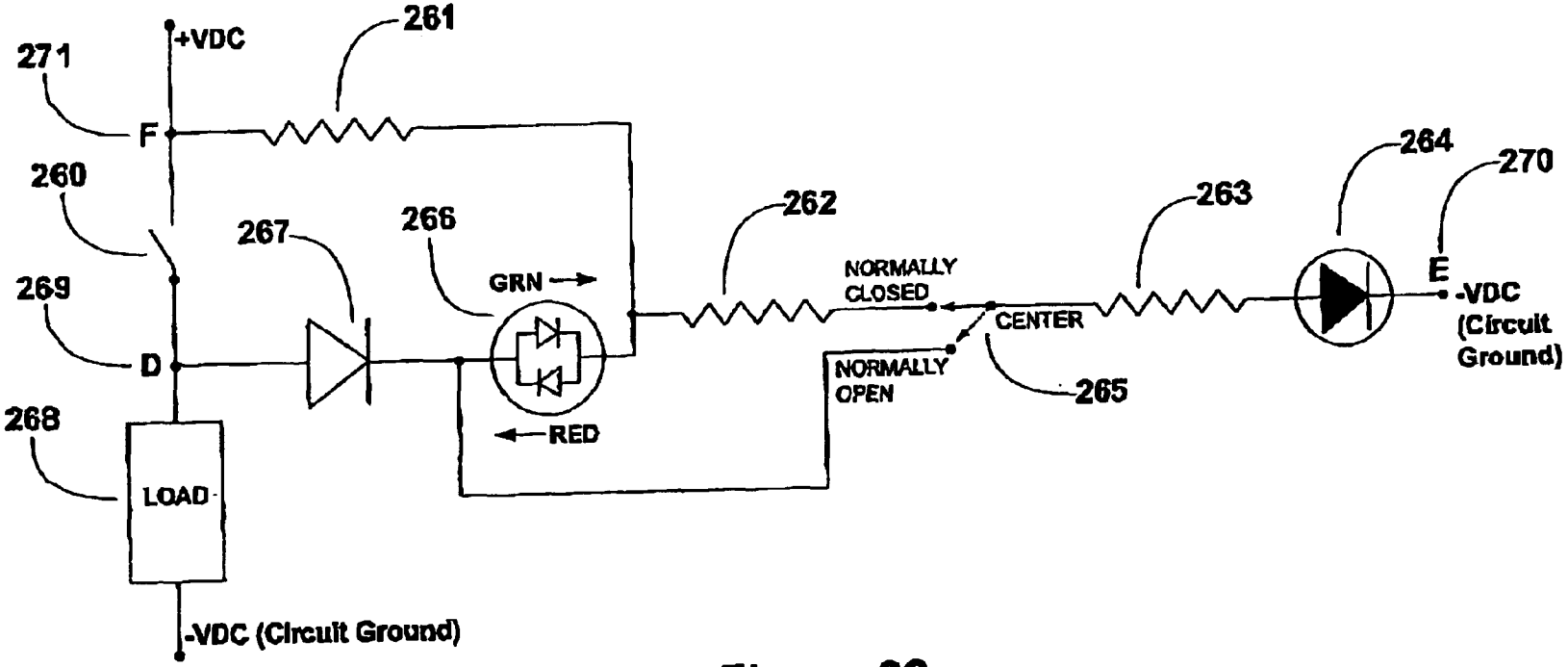
FIG. 22 is the same as FIG. 21, except that the circuit now includes a current-limiting diode.

Description:

FIG. 22 adds a current-limiting diode 264, in series, between the resistor 263 and point E 270, to the circuit diagrammed in FIG. 21.

Elements of the FIG. 22 Circuit:

| | |
|---|---|
| 260- | Circuit Breaker |
| 261- | Resistor |
| 262- | Resistor |
| 263- | Resistor |
| 264- | Current-Limiting Diode |
| 265- | Auxiliary Switch |
| 266- | Bi-Color LED |
| 267- | Diode |
| 268- | Load |
| 269- | Point "D" |
| 270- | Point "E" |
| 271- | Point "F" |

Function:

Adding the diode 264 increases the DC power supply voltage tolerated, while keeping the current through the LED 266 within the desired limits.

The FIG. 22 circuit could also be modified to function without the resistor 263, and with the resistor 262 replaced with a jumper wire (a zero ohm resistor).

Item 23: Lighted position/status indicator for a mid-trip circuit breaker, with built-in auxiliary switch, using bi-color LED, with the circuit breaker located between the positive side of power supply and load, for an AC (or negative ground DC) system, lower power dissipation option.

Figure 23:
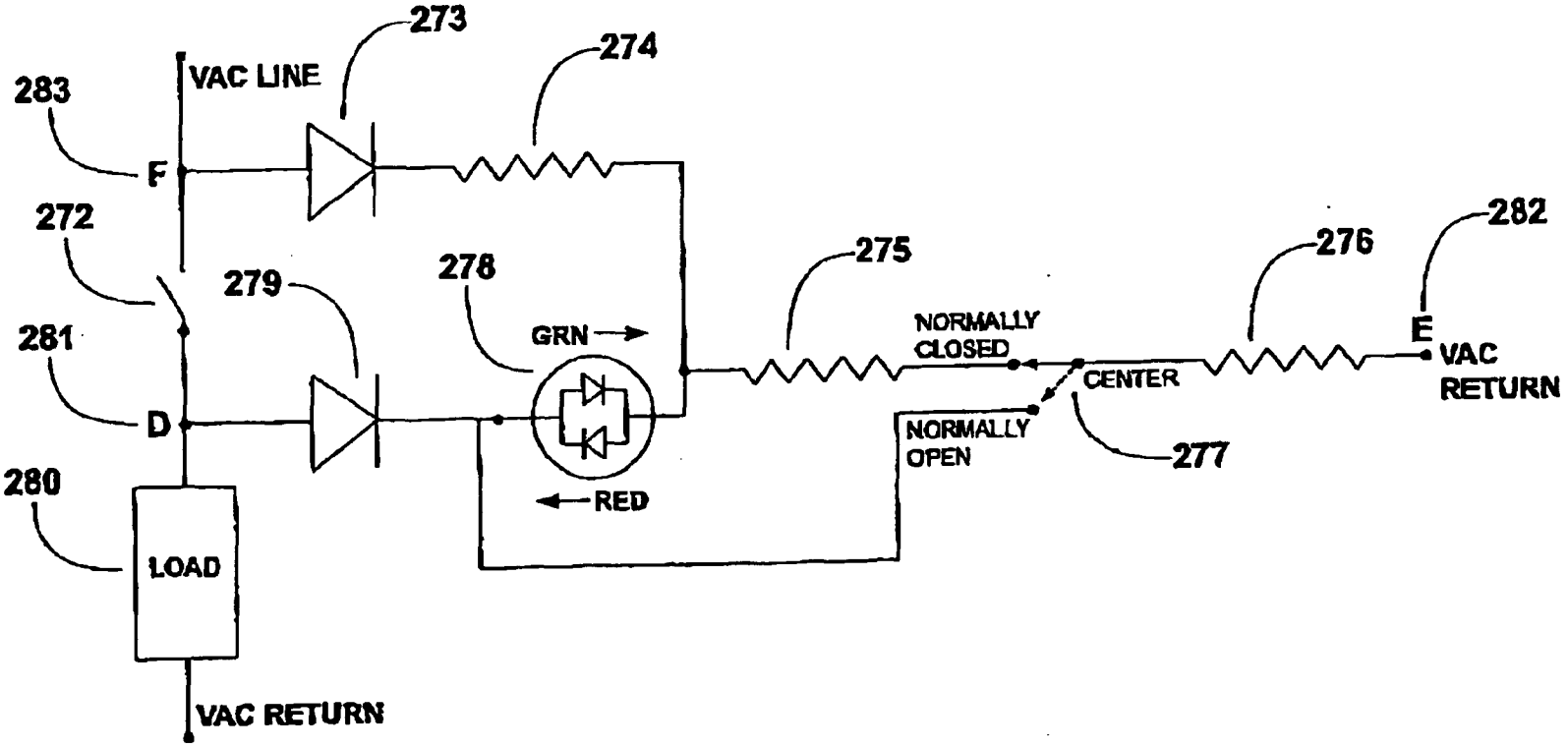
FIG. 23 is the same as FIG. 21, except that the circuit has been altered to also work with an AC power supply.

Description:

FIG. 23 modifies the circuit shown in FIG. 21, adding an additional diode 273 (similar to the diode CR 279) between point F 283 and the resistor 274.

Elements of the FIG. 23 Circuit:

| | |
|---|---|
| 272- | Circuit Breaker |
| 273- | Diode |
| 274- | Resistor |
| 275- | Resistor |

-continued

| | |
|---|---|
| 277- | Auxiliary Switch |
| 278- | Bi-Color LED |
| 279- | Diode |
| 280- | Load |
| 281- | Point "D" |
| 282- | Point "E" |
| 283- | Point "F" |

Function:

Adding the extra diode 273 allows the circuit to be used with both AC and negative ground DC power supplies.

Item 24. Lighted position/status indicator for a mid-trip circuit breaker with built-in auxiliary switch, using bi-color LED, with the circuit breaker located between the positive side of power supply and load, for an AC (or negative ground DC) system, with current-limiting diode, lower power dissipation option.

Figure 24:
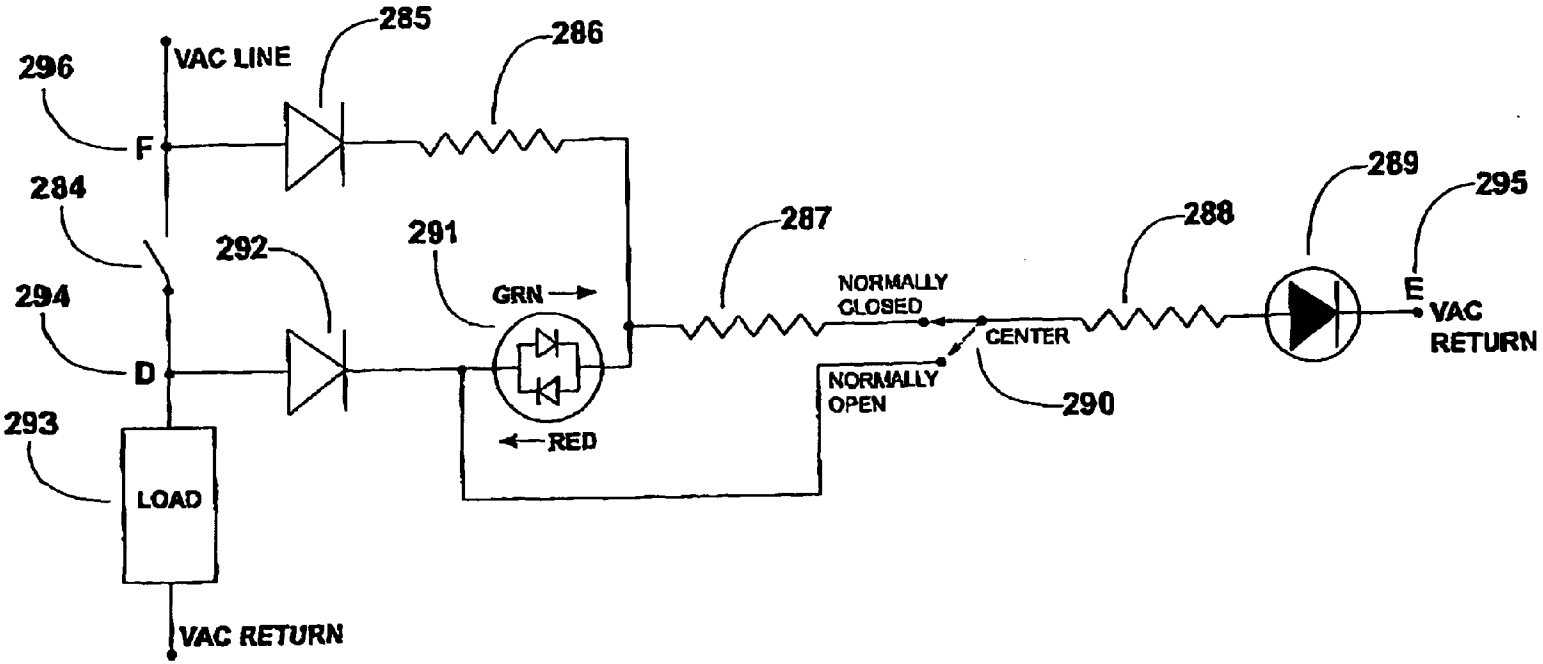
FIG. 24 is the same as FIG. 21, except that this version of the circuit incorporates both the current-limiting diode and AC power supply support.

Description:

The circuit shown in FIG. 24 is identical to that in FIG. 23, except that a current-limiting diode 289 has been added between the resistor 288 and point E 295 (VAC Return).

Elements of the FIG. 24 Circuit:

| | |
|---|---|
| 284- | Circuit Breaker |
| 285- | Diode |
| 286- | Resistor |
| 287- | Resistor |
| 288- | Resistor |
| 289- | Current-Limiting Diode |
| 290- | Auxiliary Switch |
| 291- | Bi-Color LED |
| 292- | Diode |
| 293- | Load |
| 294- | Point "D" |
| 295- | Point "E" |
| 296- | Point "F" |

Function:

The addition of the current-limiting diode 289 allows a wider AC (or negative DC ground) supply voltage range to be tolerated.

Item 25: Lighted position/status indicator, with circuit alarm test feature (simulation of tripped auxiliary switch, circuit breakers automatically tripped), for a positive ground DC system.

Figure 25:
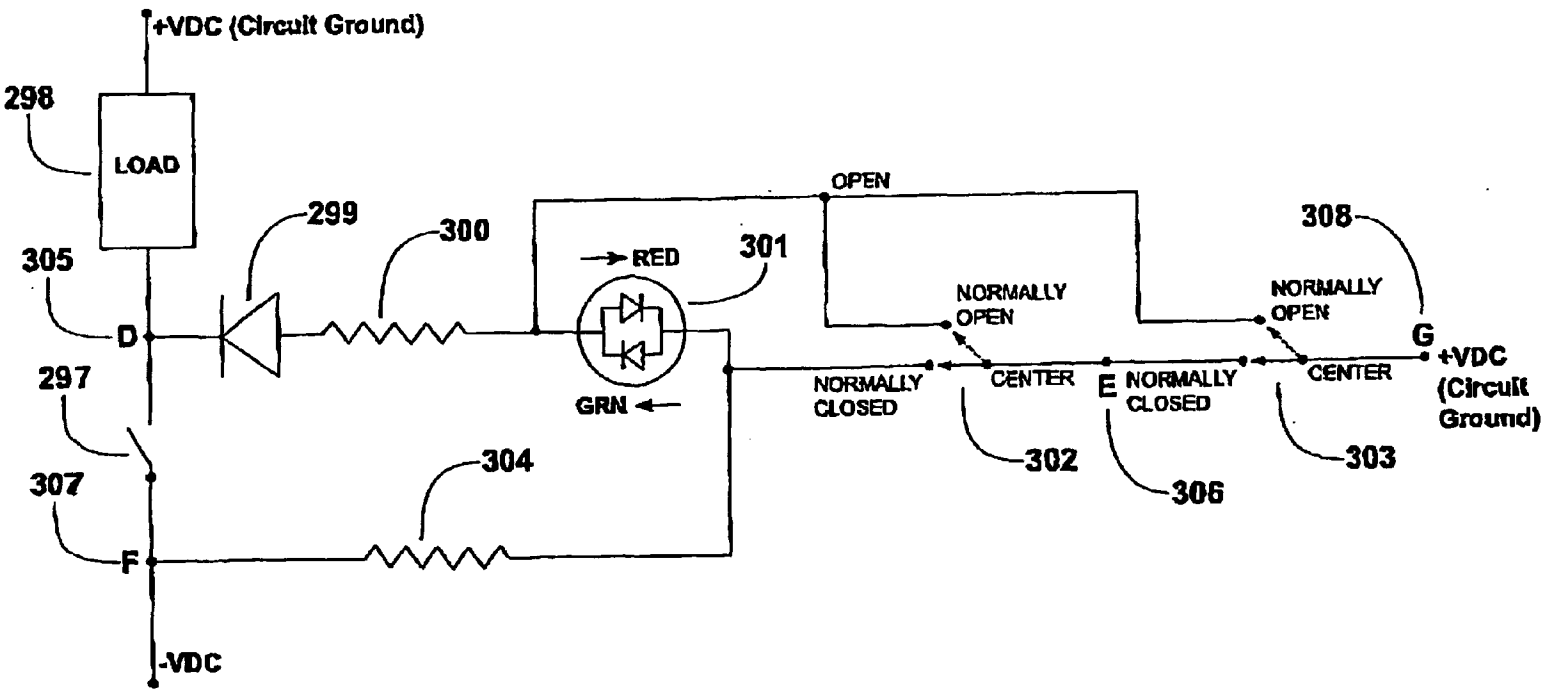
FIG. 25 is a circuit diagram of the Lighted Status Indicator circuit where the circuit supports the lighted position/status indicator as shown in FIG. 9, and incorporates a circuit alarm test feature.

Description:

The bulk of the circuit shown in FIG. 25 is identical to the FIG. 9 circuit—with one important exception. A test function has been added to the FIG. 9 circuit that allows the user to test the lighted status indicator circuit with on push-button test switch.

This test function is implemented by the addition of a momentary test switch 303 to the circuit. The momentary test switch's 303 "normally open" contact is connected to the "normally open" contact of the auxiliary switch 302, and its "normally closed" contact is connected to the center position of the auxiliary switch (point E) 306. Finally, the center position of the momentary test switch 303 is connected to point G 308 (+VDC).

Elements of the FIG. 25 Circuit:

| | |
|---|---|
| 297- | Circuit Breaker |
| 298- | Load |

-continued

| | |
|---|---|
| 299- | Diode |
| 300- | Resistor |
| 301- | Bi-Color LED |
| 302- | Auxiliary Switch |
| 303- | Momentary Test Switch |
| 304- | Resistor |
| 305- | Point "D" |
| 306- | Point "E" |
| 307- | Point "F" |
| 308- | Point "G" |

Function:

Under normal conditions (when the circuit breaker is in the CLOSED state), most of the current flows from point G 308 (+VDC), through the "normally closed" contact of the momentary test switch 303, through the auxiliary switch 302, the LED 301, the resistor 300, the diode 299, the circuit breaker 297, and then to point F 307 (negative of the DC supply). Part of the current branches off at the auxiliary switch 302 and flows to point F 307 (passing through the resistor 304).

When the momentary test switch 303 is depressed, the current flowing from point G 308 changes direction. It will flow from point G 308 to the "normally open" contact of the momentary test switch 303, and then will run in two paths to point F 307. One current path passes through the resistor 300, the diode 299, and the circuit breaker 297. The other path runs through the LED 301, and the resistor 304, resulting in a change of current direction that causes the LED 301 to glow RED.

Since the auxiliary switch 302 and the momentary test switch 303 are in series, the opening of either switch will cause the LED 301 to turn RED. Thus, testing the circuit via the momentary test switch 303 must turn the LED 301 RED, just as the activation of the auxiliary switch 302 would. Since the diode 299 and the resistor 304 are connected to point F 307 (negative or return of the DC power supply) testing the circuit using the momentary test switch 303 will have no impact on the normal supply of power to the load 298.

When the circuit breaker 297 has been manually turned to the OFF position, the only current flow in the circuit is from point G 308 to point F 307 (passing through the momentary test switch 303, the auxiliary switch 302, and the resistor 304).

Activating the momentary test switch 303 will cause the current to pass through the LED 301, the resistor 304, and on to point F 307. Current flowing through the LED 301 in this direction will cause it to turn RED, demonstrating the integrity of the circuit and the LED 301 in case of circuit breaker 297 activation.

Because the voltage polarities across the diode 299 are the same in this case (circuit breaker 297 manually set to the OFF position), no other current flow takes place. Thus the momentary test switch can be used to check the LED 301 RED condition, and associated circuit, whether the circuit breaker 297 is in the CLOSED state or is manually set to the OFF position.

When the circuit breaker 297 has been TRIPPED due to an over-current condition, the position of the auxiliary switch 302 will change, and this change in direction of the current flow through the LED 301 will cause it to glow RED.

In a TRIPPED condition, whether the momentary test switch 303 is pressed or not, the flow of current will run the same direction through the LED 301, and it will continue to glow RED. Therefore the momentary test switch 303 could be activated anytime—regardless of the circuit breaker 297 condition—without disturbing the load 298 functionality.

While the FIG. 25 circuit has been configured to support a positive ground DC system, a similar approach could easily be used for a negative ground DC system. This circuit would require only minor modifications (including reversal of the direction of the diode 299 and bi-color LED 301) to support a circuit breaker located between the positive side of power supply and load 298 (as in the FIG. 13 circuit). The circuit in FIG. 25 may also be built using the lower power dissipation designs previously described.

Item 26: Alarm test circuit for several lighted position/status indicator circuit breakers with auxiliary switch, for a positive ground DC system.

Figure 26:
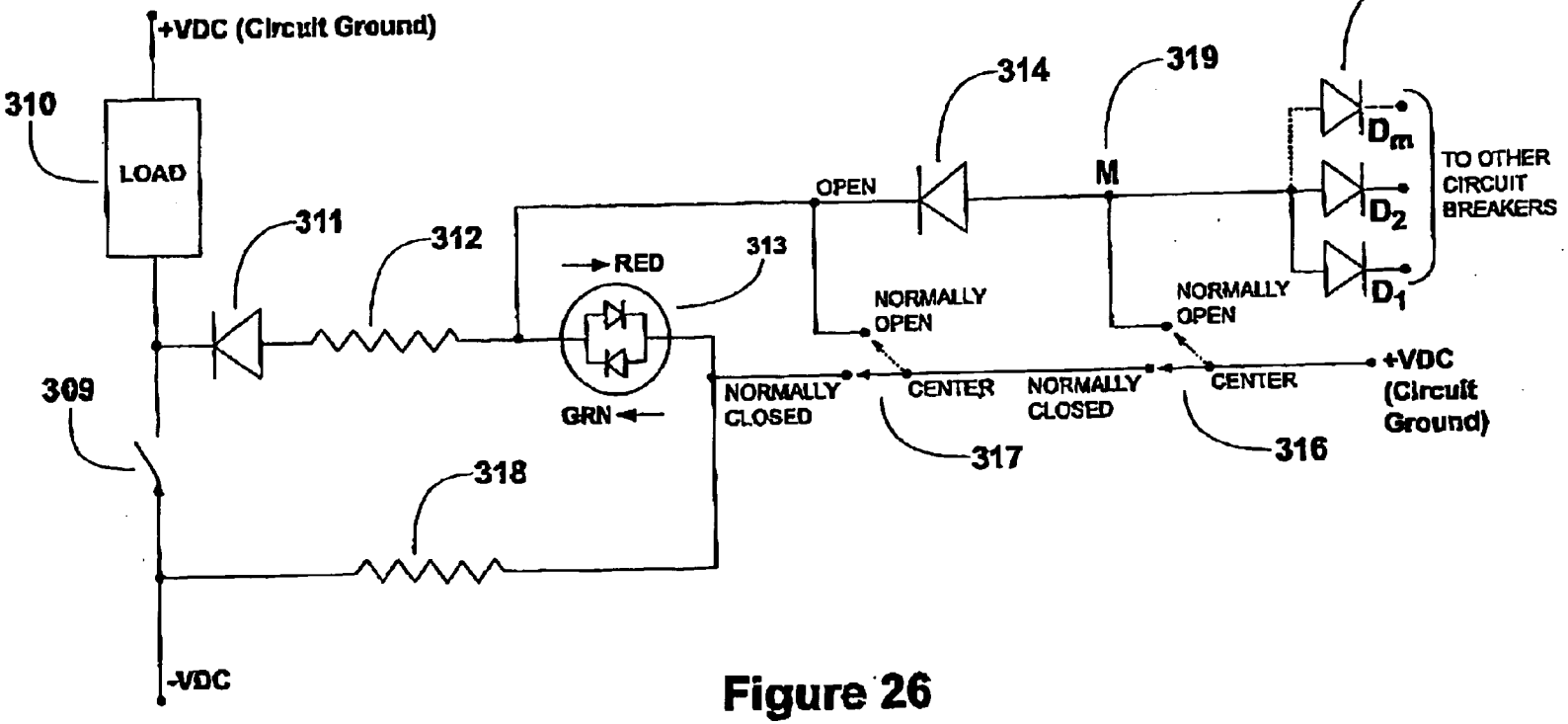
FIG. 26 is a circuit diagram of the Lighted Status Indicator circuit where the circuit supports an alarm test circuit for several lighted position/status indicator circuit breakers.

Description:

FIG. 26 modifies FIG. 25, adding a diode 314 between the "normally open" positions of the auxiliary switch 317 and the momentary test switch 316. The "normally open" position of the momentary test switch 316 (point M 319) is also connected to several circuits similar to that shown in FIG. 25 (with an added diode), through several diodes (D1, D2, . . . and Dn 315).

Elements of the FIG. 26 Circuit:

| | |
|---|---|
| 309- | Circuit Breaker |
| 310- | Load |
| 311- | Diode |
| 312- | Resistor |
| 313- | Bi-Color LED |
| 314- | Diode |
| 315- | Diodes D1 through Dn |
| 316- | Momentary Test Switch |
| 317- | Auxiliary Switch |
| 318- | Resistor |
| 319- | Point "M" |

Function:

Pressing the momentary test switch 316 causes current to flow in the same direction through all of the diodes (Diodes D1 through Dn) 315, all of the connected circuits, and through all of the LEDs associated with those circuits.

If all of these circuits are working properly, all the associated LEDs will turn RED. Therefore, testing of several circuit breaker circuits can be accomplished using a single momentary test switch. The diode 314 and the diodes D1 though Dn 315 serve to isolate each circuit, so that if one circuit breaker is tripped and its auxiliary switch is activated, no current will flow to the other circuits.

While the FIG. 26 circuit(s) have been configured to support a positive ground DC system, a similar approach could easily be used for a negative ground DC system. This circuit would require only minor modifications (including reversal of the direction of the diode 311 and bi-color LED 313) to support a circuit breaker located between the positive side of power supply and load (as in the FIG. 13 circuit). The circuit in FIG. 26 may also be built using the lower power dissipation design previously described.

Item 27: One rack unit power distribution unit using mid-trip circuit breakers with lighted status/position indicator and alarm test circuit, for a positive ground DC system.

Figure 28:
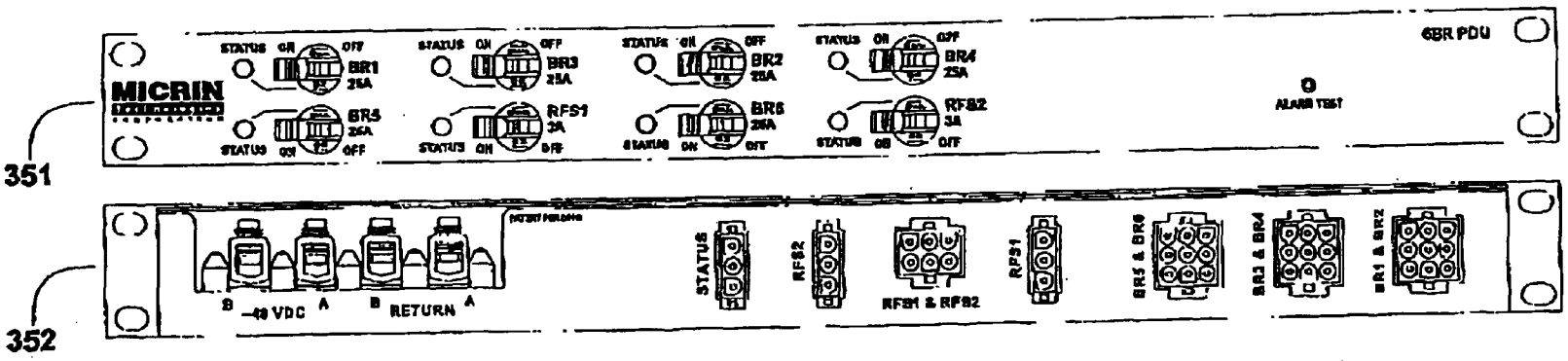
FIG. 28 illustrates the one rack unit PDU, using mid-trip circuit breaker, lighted status/position indicators, and an alarm test circuit, diagrammed in FIG. 27.

Description:

Shown in FIG. 28, the 1 rack unit (RU) power distribution unit (PDU) receives up to two independent sources of DC power at the input, and distributes these two input power streams to several outputs. The total number of outputs that may be supported depends on the total current capability of the input power streams, and on the current requirements of the each output. The 1-RU PDU incorporates many of the technologies claimed in Items 1 through 26.

Depending upon what system in which the PDU is used, either the positive or the negative lines from the input DC power streams will pass through circuit breakers to each output. These circuit breakers may or may not be of the mid-trip variety, and may or may not include auxiliary switches. The auxiliary switch of each circuit breaker could be used either for the remote monitoring of the status of the circuit breakers, or to activate separate circuits for control or alarm purposes.

Included in the 1-RU PDU are lighted status indicator circuits, as well as circuits for remote monitoring of the PDU status, when one or more of its output circuits are interrupted by circuit breaker(s). Output connectors for the 1-RU PDU may be either individual to each output stream, or combined into one or more modules.

The positive and negative of each input line is connected to individual bus bars from which sets of cables flow power to the different outputs, passing through the circuit breakers and lighted status indicator circuits.

Depending on the system configuration, the cables that run the power to the outputs through the circuit breakers are either positive or negative. A second wire of each output (return) that does not run current through the circuit breaker is directly connected to the output. For a positive ground DC system, the negative line goes through the circuit breakers, and all loads are located between the positive side of the power supply and the circuit breakers. In the case of a negative ground DC system the positive line goes through the circuit breakers, and all loads are located between the negative side of the power supply and the circuit breakers.

FIG. 26 diagrams the lighted status indicator circuit used in this type of the system. Two sets of lighted status indicator/breaker group circuits, and a circuit for the remote monitoring of the PDU, are shown in FIG. 27.

In this 1-RU PDU, each set of circuits drives the lighted status indicators associated with the circuit breakers in that set. Each set of circuit breakers also receives power from only one input power stream. The two sets of circuits (each powered by the one of the two separate input power streams) are electrically isolated from each other. A single DPDT (double pole, double throw) momentary test switch 332/347 is used for testing both sets of circuits. One side of the switch is used for one set of circuits and the other side is used for the second set of circuits.

Figure 27:
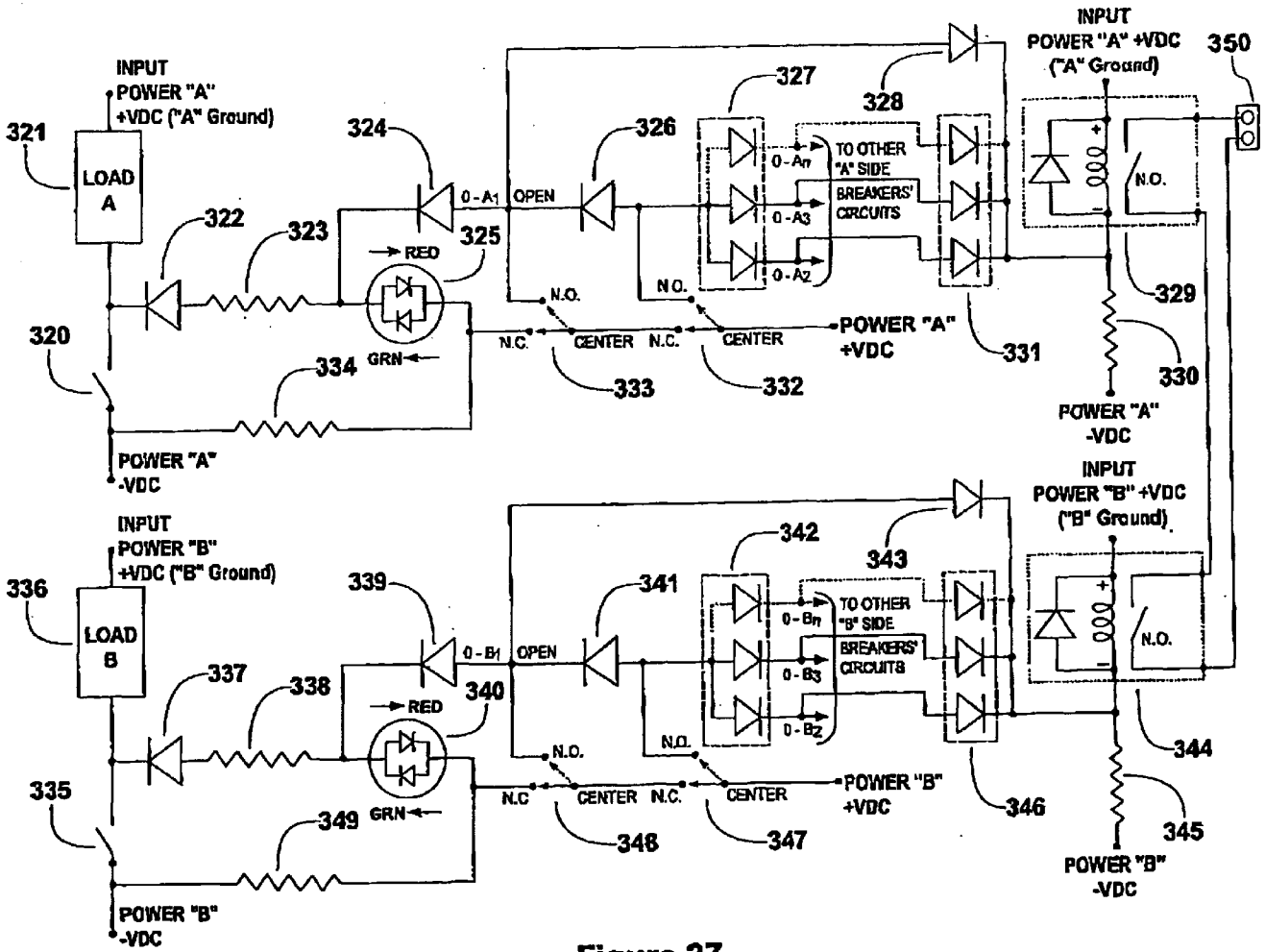
FIG. 27 is a circuit diagram for a one rack unit power distribution unit (PDU) using mid-trip circuit breaker, with lighted status/position indicators and an alarm test circuit, for a positive ground DC system.

Elements of the FIG. 27 Circuit

| | |
|---|---|
| 320- | Circuit Breaker (A-side) |
| 321- | Load (A-side) |
| 322- | Diode (A-side) |
| 323- | Resistor (A-side) |
| 324- | Diode (A-side) |
| 325- | Bi-Color LED (A-side) |
| 326- | Diode (A-side) |
| 327- | Diodes D1 through Dn (A-side) |
| 328- | Diode (A-side) |
| 329- | Relay (A-side) |
| 330- | Resistor (A-side) |
| 331- | Diodes D1 through Dn (A-side) |
| 332- | Momentary Test Switch (A-side) |
| 333- | Auxiliary Switch (A-side) |
| 334- | Resistor (A-side) |
| 335- | Circuit Breaker (B-side) |
| 336- | Load (B-side) |
| 337- | Diode (B-side) |
| 338- | Resistor (B-side) |
| 339- | Diode (B-side) |

-continued

| | |
|---|---|
| 340- | Bi-Color LED (B-side) |
| 341- | Diode (B-side) |
| 342- | Diodes D1 through Dn (B-side) |
| 343- | Diode (B-side) |
| 344- | Relay (B -side) |
| 345- | Resistor (B-side) |
| 346- | Diodes D1 through Dn (B-side) |
| 347- | Momentary Test Switch (B-side) |
| 348- | Auxiliary Switch (B-side) |
| 349- | Resistor (B-side) |
| 350- | PDU Status Output |

Elements of FIG. 28:

| | |
|---|---|
| 351- | PDU, Front View |
| 352- | PDU, Rear View |

Function:

Under normal operating conditions (circuit breakers are in the CLOSED/ON state), when the input power streams are applied, and there has been no over-current condition in any of the circuit breakers, the relays for the input power stream "A" 329 and for the input power stream "B" 344 are activated, and contacts of both relays are closed. The contact closure of relay "A" 329, in series with a similar contact closure for relay "B" 344 (used with input power stream "B"), is used for the remote monitoring of the status of the PDU though a connector 350 on the back of the unit.

Since manually setting any circuit breaker 320/335 to the OFF position does not affect the status circuit for that circuit breaker's alarm, the relay 329/344 will stay energized whether or not any circuit breaker 320/335 is set to the CLOSED/ON position, or is manually turned OFF.

When an over-current condition occurs in any of the circuit breakers 320/335, causing it to trip, or whenever the momentary alarm test switch 332/347 is pressed, the +VDC voltage associated with that breaker 320/335 will reach the negative side of the associated relay coil through the OR-ing diodes. This will cause the relay coils to have approximately the same positive voltage at both ends. Thus the relay 329/344 will no longer be energized, and the relay contact used for the remote monitoring of the PDU will open, indicating either an over-current (TRIPPED) condition, or that an alarm test taking place.

Since the two contacts of the relays "A" and "B" 329/344 are connected to each other in series, an opening of either relay contact will cause an open loop condition in the status circuit, connected to the status connector 350 on the back of the PDU. The absence of either input power "A" or "B" will cause the relay 329/344 for that particular power side not to energize, opening loop of the status output 350, and indicating an alarm condition. The circuit in FIG. 27 may also be built using the lower power dissipation designs previously described.

FIG. 28 shows the front panel 351 and back panel 352 of a six-output, one-RU PDU. The front panel displays the status LED associated with each of the lighted status indicator circuits, while the rear panel shows the final status output connector, as well as the input and output connectors.

Item 28: Compact circuit breaker incorporating a mid-trip switch, a lighted status indicator for the ON/OFF/TRIPPED positions, auxiliary "normally open"/"normally closed" contact points for remote monitoring of the circuit breaker system, and an alarm circuit momentary test switch, for AC or a positive or negative ground DC system.

Figure 29:
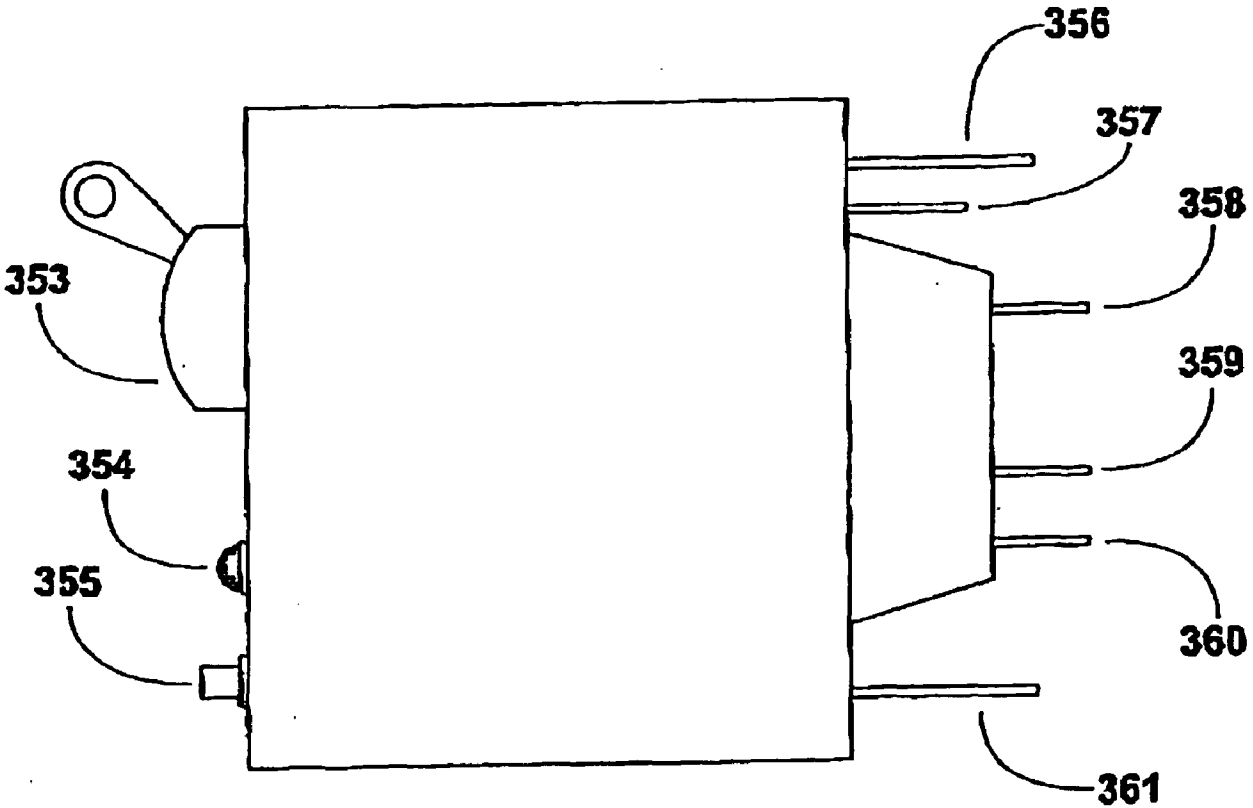
FIG. 29 shows a compact circuit breaker incorporating a mid-trip switch, a lighted status indicator for the ON/OFF/TRIPPED positions, auxiliary "normally open"/"normally closed" contact points for remote monitoring of the circuit breaker system, and an alarm circuit momentary test switch, for AC or positive or negative ground DC systems.

FIG. 29 shows a compact circuit breaker that incorporates a mid-trip switch, a lighted status indicator, auxiliary "normally open"/"normally closed" contact points (358 and 359) for remote monitoring of the breaker, and an alarm circuit momentary test switch 355. With appropriate changes to the internal circuitry (as shown in FIGS. 30 through 34), this design can support AC power supplies, and/or positive or negative ground DC power supplies. Lower power dissipation versions of this circuit could also be used in compact circuit breakers. The compact circuit breaker shown in FIG. 29 could also be implemented with or without the alarm circuit and momentary test switch.

Elements of FIG. 29:

| | |
|---|---|
| 353- | Circuit Breaker Handle |
| 354- | Bi-Color LED |
| 355- | Alarm Test Switch |
| 356- | Power Connection to Load (return) |
| 357- | Power Connection to + VDC Supply |
| 358- | "Normally Open" Status Contact |
| 359- | "Normally Closed" Status Contact |
| 360- | "Center" Status Contact |
| 361- | Power Connection to Line (supply) |

Figure 30:
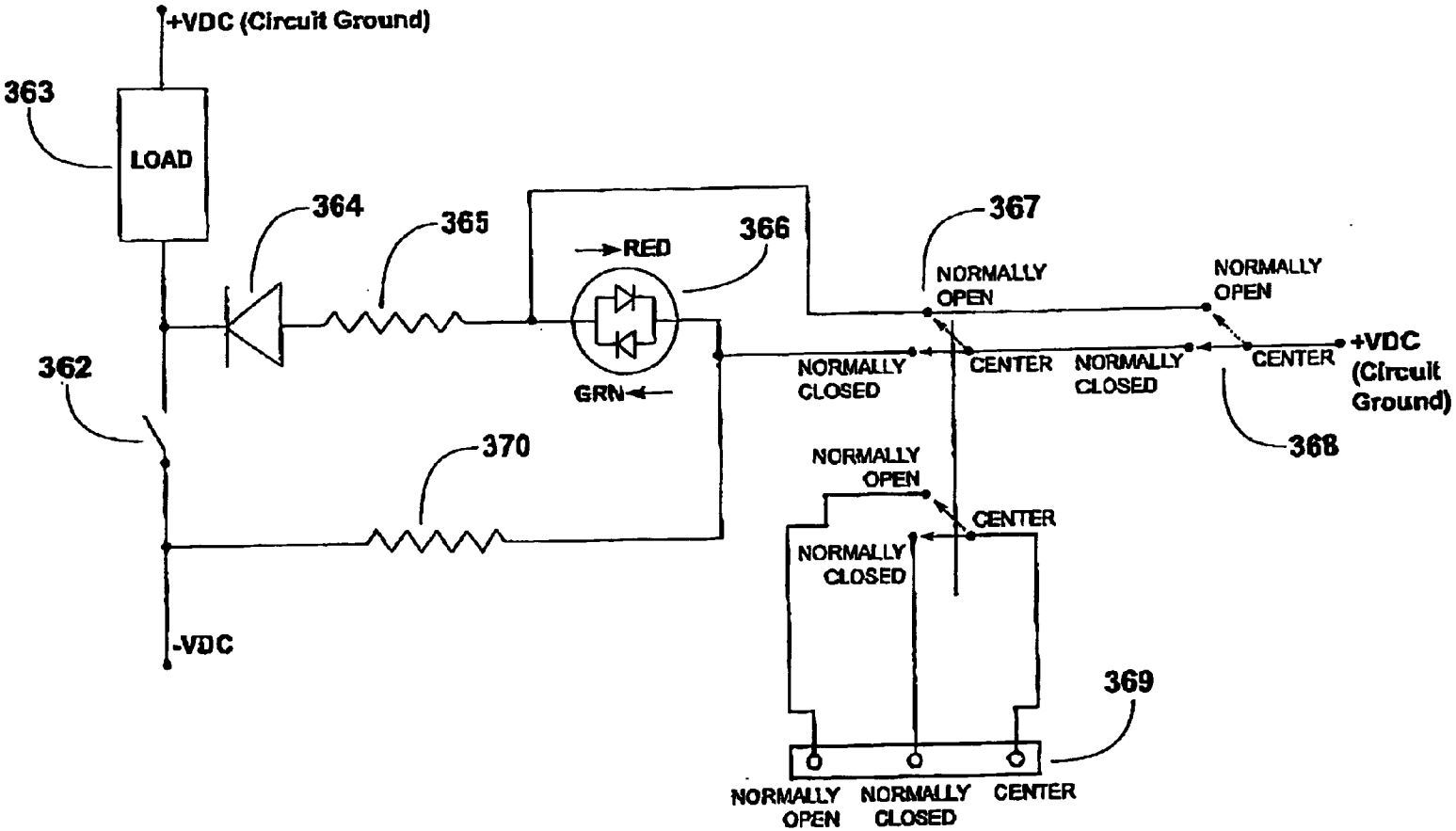
FIG. 30 is a circuit diagram for the compact circuit breaker shown in FIG. 29, with a lighted status indicator for ON/OFF/TRIPPED positions, for a positive ground DC system.

Description:

FIG. 30 diagrams the basic compact circuit breaker circuit (for a positive ground DC system). This circuit includes: a main contact 362 that carries the current to the load, a Diode 364 with its cathode connected to the load side of the main contact 362, a Resistor 370, where one side is connected to the line side (in this case negative) of the main contact 362, and the other side to a Bi-color LED 366. It also incorporates a DPDT (dual pole, dual throw) auxiliary switch 367 that activates only when the main contact of the circuit breaker 362 has been tripped by over-current flow through the main contact, and a miniature pushbutton SPDT (single pole, double throw) momentary test switch 368.

Elements of the FIG. 30 Circuit:

| | |
|---|---|
| 362- | Circuit Breaker Main Contact |
| 363- | Load |
| 364- | Diode |
| 365- | Resistor |
| 366- | Bi-Color LED |
| 367- | Auxiliary Switch |
| 368- | Alarm Test Momentary Switch |
| 369- | Connector on back of Circuit Breaker |
| 370- | Resistor |

Figure 31:
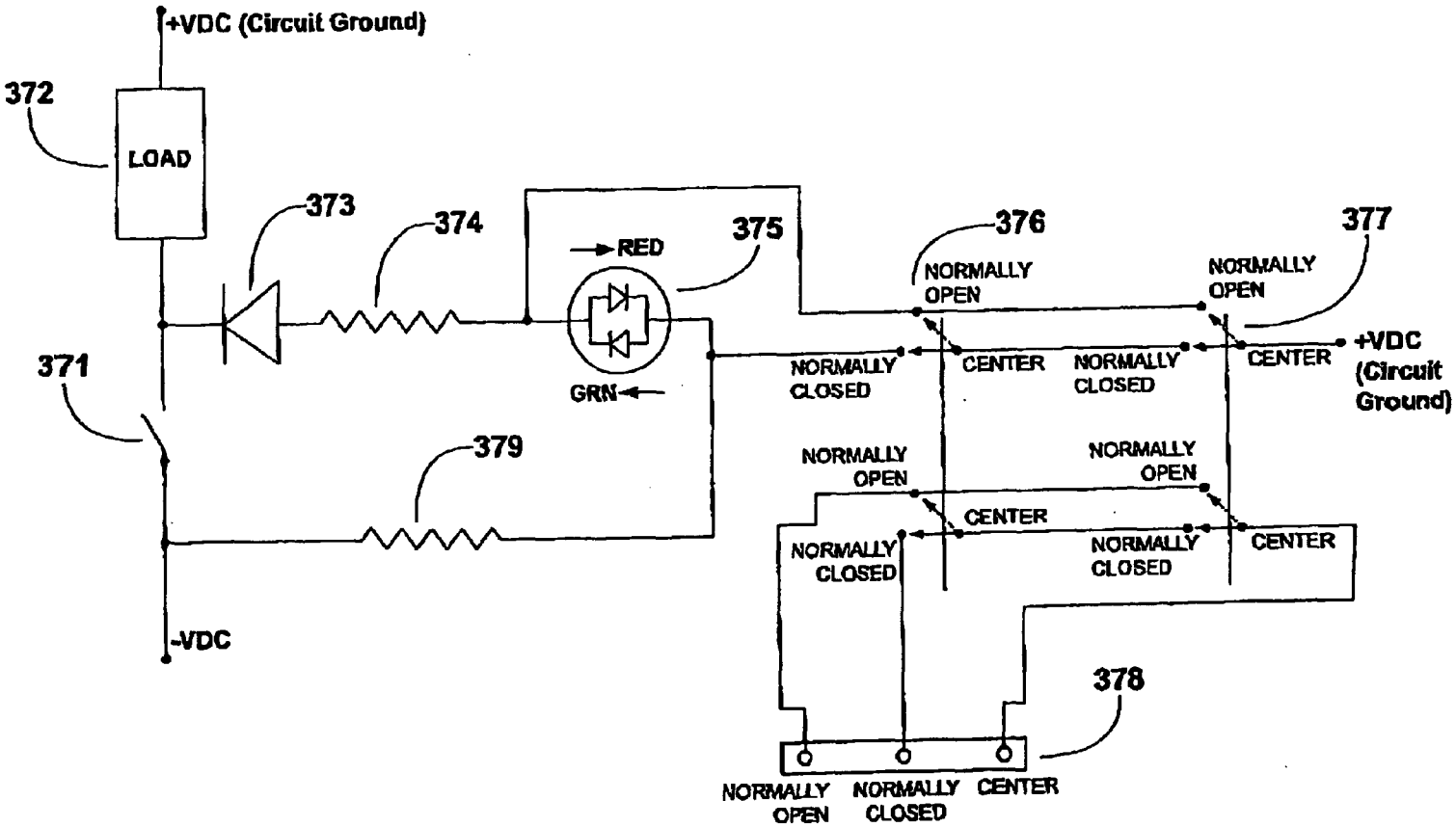
FIG. 31 shows how the circuit diagram in FIG. 30 could be modified to support a DPDT (Dual Poll, Dual Throw) momentary test switch

Elements of the FIG. 31 Circuit:

| | |
|---|---|
| 371- | Circuit Breaker Main Contact |
| 372- | Load |
| 373- | Diode |
| 374- | Resistor |
| 375- | Bi-Color LED |
| 376- | Auxiliary Switch |
| 377- | Alarm Test Momentary Switch |
| 378- | Connector on back of Circuit Breaker |
| 379- | Resistor |

Function:

The FIG. 30 circuit is designed for use only in a circuit breaker with mid-trip capability. In such a breaker, the main contact of the circuit breaker 362 opens in trip mode, only if over-limit current is passing through the main contact.

Under normal operating condition, when the main contact 362 is closed (breaker is in the CLOSED/ON state), current will flow from the +VDC input pin, through the "normally closed" position of the momentary test switch 368, and through the center position of the first section of the DPDT auxiliary switch 367 (through its "normally closed" contact). Current flow will continue through the bi-color LED 366, the resistor 365, the diode 364, finally reaching the main contact 362 of the negative side of the power supply. This direction of current flow passes through the forward bias green chip of the LED 366 causing it to glow GREEN.

When an over-current condition causes the main contact 362 to trip "open" (breaker is in the TRIPPED state), the DPDT auxiliary switch 367 also changes its position. In the TRIPPED state, current will flow through the first section of the auxiliary switch 367 (via the "normally open" path), the LED 366 (but in the opposite direction than in the CLOSED/ON condition), the resistor 370, and on to the negative point of the power supply. As a result, the LED 366 will turn RED, indicating a tripped condition. In this TRIPPED condition, no current will flow through the diode 364 because the main contact of the breaker is open. A second section of the DPDT auxiliary switch 367 will change the state used for remote monitoring of circuit breaker status.

When the circuit breaker is in normal operating condition (CLOSED/ON), or has been manually opened (OFF), pressing the momentary test switch 367 will cause the LED 366 to turn RED. Current flowing through the "normally open" contact of the momentary test switch 368, to the "normally open" contact of the auxiliary switch 367, and on to the negative side of the power supply (passing through the LED 366 and the resistor 370), causes LED 366 to glow RED.

Since this current flow is the same whether the main contact of the circuit breaker 362 is closed or manually opened, depressing the momentary test switch 368 will test the RED alarm condition of the LED 366 for either case. In both cases, it will simulate an open line of current flow through the "normally closed" contact of the DPDT auxiliary switch 367.

The values and power rating of the resistors selected for the circuit will depend on the desired intensity for the LED 366 (for both RED and GREEN states), and on the power levels the circuit is designed to tolerate.

While the FIG. 30 circuit has been configured to support a positive ground DC system, a similar approach could easily be used for a negative ground DC system. This circuit would require only minor modifications (including reversal of the direction of the diode 364 and LED 366) to support a circuit breaker located between the positive side of power supply and load 363 (as in the FIG. 13 circuit). The circuit in FIG. 30 may also be built using the lower power dissipation circuits previously described.

The momentary test switch 368 may also be a DPDT (Dual Poll, Dual Throw) switch. This would provide a second set of contacts that could be used to test the integrity of the status contacts (as shown in FIG. 31).

Item 29: Circuit diagram for the compact circuit breaker incorporating a mid-trip switch, with lighted status indicator for ON/OFF/TRIPPED positions, auxiliary "normally open"/"normally closed" contact points for remote monitoring of the circuit breaker system, and an alarm circuit momentary test switch, for positive ground DC systems, with current-limiting diodes.

Figure 32:
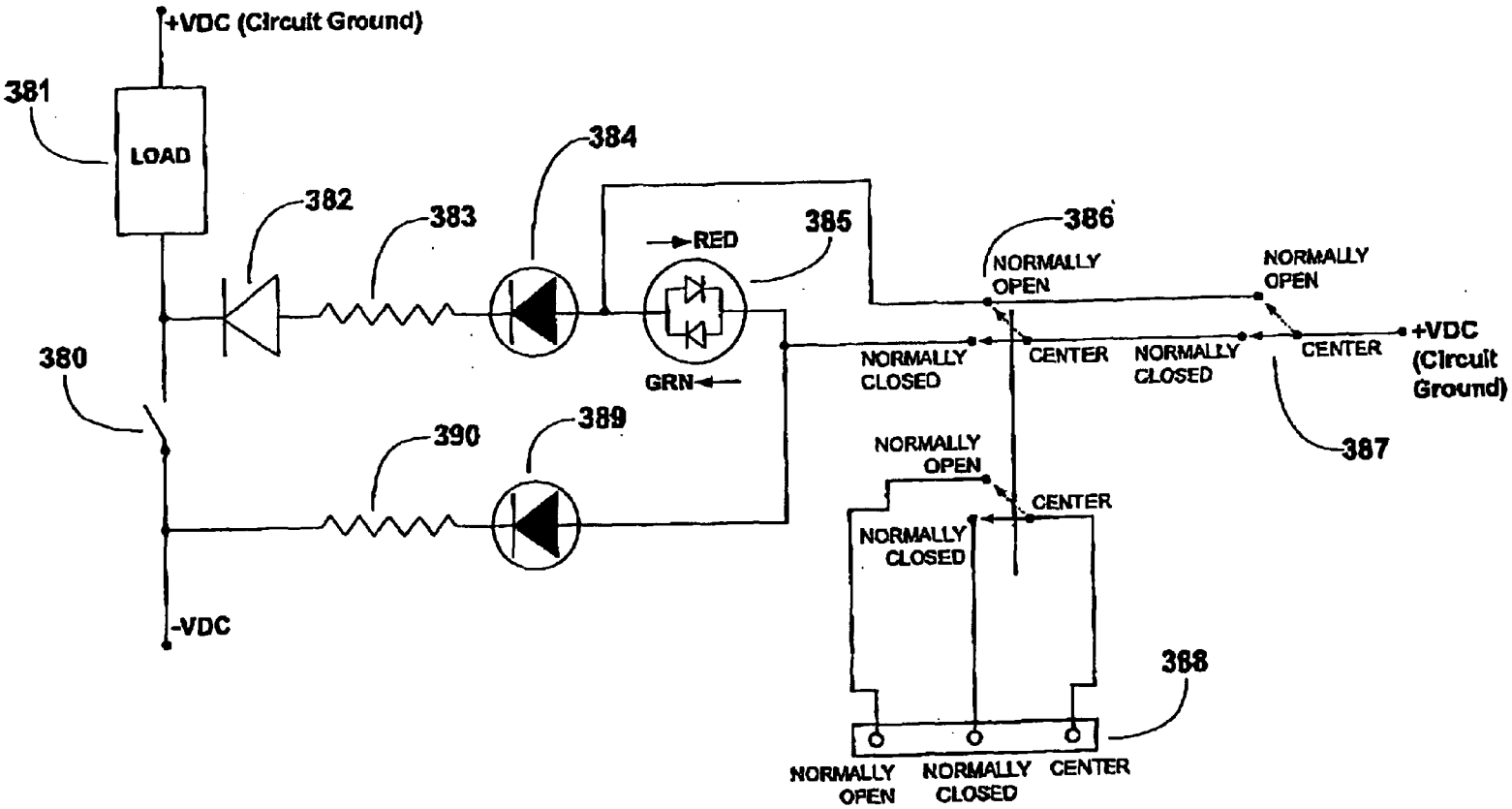
FIG. 32 shows the FIG. 30 circuit with the addition of two current-limiting diodes.

Description:

The circuit diagrammed in FIG. 32 modifies the FIG. 30 circuit, adding two current-limiting diodes 384 and 389. One diode (384) is located between the resistor 383 and the bi-color LED 385; the other (389) is located between resistor 390 and the auxiliary switch 386.

Elements of the FIG. 32 Circuit:

| | |
|---|---|
| 380- | Circuit Breaker Main Contact |
| 381- | Load |
| 382- | Diode |
| 383- | Resistor |
| 384- | Current-Limiting Diode |
| 385- | Bi-Color LED |
| 386- | Auxiliary Switch |
| 387- | Alarm Test Momentary Switch |
| 388- | Connector on back of Circuit Breaker |
| 389- | Current-Limiting Diode |
| 390- | Resistor |

Function:

The addition of the current-limiting diodes (384 and 389) increases the circuit's DC supply voltage limit, while not allowing the current through the LED 385 to exceed that LED's limits.

While the FIG. 32 circuit has been configured to support a positive ground DC system, as before, a similar approach could easily be used for a negative ground DC system. This circuit would require only minor modifications (including reversal of the direction of the current-limiting diodes 384 and 389 and bi-color LED 385) to support a circuit breaker located between the positive side of power supply and load 381 (as in the FIG. 13 circuit). The circuit in FIG. 32 may also be built using the lower power dissipation designs previously described.

Item 30: Circuit diagram for the compact circuit breaker incorporating a mid-trip II switch, with lighted status indicator for ON/OFF/TRIPPED positions, auxiliary "normally open"/"normally closed" contact points for remote monitoring of the circuit breaker system, and an alarm circuit momentary test switch, for AC systems or positive ground DC systems.

Figure 33:
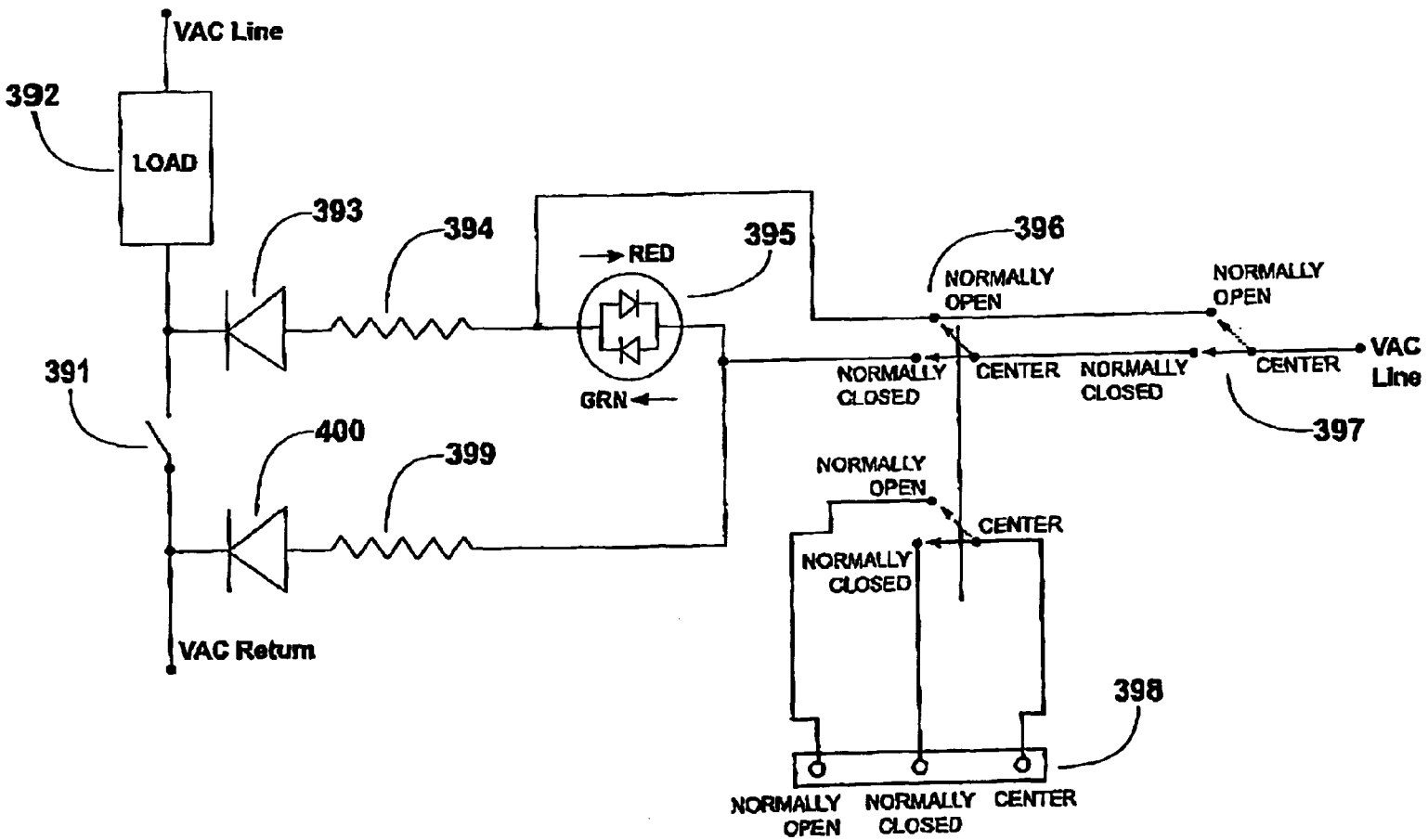
FIG. 33 shows the FIG. 30 circuit reconfigured to support an AC power supply.

Description:

The circuit shown in FIG. 33 is identical to the FIG. 30 circuit, save for the addition of a diode 400 between the resistor 399 and the VAC return.

Elements of the FIG. 33 Circuit:

| | |
|---|---|
| 391- | Circuit Breaker Main Contact |
| 392- | Load |
| 393- | Diode |
| 394- | Resistor |
| 395- | Bi-Color LED |
| 396- | Auxiliary Switch |
| 397- | Alarm Test Momentary Switch |
| 398- | Connector on back of Circuit Breaker |
| 399- | Resistor |
| 400- | Diode |

Function:

Adding the extra diode 400 allows the circuit to be used with both AC and positive ground DC power supplies. As before, the FIG. 33 circuit could easily be reconfigured to support a negative ground DC system with minor modifications (including reversal of the direction of the diodes 393/400 and bi-color LED 395). The circuit in FIG. 33 may also be built using the lower power dissipation designs previously described.

Item 31: Circuit diagram for the compact circuit breaker incorporating a mid-trip switch, with lighted status indicator for ON/OFF/TRIPPED positions, auxiliary "normally open"/"normally closed" contact points for remote monitoring of the circuit breaker system, and an alarm circuit momentary test switch, for AC systems or positive ground DC systems, with current-limiting diodes.

Figure 34:
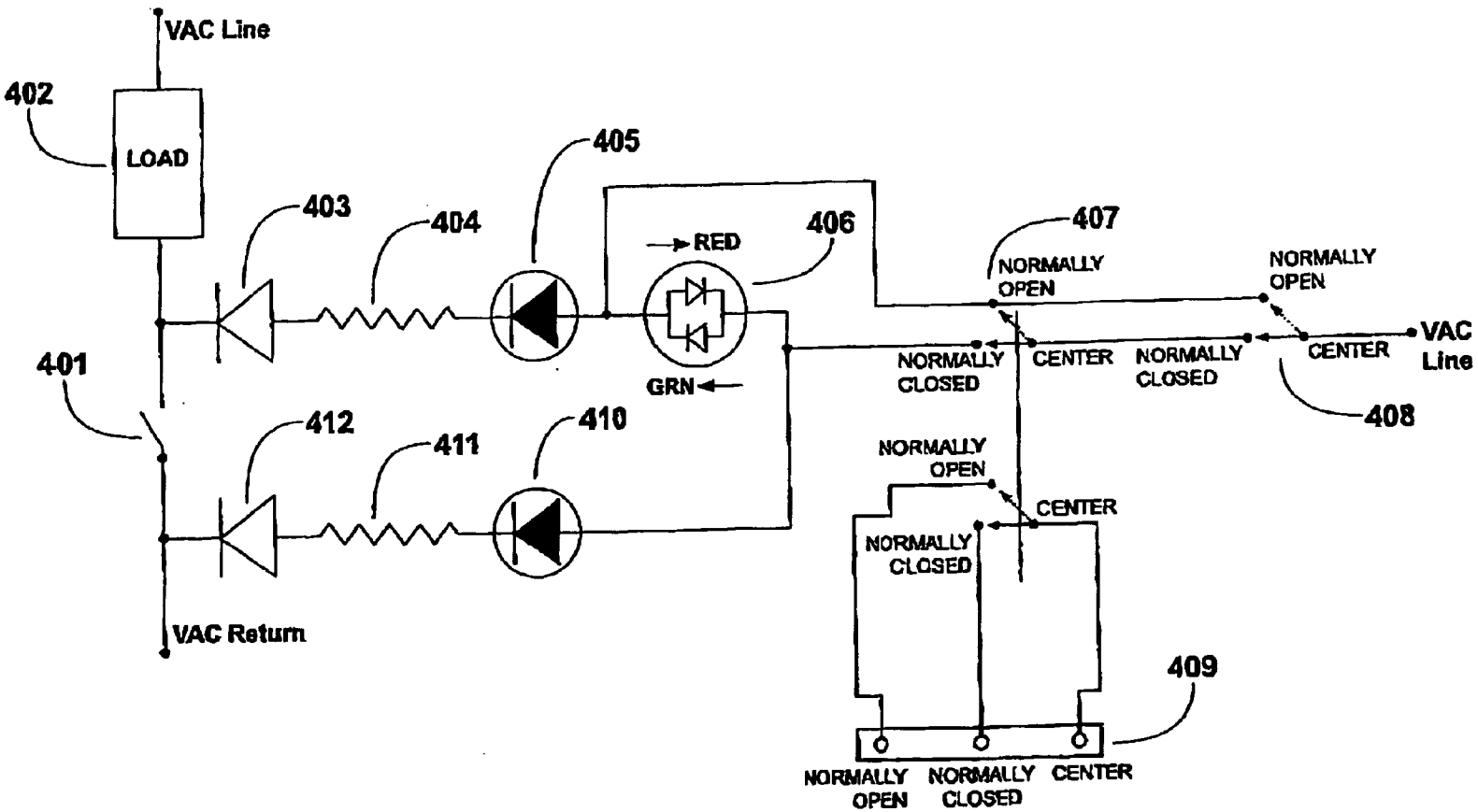
FIG. 34 shows the FIG. 30 circuit reconfigured to incorporate both current-limiting diodes and AC power supply support.

Description:

The circuit shown in FIG. 34 incorporates the features of both the FIGS. 32 and 33 circuits. A diode 412 (located between the resistor 411 and the VAC return), and two current-limiting diodes 405 and 410 (405 being located between the resistor 404 and the bi-color LED 406; 410 being located between resistor 411 and the auxiliary switch 407) have been added to the base circuit shown in FIG. 30.

Elements of the FIG. 34 Circuit:

| | |
|---|---|
| 401- | Circuit Breaker Main Contact |
| 402- | Load |
| 403- | Diode |
| 404- | Resistor |
| 405- | Current-Limiting Diode |
| 406- | Bi-Color LED |
| 407- | Auxiliary Switch |
| 408- | Alarm Test Momentary Switch |
| 409- | Connector on back of Circuit Breaker |
| 410- | Current-Limiting Diode |
| 411- | Resistor |
| 412- | Diode |

Function:

The extra diode 412 allows the circuit to be used with both AC and positive ground DC power supplies. The two current-limiting diodes 405 and 410 increase the circuit's supply voltage limit, while not allowing the current through the LED 406 to exceed that LED's limits.

Like circuits in FIG. 30 through FIG. 33, the FIG. 34 circuit could easily be reconfigured to support a negative ground DC system with minor modifications (including reversal of the direction of the diodes 403 and 412, the current-limiting diodes 405 and 410, and bi-color LED 406). The circuit in FIG. 33 may also be built using the lower power dissipation designs previously described.

Item 32—Lighted Status Indicator for a mid-trip circuit breaker using a SPDT as a main contact and an auxiliary switch SPDT for tripped status indication, for a positive ground DC system.

Figure 35:
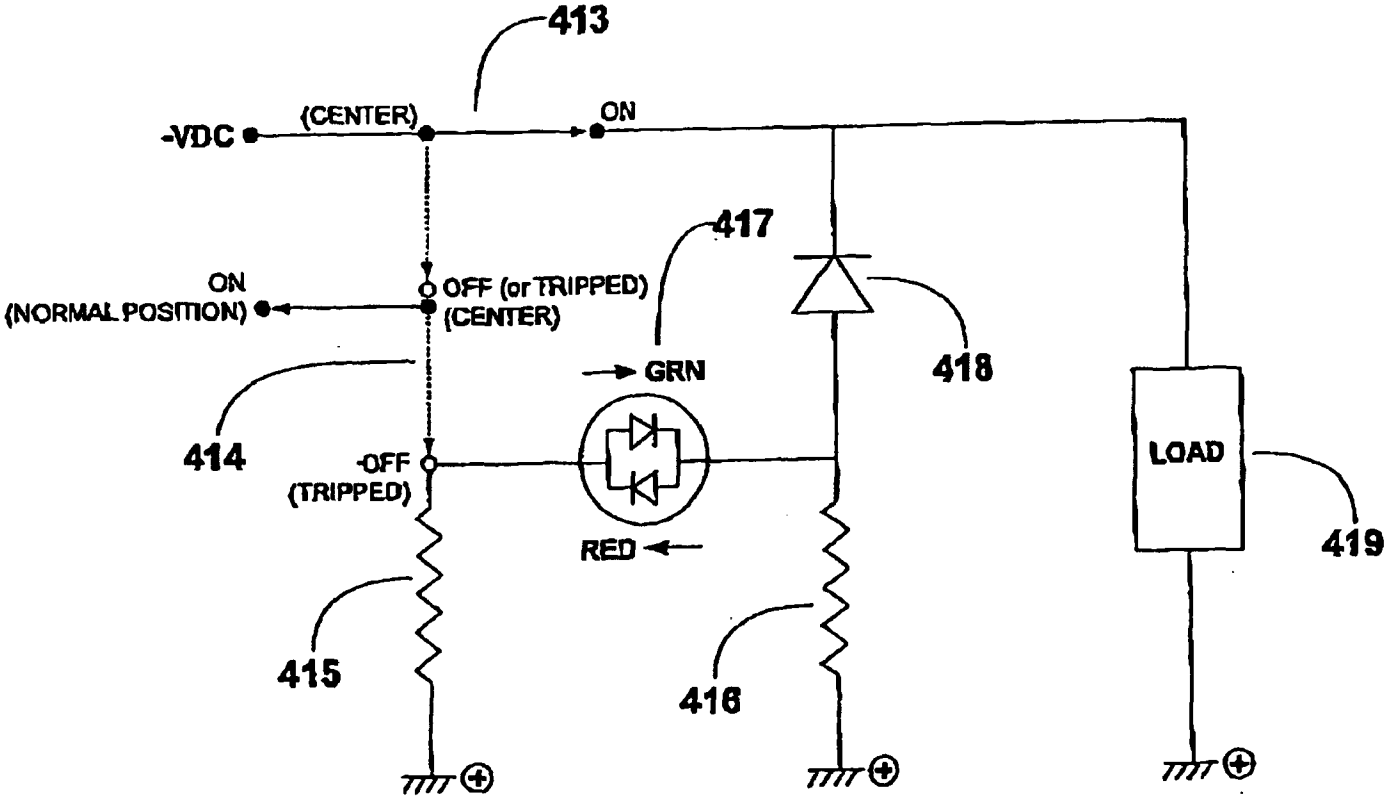
FIG. 35 is a circuit diagram of the Lighted Status Indicator circuit for a mid-trip circuit breaker, using a SPDT as a main contact and an auxiliary switch SPDT for tripped status indication, for a positive ground DC system.

Description:

In the circuit diagrammed in FIG. 35, the circuit breaker includes two switches (413 and 414). The main contact 413 can be turned ON or OFF manually, and will be turned OFF automatically when the current running through the circuit breaker main contact 413 exceeds a preset value. The auxiliary switch 414 will be in the ON position except when the main contact 413 has been activated automatically by a current overload, and has tripped to the OFF position. In such a case, the auxiliary switch 414 will also be moved to the OFF position.

Elements of the FIG. 35 Circuit:

| | |
|---|---|
| 413- | Main Contact |
| 414- | Auxiliary Switch |
| 415- | Resistor |
| 416- | Resistor |
| 417- | Bi-Color LED |
| 418- | Diode |
| 419- | Load |

Function:

When the circuit breaker has been manually set to the OFF position, the auxiliary switch 414 stays in the ON position, and the supply voltage (−VDC) is completely disconnected from the circuit and no current flows through the bi-color LED 417 (the bi-color LED 414 is in the OFF state).

When the circuit breaker is manually set to the ON position, the auxiliary switch 414 remains in the ON position (and is disconnected from resistor 415 and the bi-color LED 417), and the supply (−VDC) is connected to the diode 418 and the load 419. In this configuration, a current flows from the positive ground, through the resistor 415, the GREEN LED of the bi-color LED 417, the diode 418, the main contact 413, and on to the supply (−VDC). Therefore when the current running through the circuit breaker main contact 418 is within the preset limit, the auxiliary switch 414 remains in the ON position, and the bi-color LED 417 glows GREEN. A second current flows through the circuit running from the positive ground, through the resistor 416, the diode 418, the main contact 413, and on to the supply (−VDC).

When the current flowing through the main contact 413 exceeds the preset value, the circuit breaker will be activated and both the main contact 413 and the auxiliary switch 414 will shift to their OFF positions. In this case, the main contact 413 will disconnect the load and the diode 418 from the supply voltage (−VDC). The auxiliary switch 414 (now also tripped to its OFF position) will cause the supply voltage (−VDC) to be connected to the resistor 415 and to the bi-color LED through the main contact 413 and the auxiliary switch 414. In this case, a current will flow from the positive ground, through the resistor 416, the RED LED of the bi-color LED 417, the auxiliary switch 414, the main contact 413, and on to the supply (−VDC). A second flow of current will run from the positive ground, through the resistor 415, the main contact 413 and the auxiliary switch 414, to the supply (−VDC). The amounts of both currents are limited by resistor values. Therefore when an overcurrent condition causes the circuit breaker to trip, both the main contact 413 and the auxiliary switch 414 will be activated. Only under this condition will the bi-color LED 417 glow RED.

The resistors 416 and 415 may be replaced with current-limiting diodes. Several current-limiting diodes may be used in series in order to use the FIG. 35 circuit with higher supply voltages.

Item 33—Lighted Status Indicator for a mid-trip circuit breaker using a SPDT as a main contact and an auxiliary switch SPDT for tripped status indication for a negative ground DC system.

Figure 36:
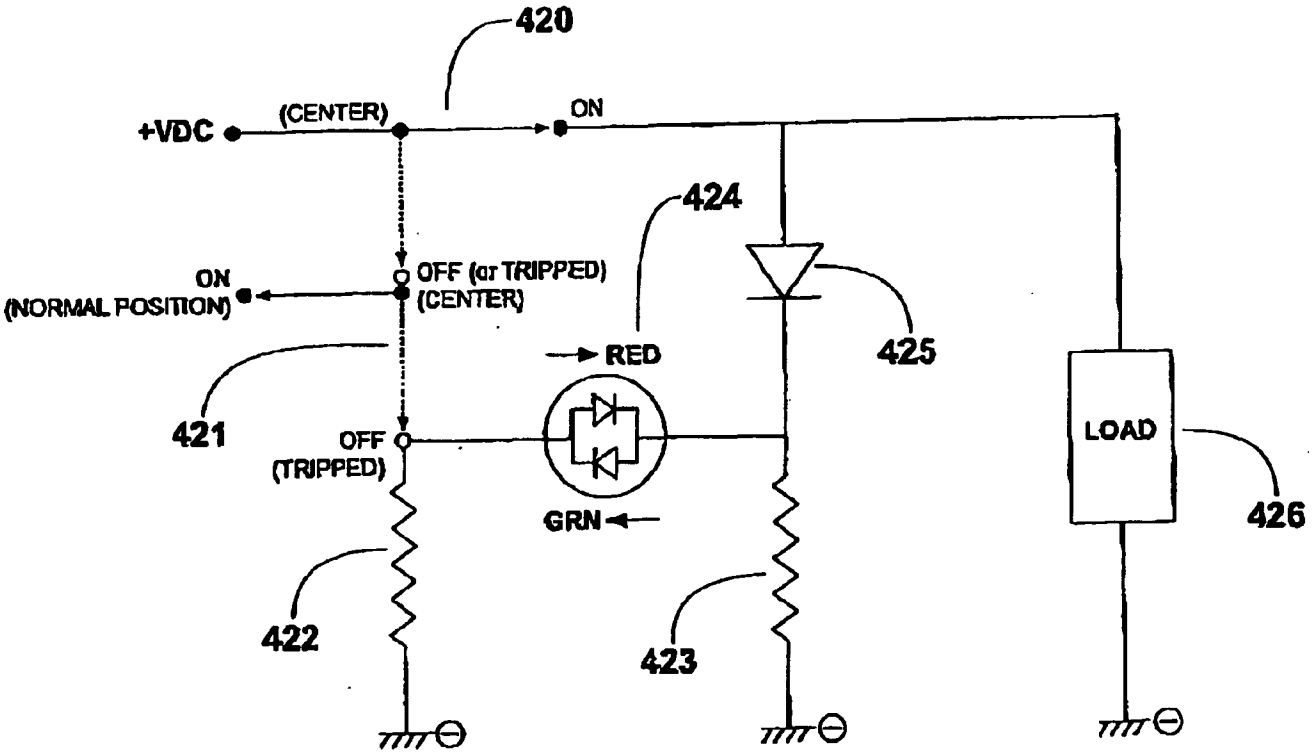
FIG. 36 is the same as FIG. 35, except that the circuit has been altered to work with a negative ground DC system.

Description:

The FIG. 36 circuit is the same as the circuit shown in FIG. 35, except that the direction of the diode 425 and the bi-color LED 424 have been reversed, in order to allow the circuit to work in a negative ground DC system.

Elements of the FIG. 36 Circuit:

| | |
|---|---|
| 420- | Main Contact |
| 421- | Auxiliary Switch |
| 422- | Resistor |
| 423- | Resistor |
| 424- | Bi-Color LED |
| 425- | Diode |
| 426- | Load |

Function:

When the circuit breaker (main contact 420 and auxiliary switch 421) is manually turned OFF the load 426, and the diode 425, are disconnected from the supply (+VDC) causing the bi-color LED 424 to remain in its OFF state.

When the circuit breaker is turned to the ON position—and the current through the circuit breaker is within the preset limits—the main contact 420 remains in the ON position and is disconnected from the resistor 422 and the bi-color LED 424. In this state of the circuit, a current will flow through the main contact 420, the diode 425, the GREEN LED of the bi-color LED 424, the resistor 422, and on to the ground. A second current exists, flowing through the main contact 420, the diode 425, the resistor 423, and on to the ground.

When the circuit breaker is activated due to an overcurrent condition, the main contact 420 and the auxiliary switch 421 will both shift to their OFF positions. In this state, the only current flowing through the circuit will be: (a) from the +VDC supply, through the main contact 420, the auxiliary switch 421, the RED side of the bi-color LED 424, resistor 423, and on to the ground; and (b) from the +VDC supply through the main contact 420, the auxiliary switch 421, the resistor 422, and on to the ground. Thus only the tripped condition of the breaker will cause the RED side of the bi-color LED 424 to be activated.

Item 34—Lighted Status Indicator for a mid-trip circuit breaker using a SPDT as a main contact and an auxiliary switch SPDT for tripped status indication for a positive ground DC or an AC system.

Figure 37:
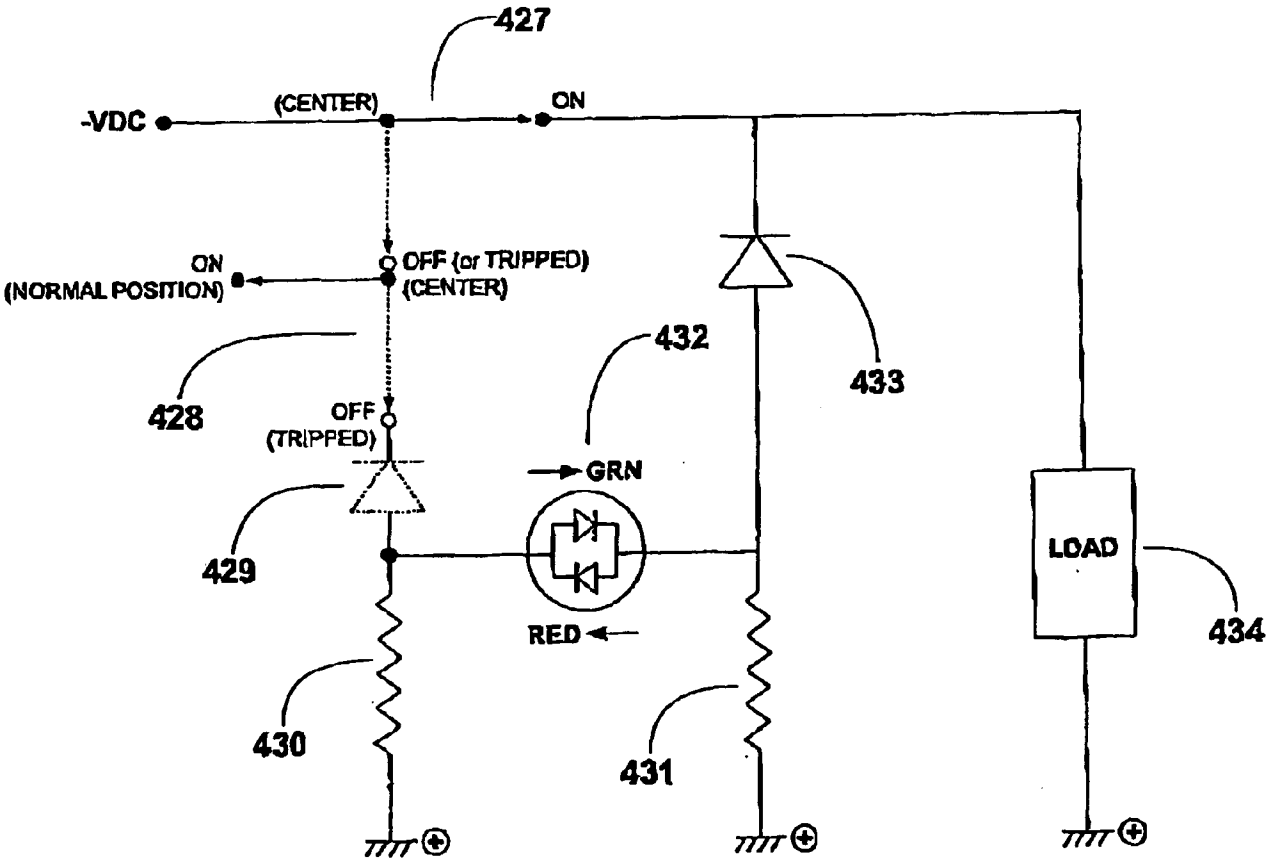
FIG. 37 is the same as FIG. 35, except that the circuit has been altered to work with a positive ground DC or an AC power system.

Description:

The circuit shown in FIG. 37 is identical to that shown in FIG. 35, except for the placement of a diode 429, between the resistor 430 and the OFF contact position of the auxiliary switch 428.

Elements of the FIG. 37 Circuit:

| | |
|---|---|
| 427- | Main Contact |
| 428- | Auxiliary Switch |
| 429- | Diode |
| 430- | Resistor |
| 431- | Resistor |
| 432- | Bi-Color LED |
| 433- | Diode |
| 434- | Load |

Function:

The addition of the diode 429 will cause current to flow only in a half-cycle through the circuit. Half-cycle current flow only occurs when the ground polarity is positive with respect to the −VDC supply. The circuit is only active during this half-cycle time for both RED and GREEN displays of the bi-color LED 432.

Otherwise, the function of this circuit is identical to the circuit described under FIG. 35.

Item 35—Lighted Status Indicator for a mid-trip circuit breaker using a SPDT as a main contact and an auxiliary switch SPDT for tripped status indication for a negative ground DC or an AC system.

Figure 38:
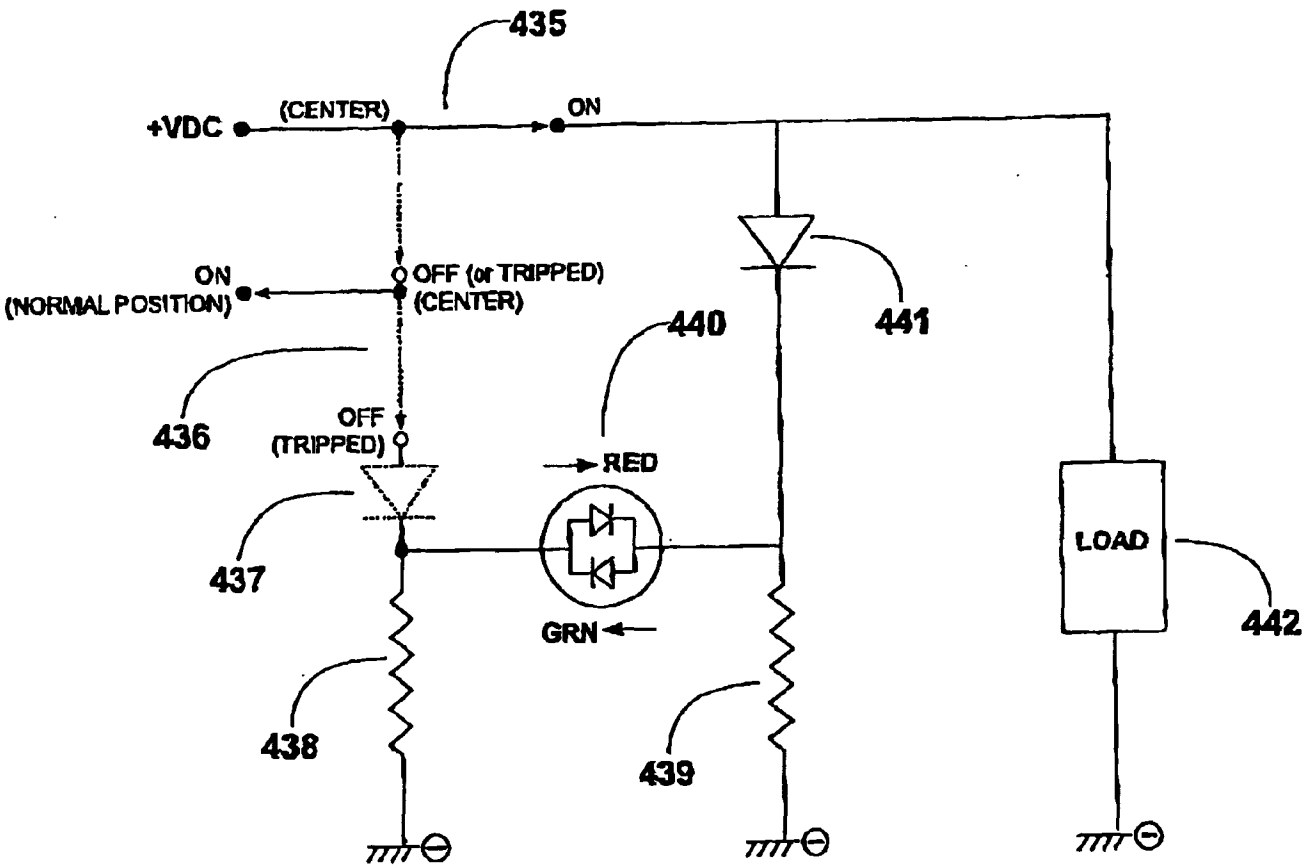
FIG. 38 is the same as FIG. 36, except that the circuit has been altered to work with a negative ground DC or an AC system.

Description:

The circuit diagrammed in FIG. 38 is identical to that shown in FIG. 36, except for the placement of a diode 437, between the resistor 438 and the OFF contact position of the auxiliary switch 436.

Elements of the FIG. 38 Circuit:

| | |
|---|---|
| 435- | Main Contact |
| 436- | Auxiliary Switch |
| 437- | Diode |
| 438- | Resistor |
| 439- | Resistor |

-continued

| | |
|---|---|
| 440- | Bi-Color LED |
| 441- | Diode |
| 442- | Load |

Function:

The addition of the diode 437 will cause current to flow only in a half-cycle through the circuit. Half-cycle current flow only occurs when the ground polarity is negative with respect to the +VDC supply. The circuit is only active during this half-cycle time for both RED and GREEN displays of the bi-color LED 440.

Otherwise, the function of this circuit is identical to the circuit described under FIG. 36.

Item 36—Lighted Status Indicator for a mid-trip circuit breaker using a SPST as a main contact and an auxiliary switch SPST for tripped status indication for a negative ground DC or an AC system.

Figure 39:
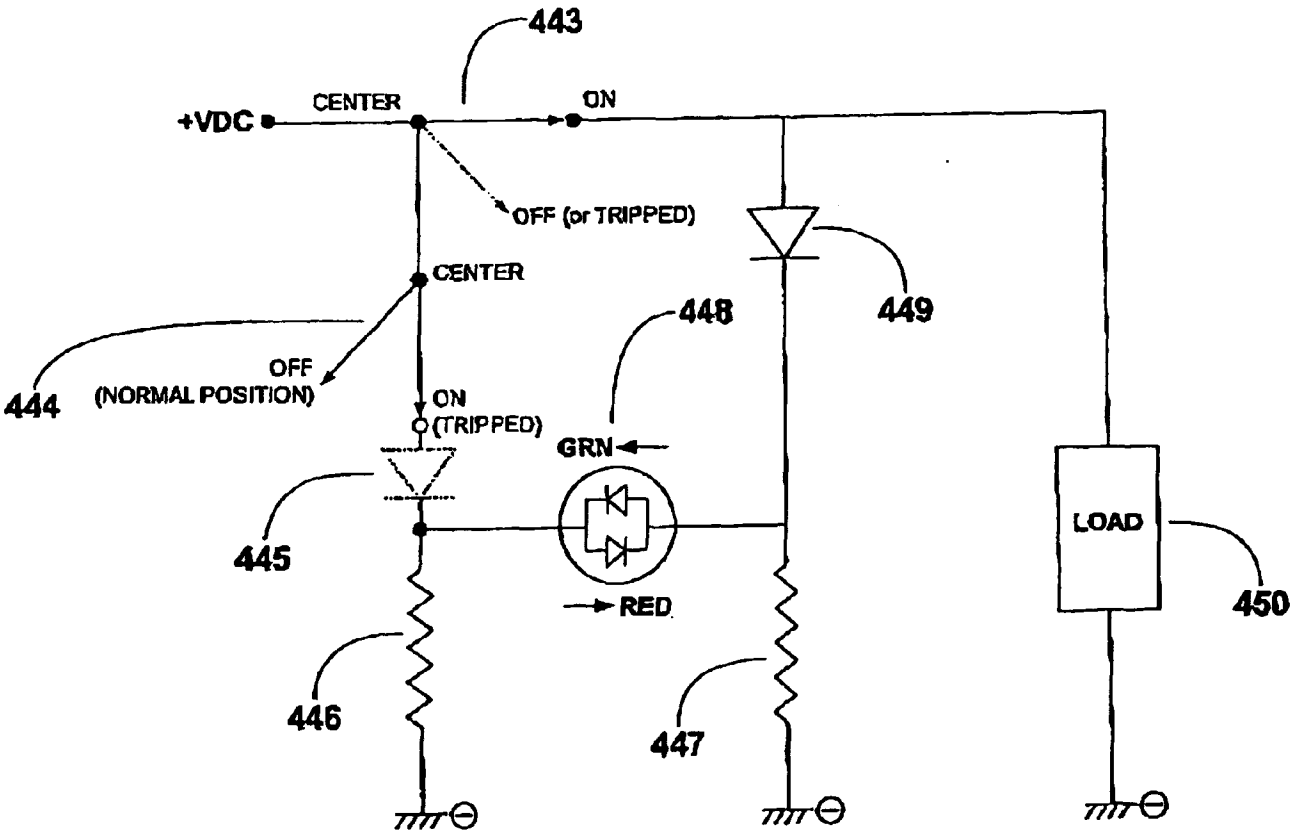
FIG. 39 is a circuit diagram of the Lighted Status Indicator circuit for a mid-trip circuit breaker using a SPST as a main contact and an auxiliary switch SPST for tripped status indication for a negative ground DC or an AC system.

Description:

The circuit diagrammed in FIG. 39 is identical to that shown in FIG. 38, except that the main contact 443 and the auxiliary switch 444 are SPST (single pole, single throw) switches rather than SPDT (single pole, double throw) switches, whose center points are tied together and to the +VDC source Elements of the FIG. 39 Circuit:

| | |
|---|---|
| 443- | Main Contact |
| 444- | Auxiliary Switch |
| 445- | Diode |
| 446- | Resistor |
| 447- | Resistor |
| 448- | Bi-Color LED |
| 449- | Diode |
| 450- | Load |

Function:

When the circuit breaker is manually turned off, the load and the Diode 449 are disconnected from the +VDC supply (the auxiliary switch 444 being in the OFF state), the bi-color LED 448 will be in the OFF state, as well.

When the circuit breaker is turned to the ON position—and the current through the circuit breaker is within the preset limits—the main contact 443 will remain in the on position and be disconnected from the diode 445, the resistor 446, and the bi-color LED 448. In this state, a current will flow through the main contact 443, the diode 449, the Green LED of the bi-color LED 448, the resistor 446, and on to the ground. A second current will also exist, flowing through the circuit breaker main contact 443, the diode 449, the resistor 447, and on the ground.

When the circuit breaker is activated due to an overcurrent condition, the main contact 443 will shift to the OFF position, and the auxiliary switch 444 will shift to the ON (TRIPPED) position. In this state, the only currents flowing through the circuit will be:

(a) From the +VDC supply, through the main contact's 443 center contact, the auxiliary switch 444 contact, the diode 445, the RED side of the bi-color LED 448, the resistor 447, and on to the ground, and (b) From the +VDC supply, thought the main contact's 443 center contact, the auxiliary switch 444 contact, the diode 445, the resistor 446, and on to the ground.

Thus only the TRIPPED condition of the breaker will cause the RED side of the bi-color LED 448 to be activated.

Item 37—Lighted Status Indicator for a mid-trip circuit breaker using a SPST as a main contact and an auxiliary switch SPST for tripped status indication for a positive ground DC or an AC system.

Figure 40:
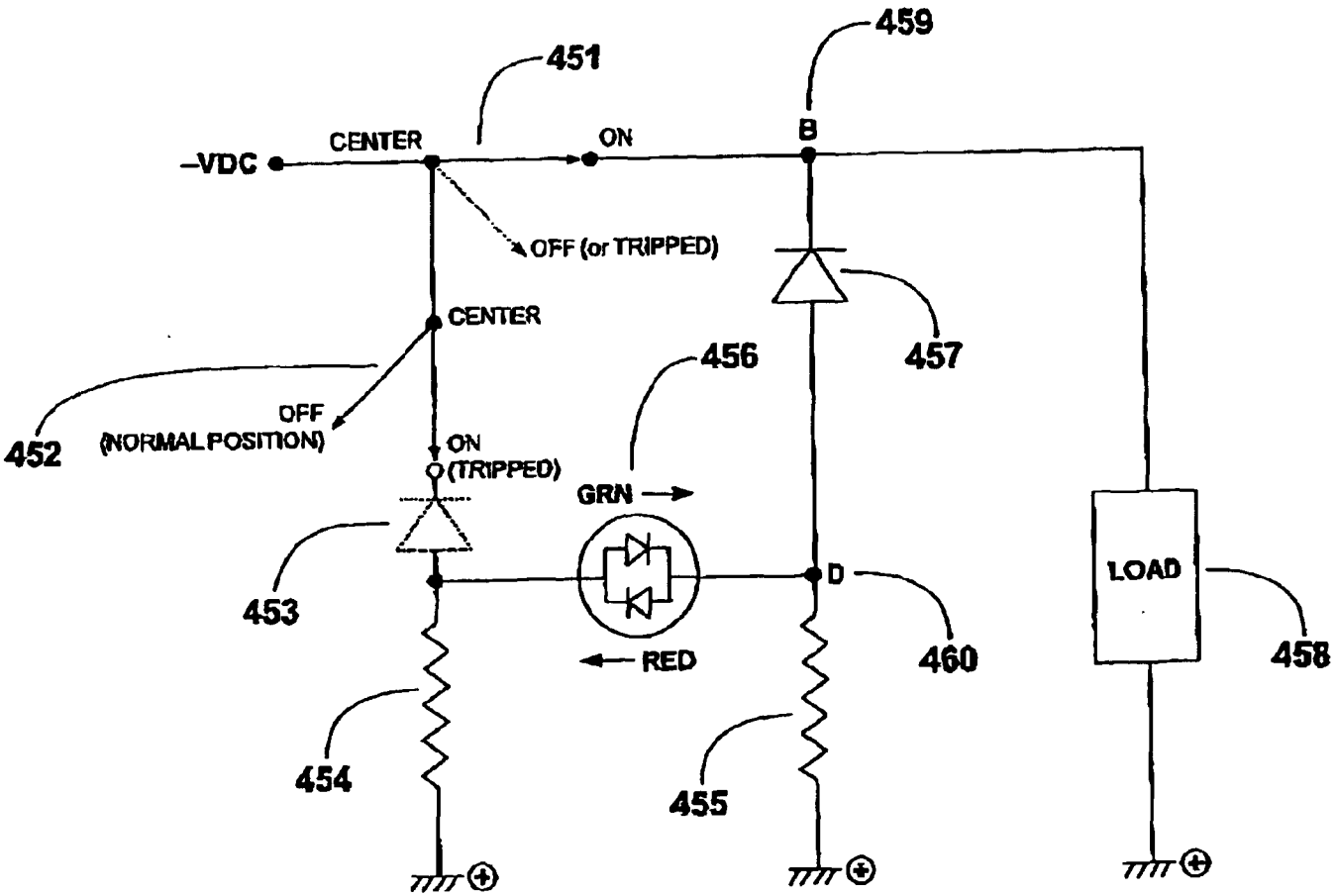
FIG. 40 is the same as FIG. 39, except that the circuit has been altered to work with a positive ground DC or an AC power system.

Description:

The circuit diagrammed in FIG. 40 is similar to the circuit shown in FIG. 37, with the following exceptions:

(1) The main contact 451 is a SPST (single pole, single throw) switch, normally placed in the OFF position (the circuit is in the OFF position), and can be turned ON or OFF manually and turned OFF automatically (TRIPPED mode).

(2) The auxiliary switch 452 is a SPST (single pole, single throw) switch, normally placed in the OFF position which will only shift to the ON position when the main circuit breaker contact 451 is tripped.

(3) The center points of the main contact 451 and the auxiliary switch 452 are connected to each other and to the −VDC.

Elements of the FIG. 40 Circuit:

| | |
|---|---|
| 451- | Main Contact |
| 452- | Auxiliary Switch |
| 453- | Diode |
| 454- | Resistor |
| 455- | Resistor |
| 456- | Bi-Color LED |
| 457- | Diode |
| 458- | Load |
| 459- | Point "B" |
| 460- | Point "D" |

Function:

When the main contact 451 is in the OFF position, the auxiliary switch 452 is also in the OFF position, and −VDC is disconnected from the diode and the load. But when the main contact 451 is set in the ON position, the −VDC supply is connected to the Load 458 and Diode 457, and the auxiliary switch 452 remains in the OFF position and disconnected from the diode 453, the bi-color LED 456, and the resistor 454.

Besides the main current flowing through the load, a current flow will run from the positive (+) ground through the resistor 454, through the GREEN side of the bi-color LED 456, the diode 457, the main contact 451, and on to the −VDC. A second current flow will run from the positive (+) ground, through the resistor 455, the diode 457, the main contact 451, and on to the −VDC. In this state, the GREEN LED of the Bi-Color LED 456 will indicate that the circuit is ON and normally operational.

When an overcurrent load condition causes the main circuit breaker contact 451 to trip, the main contact 451 will open up the current flow to the load and the diode 457. At the same time, the auxiliary switch 452 will flip to its ON state and connect −VDC to the diode 453, the bi-color LED 456, and the resistor 454. In this condition of the circuit, a current flows from the positive (+) ground through the resistor 455, the RED side of the bi-color LED 456, the diode 453, the auxiliary switch 452, the center of breaker main contact 451, and on to the −VDC. A second current path exists from the positive (+) ground, through the resistor 454, the diode 453, the auxiliary switch 452, the center of the main contact 451, and on to the −VDC supply. In this state, the RED side of the bi-color LED 456 will be ON, indicating that the breaker has tripped.

Resistors 455 and 454 may be replaced with current-limiting diodes. Also, several current-limiting diodes may be used in series to modify the FIG. 40 circuit for use with higher supply voltages. A circuit identical to the FIG. 40 circuit may be used for a negative ground DC system if the direction of the diodes (457 and 453) and the bi-color LED 456 are reversed.

Item 38—Lighted Status Indicator for a mid-trip circuit breaker using a SPST as a main contact and an auxiliary switch SPST (or SPDT) for tripped status indication with alarm test push button switch, for a positive ground DC or an AC system.

Figure 41:
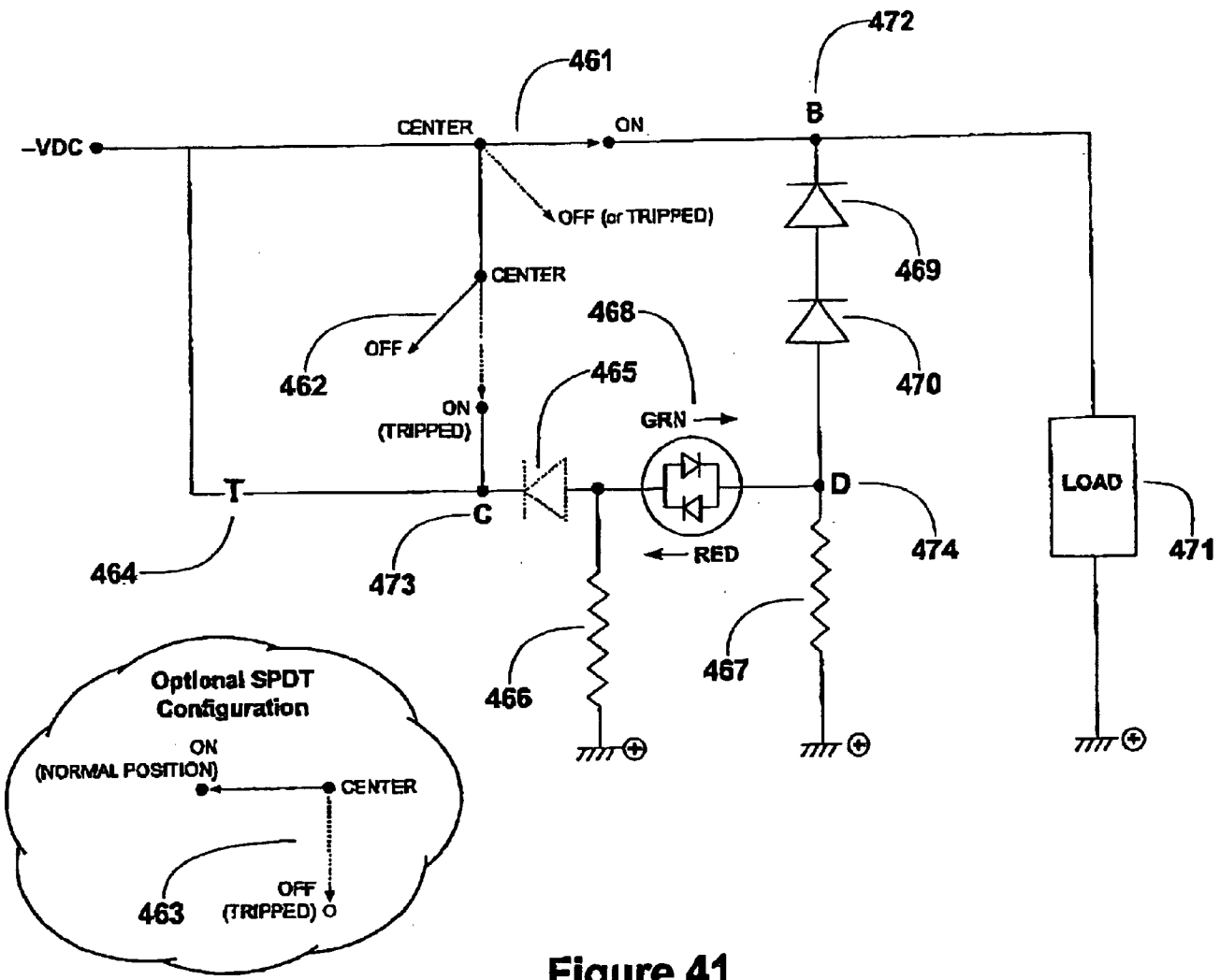
FIG. 41 is a circuit diagram of the Lighted Status Indicator circuit for a mid-trip circuit breaker using a SPST as a main contact and an auxiliary switch SPDT (or a SPST) for tripped status indication with alarm test push button switch, for a positive ground DC or an AC system.

Description:

The circuit diagrammed in FIG. 41 is identical to that shown in FIG. 40, except that a diode has been added between Points B 472 and D 474, and a push button alarm test switch 464 (momentary, normally open) has been added on a line between the −VDC supply and the SPST auxiliary switch 462 (the line passing through Point C 473).

Elements of the FIG. 41 Circuit:

| | |
|---|---|
| 461- | Main Contact |
| 462- | Auxiliary Switch (SPST) |
| 463- | Auxiliary Switch (SPDT option) |
| 464- | Push-Button Alarm Test Switch |
| 465- | Diode |
| 466- | Resistor |
| 467- | Resistor |
| 468- | Bi-Color LED |
| 469- | Diode |
| 470- | Diode |
| 471- | Load |
| 472- | Point "B" |
| 473- | Point "C" |
| 474- | Point "D" |

Function:

When the push button test switch 464 is not pressed, this circuit functions identically to the FIG. 40 circuit. However, when the push button test switch 464 is pressed, it bypasses the main contact 461 and the auxiliary switch 462, causing the supply voltage to be applied to the tripped contact of the auxiliary switch 462, thus simulating a tripped condition for the auxiliary switch 462, regardless of the position of the main contact 461.

This circuit allows two possible positions of the main contact 461—OFF and ON. Circuit function for both positions is detailed below.

If the main contact 461 is in the OFF position then a current flow will exist from the positive ground through the resistor 466, the diode 465, the push button test switch 464, and on to the −VDC supply. A second current flow will run from the positive ground through the resistor 467, the RED LED of the bi-color LED 468, the diode 465, the push button test switch 464, and on to the −VDC supply. This current flow will cause the RED side of the bi-color LED 468 to glow, indicating that the alarm circuit is working properly.

If the main contact 461 is in the ON position while the −VDC supply is powering the load, the two current flows described above exist—along with a third current path that flows from the positive ground, through the resistor 467, the diodes 469 and 470, the main contact 461, and on to the −VDC supply.

The addition of the diode 470 (or a resistor in its place) will cause the voltage at point D 474 to be positive enough with respect to point C 473, to cause the RED side of the bi-color LED 468 to turn ON and the GREEN side of the bi-color LED 468 to turn OFF (points B 472 and C 473 are at the −VDC potential). Thus the RED side of the bi-color LED 468 will indicate the proper functionality of the alarm circuitry without having any effect on the supply voltage to the Load 471.

Notes: Diode 470 may be replaced by a Zener diode or a resistor; resistors 467 and 466 may be replaced with current-limiting diodes; and Diode 465 is used for AC applications.

The circuit in FIG. 41 will also function identically with a SPDT auxiliary switch 463 substituted for the SPST auxiliary switch 462 shown in the main circuit diagram (see also Item 39 below).

Item 39—Lighted Status Indicator for a mid-trip circuit breaker using a SPST as a main contact and an auxiliary switch (SPDT) for tripped status indication with alarm test push button switch, for a positive ground DC or an AC system.

Figure 42:
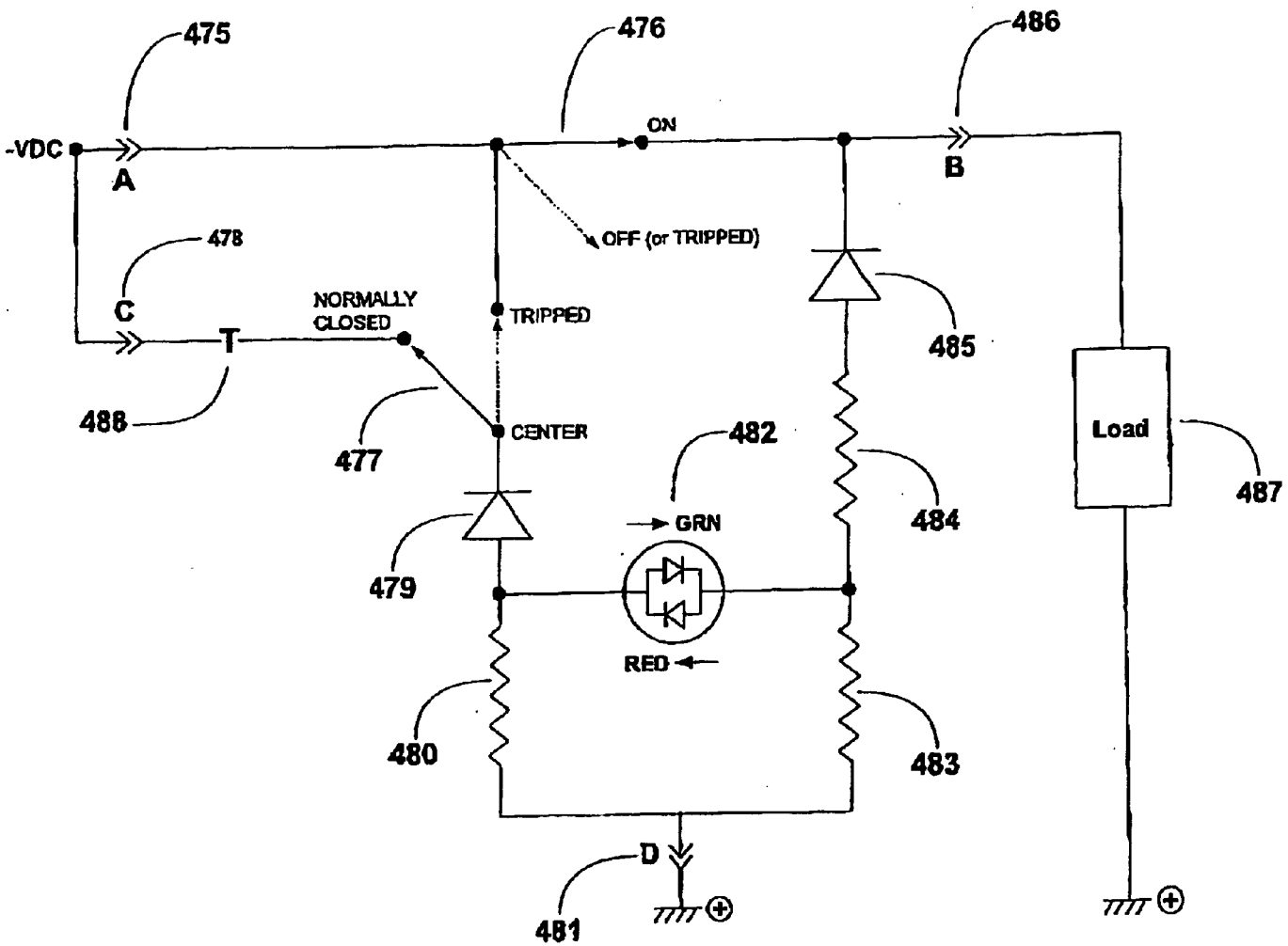
FIG. 42 is circuit diagram of the Lighted Status Indicator circuit for a mid-trip circuit breaker using a SPST as a main contact and an auxiliary switch (SPDT) for tripped status with alarm test push button switch, for a positive ground DC or an AC system.

Description:

This circuit in FIG. 42 details the SPDT (single pole, double throw) for the auxiliary switch 477 version of FIG. 41 designed for a positive ground DC (or AC) system. This version of the circuit has the auxiliary switch 477 placed differently in the circuit and the diode 470 (of FIG. 41) is replaced with a resistor 484.

Elements of the FIG. 42 Circuit:

| | |
|---|---|
| 475- | Point "A" |
| 476- | Main Contact (SPST) |
| 477- | Auxiliary Switch (SPDT) |
| 478- | Point "C" |
| 479- | Diode |
| 480- | Resistor |
| 481- | Point "D" |
| 482- | Bi-Color LED |
| 483- | Resistor |
| 484- | Resistor |
| 485- | Diode |
| 486- | Point "B" |
| 487- | Load |
| 488- | Push-Button Alarm Test Switch |

Function:

This circuit works like FIG. 41 circuit, except that the FIG. 42 configuration (and not the configuration of FIG. 41) is used when multiple circuit breakers are connected to the same push-button alarm test switch 488 (momentary, normally open).

In such a case, when the alarm test switch 488 is pressed, all alarm circuits are tested at the same time within the same system (positive or negative ground). Also in this version of the circuit, when a circuit breaker is tripped, the circuit associated with that circuit breaker will be disconnected from the test switch 488.

Item 40—Lighted Status Indicator for a mid-trip circuit breaker using a SPDT as a main contact and an auxiliary switch (SPDT) for tripped status indication with alarm test push button switch, for a negative ground DC (or an AC) system.

Figure 43:
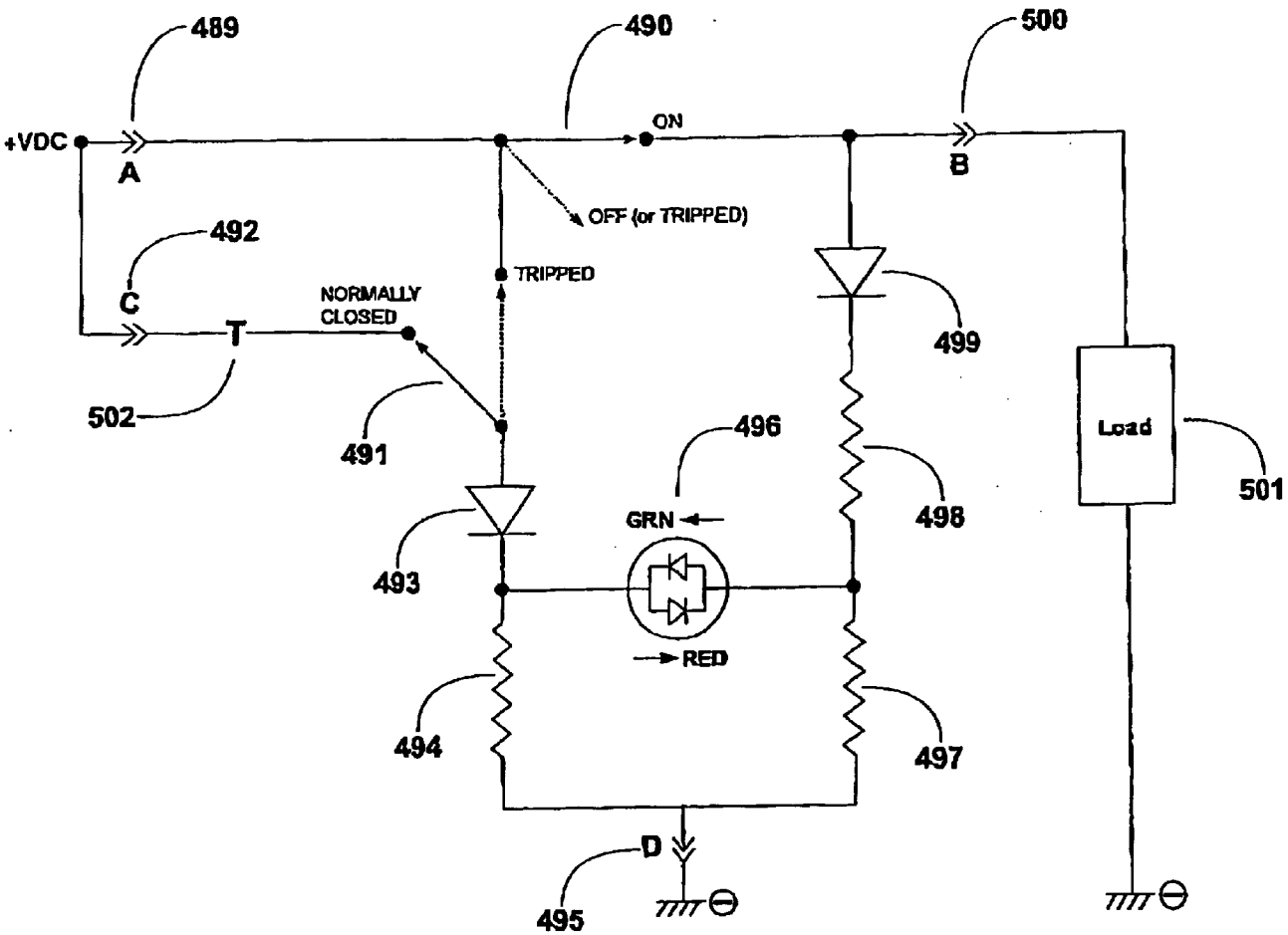
FIG. 43 is the same as FIG. 42, except that the circuit has been altered to work with a negative ground DC or an AC system.

Description:

This circuit in FIG. 43 is the negative ground DC version of the circuit in FIG. 42. It is identical to the FIG. 42 circuit except that the directions of the diodes 499 and 493 and the bi-color LED 496 have been reversed.

Elements of the FIG. 43 Circuit:

| | |
|---|---|
| 489- | Point "A" |
| 490- | Main Contact (SPST) |
| 491- | Auxiliary Switch (SPDT) |
| 492- | Point "C" |
| 493- | Diode |
| 494- | Resistor |

-continued

| | |
|---|---|
| 495- | Point "D" |
| 496- | Bi-Color LED |
| 497- | Resistor |
| 498- | Resistor |
| 499- | Diode |
| 500- | Point "B" |
| 501- | Load |
| 502- | Push-Button Alarm Test Switch |

Function:

The FIG. 43 circuit functions identically to the circuit diagrammed in FIG. 42, except that the direction of the diodes 499 and 493, bi-color LED 496, and current flow are reversed.

Item 41—Lighted Status indicator for a fuse with alarm circuit and alarm test switch, for a positive ground DC (or AC) system.

Description: The FIG. 44 circuit is functionally identical to the FIG. 41 circuit except that a fuse 503 has replaced the main contact 461 and the auxiliary switch 462 (of FIG. 41).

Figure 44:
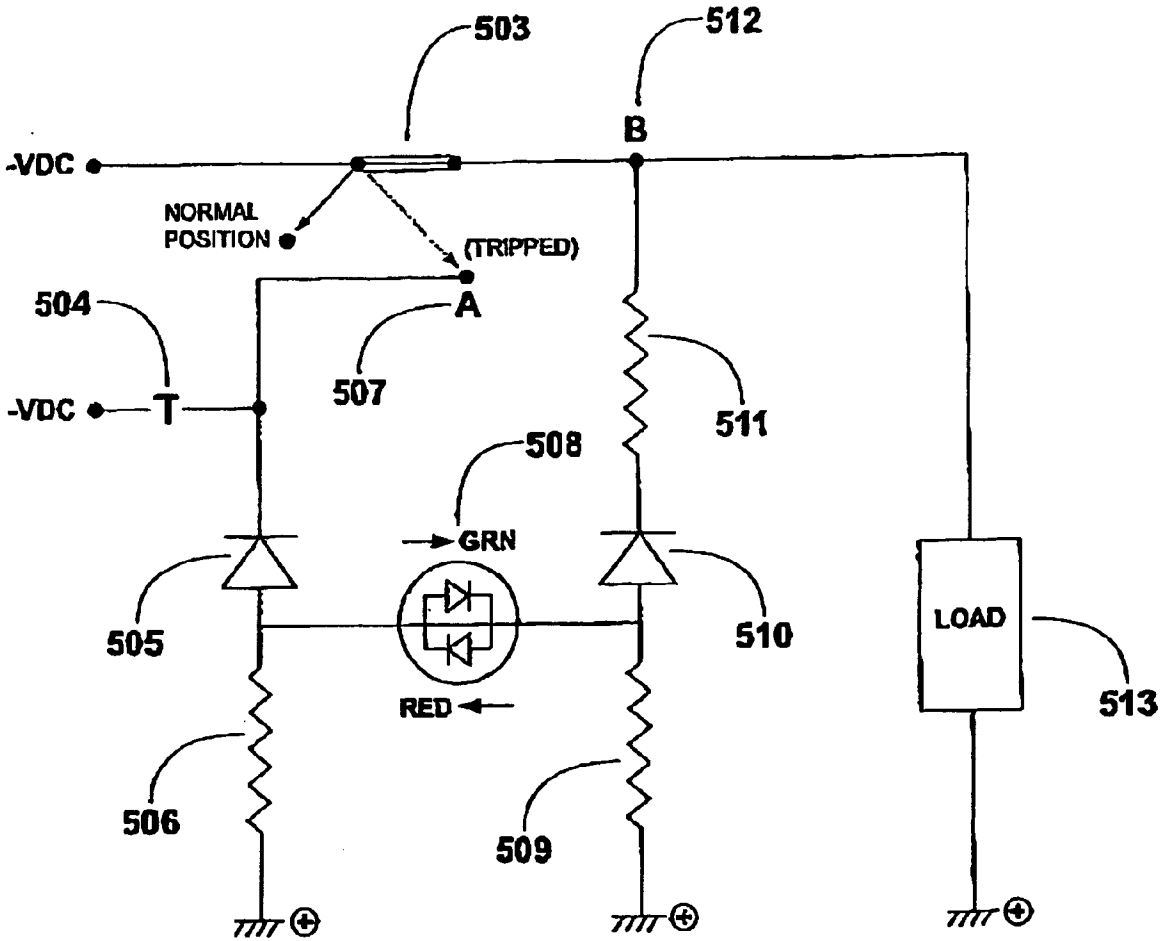
FIG. 44 is circuit diagram of the Lighted Status Indicator circuit for a fuse with alarm circuit and alarm test switch, for a positive ground DC (or AC) system.

Elements of the FIG. 44 Circuit:

| | |
|---|---|
| 503- | Fuse with Alarm Contact |
| 504- | Push-Button Alarm Test Switch |
| 505- | Diode |
| 506- | Resistor |
| 507- | Point "A" |
| 508- | Bi-Color LED |
| 509- | Resistor |
| 510- | Diode |
| 511- | Resistor |
| 512- | Point "B" |
| 513- | Load |

Function:

The circuit in FIG. 44 functions identically to the circuit shown in FIG. 41. Removal of the fuse 503 corresponds to manually turning off the power to the Load 513. In this case, the −VDC is completely disconnected from Points A 507 and B 512. When excessive current at the Load 513 blows the fuse 503, Point B 512 will be disconnected from the −VDC supply, and the diode 505 will be connected to the −VDC supply through Point A 507 of the fuse 503.

Reversing the directions of the diodes 510 and 505 and the bi-color LED 508 creates a version of this circuit for use with a negative ground DC supply.

Item 42—Compact Module (L-Module) for Display of Individual Breaker Status.

Description:

The "L-Module" 515 (detailed in FIG. 45) is a compact, breaker-mounted module that provides a front panel visual display of the exact status of a circuit breaker equipped with an auxiliary status switch (where the status switch is only activated in the TRIPPED state of the breaker). Breaker status is indicated via an LED status indicator 519 located next to the breaker. This LED status indicator 519 and associated status circuitry are encased inside of a compact module—the L-Module 515—attached to the connector lugs on the back of the circuit breaker 514.

Figure 45:
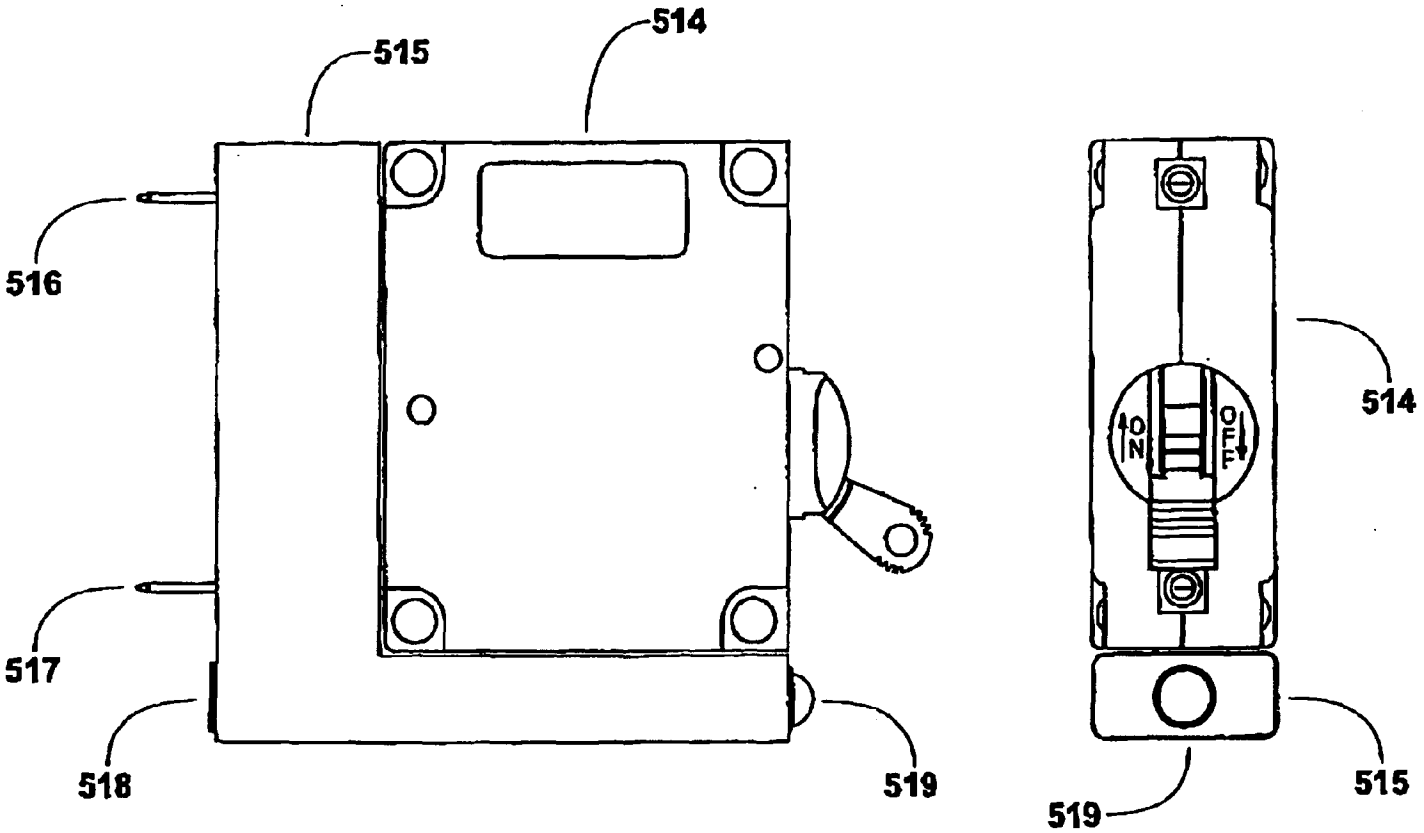
FIG. 45 illustrates side and front views of the L-Module—a compact breaker-mounted module display of individual breaker status.

Elements of FIG. 45:

| | |
|---|---|
| 514- | Breaker |
| 515- | L-Module |

-continued

| | |
|---|---|
| 516- | Load Contact |
| 517- | Line Contact |
| 518- | Status/Test Port |
| 519- | LED Status Indicator |

Figure 46:
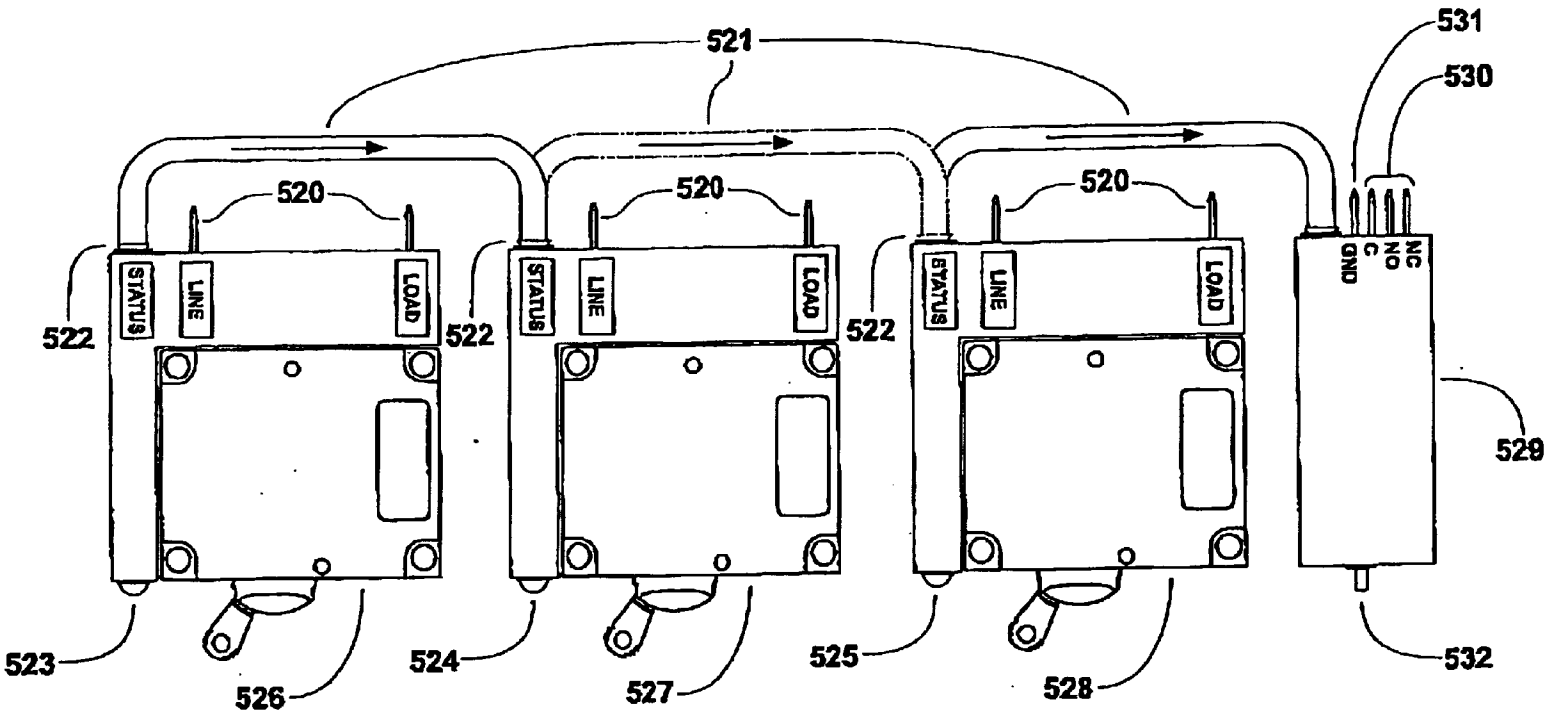
FIG. 46 illustrates a side view of a series of L-Modules daisy-chained together, and monitored by an Alarm/Status Module.

Elements of FIG. 46:

| | |
|---|---|
| 520- | Line and Load Contacts |
| 521- | Daisy-Chain Cable |
| 522- | Status/Test Port |
| 523- | L-Module 1 |
| 524- | L-Module 2 |
| 525- | L-Module n |
| 526- | Breaker 1 |
| 527- | Breaker 2 |
| 528- | Breaker n |
| 529- | Alarm/Status Module (A/S-Module) |
| 530- | A/S-Module Alarm Summary Out |
| 531- | A/S-Module Ground Contact |
| 532- | Alarm Test Switch |

Function:

The FIG. 40 circuit diagram (shown in Item 37) shows the design of the basic L-Module circuit. FIG. 41 (shown under Item 38) diagrams the L-Module 515 with an added alarm test function. Note that just as in Item 38, resistors 467 and 466 (of FIG. 41) may be replaced with current-limiting diodes. Similarly, diode 465 (of FIG. 41) may be added for use with for AC applications, and a Zener diode or a resistor may replace diode 470 (of FIG. 41).

As shown in FIG. 46, Multiple L-Modules (523, 524, and 525) may be connected in series, allowing a panel of breakers with L-Modules to all be tested using one common test switch 532 (in FIG. 46) or 488 (in FIG. 42) using the FIG. 42 circuit. That common test switch, along with an alarm status contact provision 530, is placed in a separate module—the Alarm/Status Module 529 (in FIG. 46) (see Items 43 and 44). Test lines and a ground path 521 for each L-Module are daisy-chained and terminated in the Alarm/Status Module 529 (in FIG. 46). (Alarm/Status Module is hereafter abbreviated as A/S-Module.)

Item 43—Alarm/Status Module (Used in a Single Power System).

Description:

An A/S-Module for a single power system (shown in FIG. 47) consists of a relay circuit 560 and a SPST (single pole, single throw), momentary, normally open, push-button switch 559 (the Alarm Test Switch), as well as a resistor 561, a capacitor 562, and a diode 563.

The alarm test switch extends from the front of the A/S-Module. Pressing it tests all alarm circuits within the L-Modules, as well as the A/S-Module's dry contact alarm summary output. Pressing the alarm test switch will also turn all of the L-Module bi-color LEDs RED-regardless of breaker positions. Such a test does not impact normal breaker function, or in any way affect the current moving through the breaker.

Figure 47:
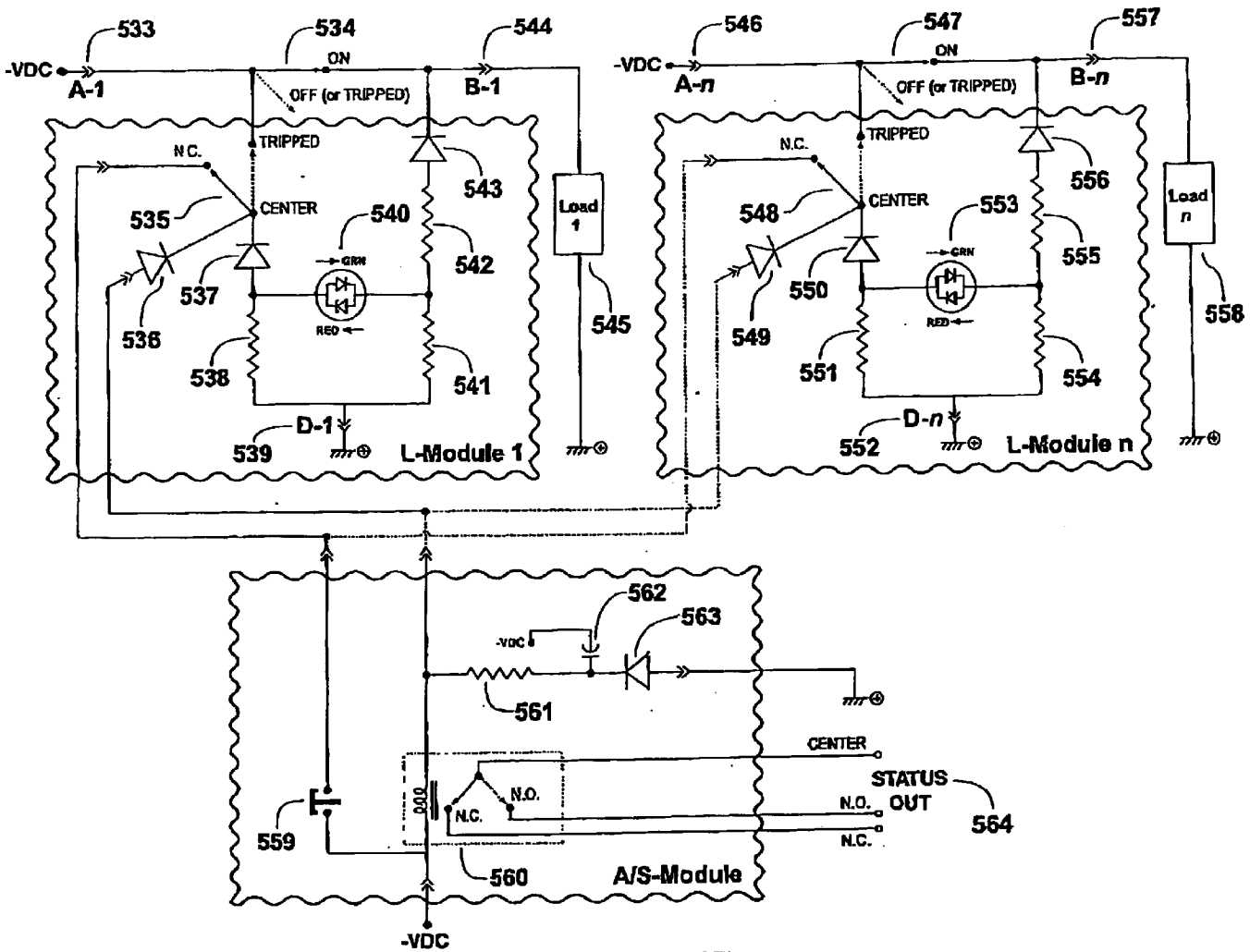
FIG. 47 is a circuit diagram of the Alarm/Status Module, together with a series of daisy-chained L-Modules that it monitors.

A/S-Module inputs come from daisy-chained L-Module status lines that terminate at the A/S-Module (as shown in FIGS. 46 and 47). The A/S-Module outputs alarm summary information for all connected breakers, from the contact points 564 of a SPDT relay 560 inside the A/S-Module, via a three-position connector. An A/S-Module can be configured as to allow the alarm test switch 559 to be panel mounted, while the A/S-Module itself is located remotely.

With this design only a minimum of panel space—just enough to mount the switch—is required.

FIG. 47 diagrams an A/S-Module together with the L-Modules it receives inputs from.

Elements of the FIG. 47 Circuit:

| | |
|---|---|
| 533- | Point "A-1" |
| 534- | Main Contact 1 (SPST) |
| 535- | Auxiliary Switch 1 (SPDT) |
| 536- | Isolation Diode |
| 537- | Diode |
| 538- | Resistor |
| 539- | Point "D-1" |
| 540- | Bi-Color LED |
| 541- | Resistor |
| 542- | Resistor |
| 543- | Diode |
| 544- | Point "B-1" |
| 545- | Load 1 |
| 546- | Point "A-n" |
| 547- | Main Contact n (SPST) |
| 548- | Auxiliary Switch n (SPDT) |
| 549- | Isolation Diode |
| 550- | Diode |
| 551- | Resistor |
| 552- | Point "D-n" |
| 553- | Bi-Color LED |
| 554- | Resistor |
| 555- | Resistor |
| 556- | Diode |
| 557- | Point "B-n" |
| 558- | Load n |
| 559- | Alarm Test Switch |
| 560- | Relay |
| 561- | Resistor |
| 562- | Capacitor |
| 563- | Diode |
| 564- | Status Out |

Function:

Input lines to the A/S module are:

(1) A supply voltage and return (ground) line, (2) A line that connects (daisy-chained) the isolation diodes (running from 536 to 549), of all the L-Modules being monitored, and (3) A line that connects (daisy-chained) all the normally closed contact positions of the monitored L-Module's auxiliary switches 1 through n (535 and 548).

During the normal operation of the monitored breakers, there is no current flow through any of the L-Modules' isolation diodes (536 and 549), the A/S-Module relay 560 is energized through diode 563 and resistor 561, and outputs from the A/S-Module relay contacts 564 indicate proper functioning of all breakers.

When an overload condition causes one or more of the L-Modules to report a TRIPPED condition in the breakers they monitor, a current will flow from the positive ground, through diode 563 and resistor 561, the isolation diode(s) (536 and/or 549) of the L-Module(s) connected to the tripped auxiliary switch (535 and/or 548), to the breaker(s) main contact (534 and/or 547), and on to the −VDC supply. As a result, the voltage differential across the A/S-Module relay 560 drops to about 0.7 Volts (diode drop), de-energizing that relay 560, causing the relay status contacts 564 to report an alarm condition. This alarm contact condition also exists whenever system power is interrupted. Note that the capacitor 562 is used for an AC-powered system.

The push-button momentary switch 559 (alarm test switch) of the A/S-Module is used to test proper functioning of all L-Module LED status indicator circuits, as well as the relay circuit within the A/S-Module itself. Pressing the alarm test switch 559 will cause the connection of the −VDC supply voltage to all L-Modules via the normally closed contact of their auxiliary switches (535 and 548). This connection triggers current flows from the positive ground, through the RED sides of the L-Modules' bi-color LEDs (540 or 553), through their auxiliary switches (535 and 548), the A/S-Module's push-button alarm test switch 559, and on to the −VDC supply at the A/S-Module.

Pressing the alarm test switch 559 also connects the isolation diodes (536 and D6 549) within all L-Modules to the −VDC supply, causing the relay 560 to de-energize, thus simulating a TRIPPED condition within one or more of the monitored L-Modules.

Item 44—Alarm/Status Module (Used in a Dual Power System).

Description:

This version of the A/S-Module is similar to the A/S-Module used for single power systems, except that the momentary, alarm test switch 567 is a DPST (double pole, single throw) switch, and that a second relay 566 is added for the second power system. (FIG. 48 illustrates the circuit used for the Dual Power System A/S-Module.)

The relay contacts are daisy-chained together (via the Normally Open contacts—see FIG. 48) to create one single status output for the entire system. Inputs to the A/S-Module are via two groups of lines—one group for each power system. The A/S-Module is designed so as to keep the two independent power systems completely isolated from each other. Since the normally open contacts of the two relays (565 and 566) are daisy-chained together, the A/S-Module will report an alarm status when an over current condition occurs in any breaker of either of the two independent power systems. The A/S-Module will also report an alarm if either—or both—of the power systems A and B is absent.

Adding the capacitors 569 and C2 572 (drawn in dotted lines), creates a version of the circuit for use in an AC power system.

Figure 48:
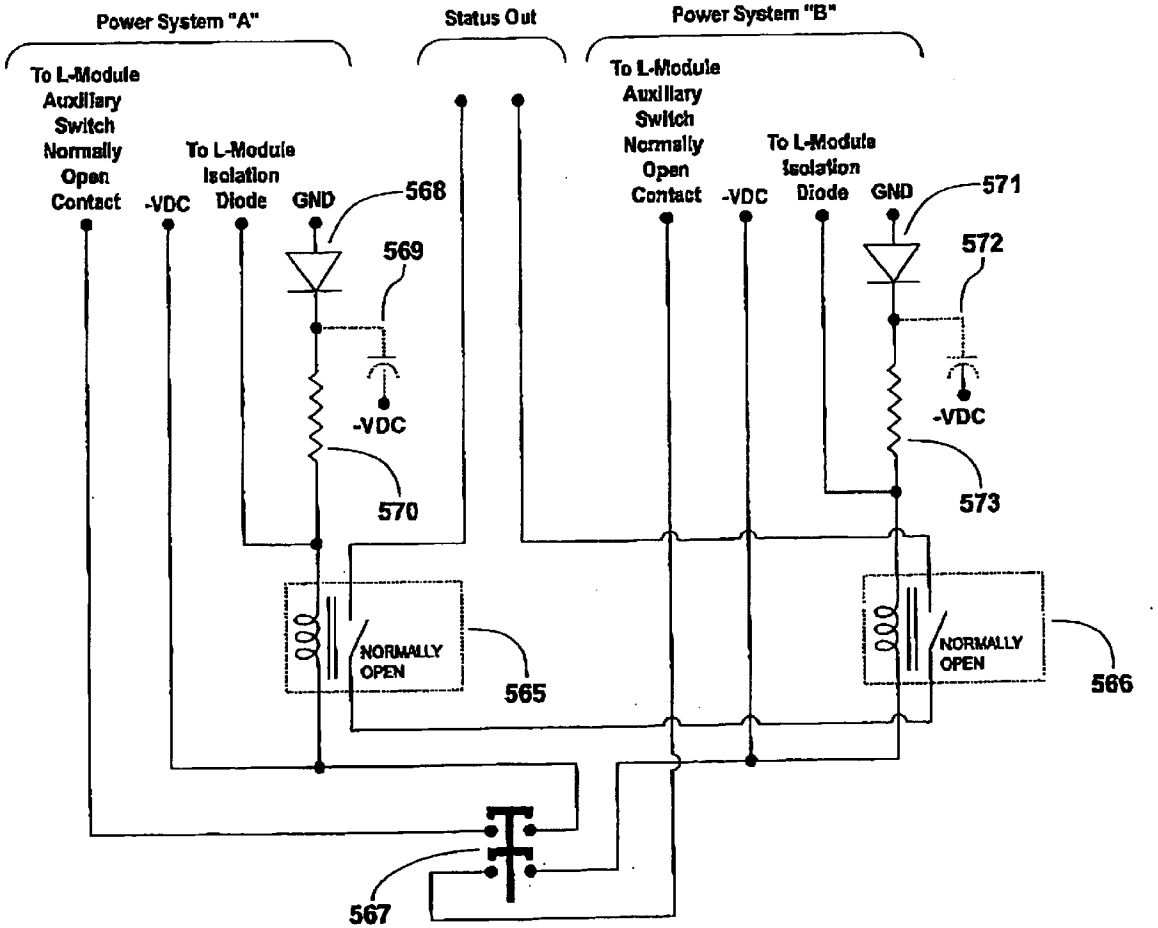
FIG. 48 is a circuit diagram of a variation of the Alarm/Status Module designed for use in a dual power system.

Elements of the FIG. 48 Circuit:

| | |
|---|---|
| 565- | Relay 1 (A-Side) |
| 566- | Relay 2 (B-Side) |
| 567- | Test Switch (DPST) |
| 568- | Diode |
| 569- | Capacitor |
| 570- | Resistor |
| 571- | Diode |
| 572- | Capacitor |
| 573- | Resistor |

Function:

This version of the A/S-Module is diagrammed in FIG. 48. It functions in the same way as the Single Power System A/S-Module (FIG. 47), except that the activation of the alarm test switch 567 will test the alarm circuits associated with the breakers in both power systems. The Dual Power System A/S-Module also provides a single alarm status output for the entire system.

Independent alarm status for each power system may also be provided using relays with DPDT (double pole, double throw) contacts. In this case, the second contact of each relay reports the status of the specific system monitored by that relay.

Item 45—Direct Status Output L-Module.

Description:

The Direct Status Output L-Module (FIG. 49) is an L-Module which includes part (or all) of the A/S-Module circuitry. It supports independent monitoring of individual circuit breakers. This version of the L-Module incorporates alarm status contacts (578, 579, and 580 on FIG. 49; 583 on FIG. 50) which output at the back of the L-Module. The Direct Status Output L-Module may also include an alarm test switch. This module is designed for use in a system where the status on a specific circuit breaker needs to be independently monitored and reported.

Figure 49:
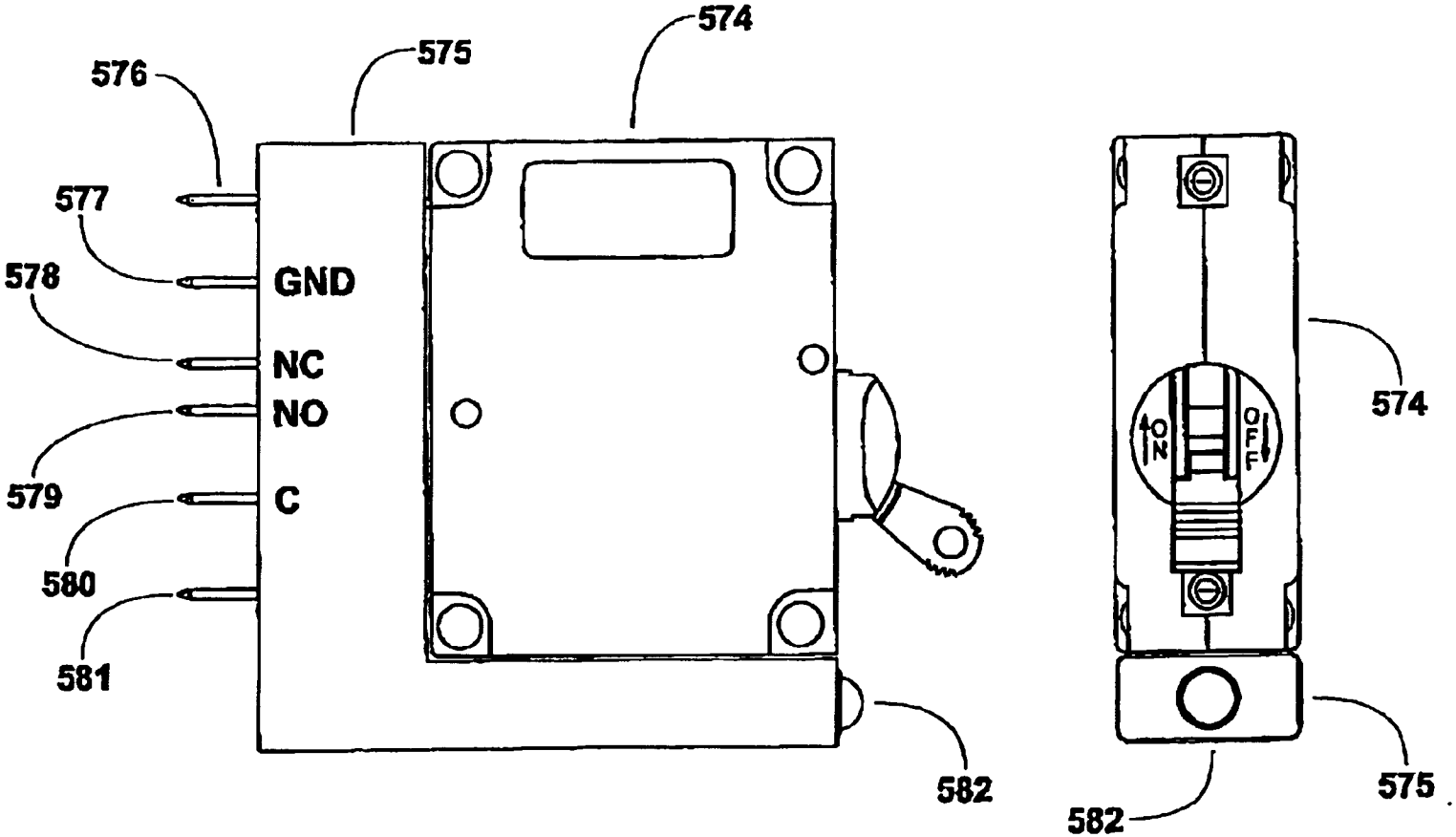
FIG. 49 illustrates side and front views of the Direct Status Output L-Module—a compact breaker-mounted module display of individual breaker status, designed to support independent monitoring of individual circuit breakers.

Elements of FIG. 49:

| | |
|---|---|
| 574- | Breaker |
| 575- | L-Module |
| 576- | Load Contact |
| 577- | Ground Contact |
| 578- | Normally Closed Contact |
| 579- | Normally Open Contact |
| 589- | Center Contact |
| 581- | Line Contact |
| 582- | LED Status Indicator |

Figure 50:
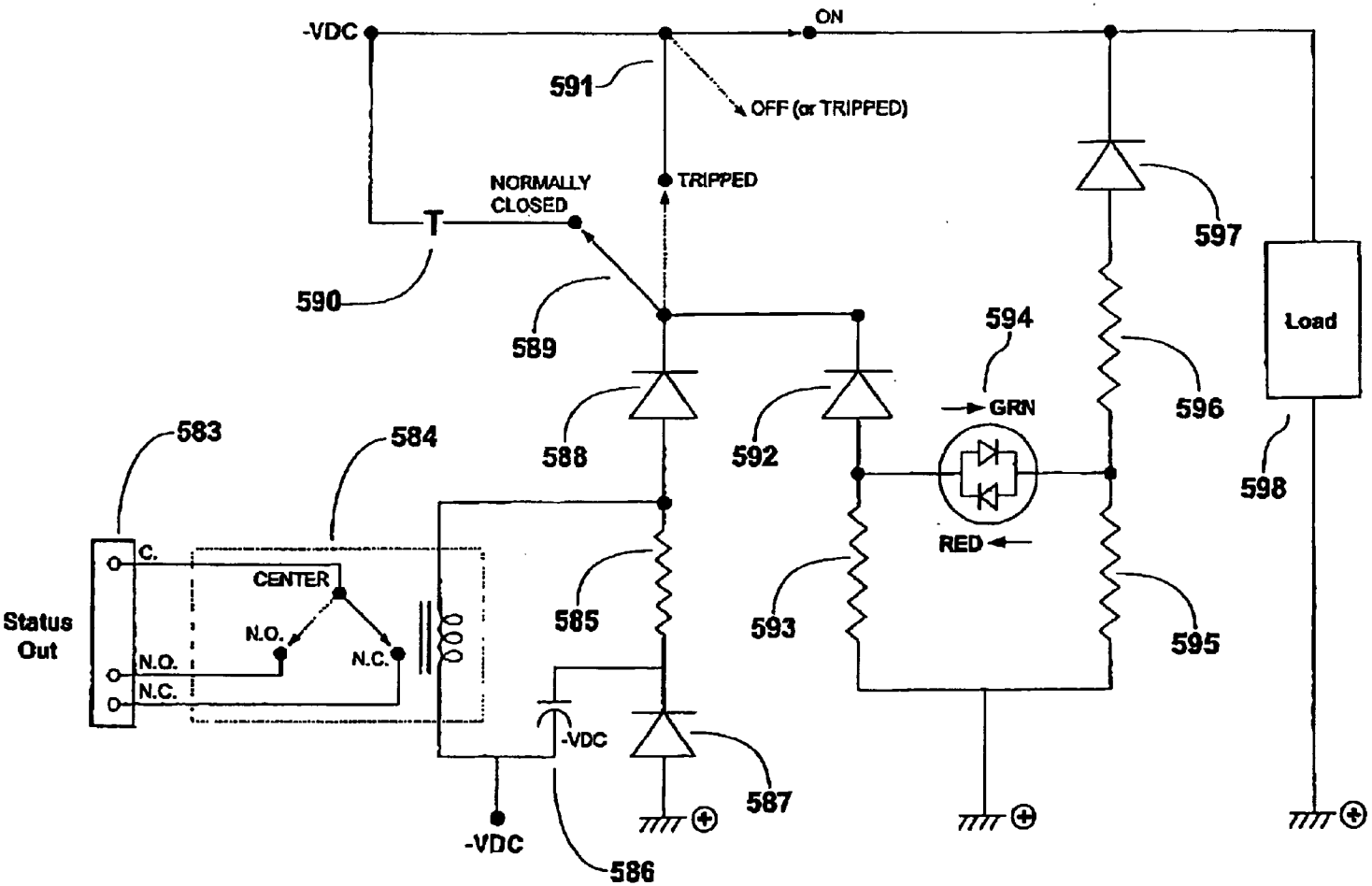
FIG. 50 is a circuit diagram of the Direct Status Output L-Module.

Elements of the FIG. 50 Circuit:

| | |
|---|---|
| 583- | Alarm Port |
| 584- | Relay |
| 585- | Resistor |
| 586- | Capacitor |
| 587- | Diode |
| 588- | Diode |
| 589- | Auxiliary Switch |
| 590- | Alarm Test Switch |
| 591- | Main Contact |
| 592- | Diode |
| 593- | Resistor |
| 594- | Bi-Color LED |
| 595- | Resistor |
| 596- | Resistor |
| 597- | Diode |
| 598- | Load |

Function:

The Direct Status L-Module circuit (FIG. 50) works in an identical manner to an L-Module and an A/S-Module connected together as one system. Both the L-Module and A/S-Module—and a circuit combining both (FIG. 47)—have previously been described (Items 42 & 43) in detail.

Item 46—L-module for circuit breakers with no auxiliary switch or circuit breakers with no mid-trip capability.

Figure 51:
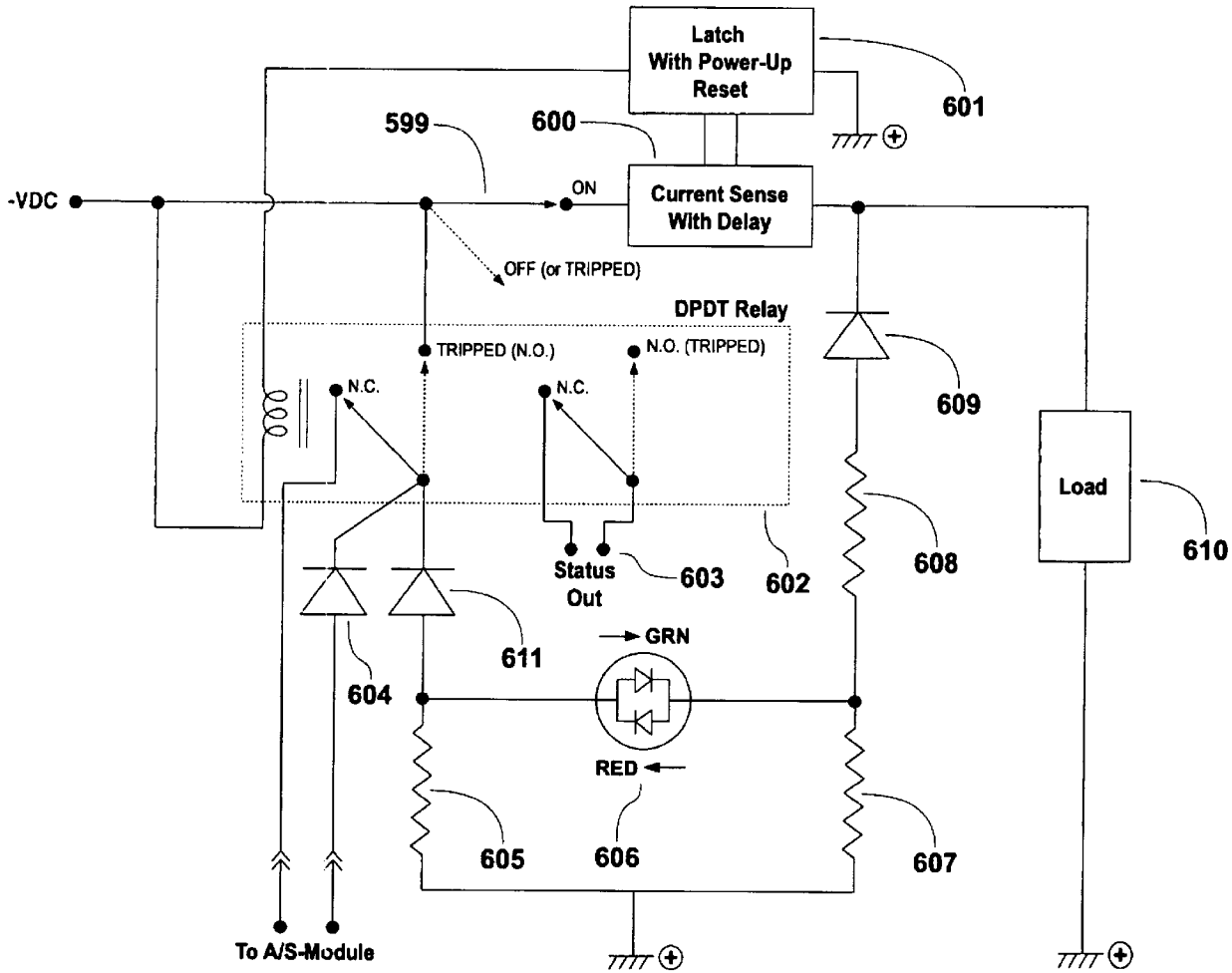
FIG. 51 is a circuit diagram of an L-Module designed for a switch, fuse, or circuit breaker with no auxiliary switch, or circuit breakers with no mid-trip capability.

Description:

The circuit for this version of the L-Module (shown in FIG. 51) is similar to the circuit for the basic L-Module (diagrammed in FIG. 40), with a few significant differences. These include a relay contact 602 that is used in the place of the auxiliary switch of a mid-trip breaker, as well as latch 601 and current-sensing circuits 600 that energize that relay circuit 602.

Elements of the FIG. 49 Circuit:

| | |
|---|---|
| 599- | Circuit Breaker Main Contact |
| 600- | Current Sense with Delay |
| 601- | Latch with Power-Up Reset |
| 602- | DPDT Relay |
| 603- | Status Out |
| 604- | Isolation Diode |
| 605- | Resistor |
| 606- | Bi-Color LED |
| 607- | Resistor |

-continued

| | |
|---|---|
| 608- | Resistor |
| 610- | Load |
| 611- | Diode |

Function:

Under normal conditions when the circuit breaker main contact 599 is on, the DPDT (double pole, double throw) relay 602 is not powered, and its normally closed contact (connected to the A/S-Module) does not carry any power. In this state (as has been explained previously), the GREEN side of the Bi-Color LED 606 will turn ON.

When an excessive load current flow occurs, the current-sensing circuit 600 will trigger the latch circuit 601, applying power to the relay 602, and activating the relay contacts. The excessive current detection time of the current-sensing circuit is selected so as to be much shorter than the activation time of the circuit breakers being monitored.

When the circuit breaker main contact 599 is tripped, the RED side of the Bi-Color LED 606 will glow. A few milliseconds delay time incorporated in the current-sensing circuit 600 eliminates any chance of circuit activation in case of high initial in-rush current. When the cause of circuit breaker 599 activation is removed from the load side, the circuit breaker's 599 manual turn on causes the latch circuit 601 to reset, the relay 602 to de-energize, and the normal operation of the system to resume.

The isolation diode 604 line of the module allows it to be used in daisy chain configurations (as in the systems shown in FIGS. 47 and 48). Using a DPDT relay also provides extra contacts that can be used as status contact out 603, via the connectors on the back of the L-Module.

As an option, this version of the L-Module also may include a SPST (single pole, single throw) momentary push button test switch.

The circuit contained in this version of the L-Module (FIG. 51) may also be used to monitor the status of a switch or a fuse.

What is claimed is:

1. A circuit in which a current interrupter is connected to interrupt current to a load, comprising:

an indicator providing an indication of whether current is coupled to the load by the current interrupter;

a passive network connected between the current interrupter and the indicator, said passive network biasing said indicator to provide a first indication of when current is flowing to the load, and a second indication of when current is interrupted by the current interrupter, in an AC or DC circuit, for positive or negative ground;

wherein the current interrupter and the load are connected between a first node and a second node, and a third node is defined between the current interrupter and the load, and said passive network comprises:

a first resistor connected between the first node and a fourth node;

a second resistor connected between said fourth node and the second node;

a third resistor connected between the second node and a fifth node;

a rectifier connected between the third node and said fifth node for limiting current flow to one direction between the third and said fifth node;

said indicator connected between the third node and said fifth node; and wherein said first, second and third resistors are sized and said rectifier is aligned for current to flow in a first direction through said indicator when the current is passing through the current interrupter and in a second direction when the current interrupter is interrupting current flow to the load.

2. A circuit in which a circuit breaker is connected to interrupt current to a load, comprising:

an indicator providing an indication of whether current is coupled to a load by the circuit breaker;

a passive network connected between the circuit breaker and the indicator, said passive network biasing said indicator to provide a first indication of when current is flowing to the load, and a second indication of when current is interrupted by the circuit breaker, in an AC or DC circuit, for positive or negative ground;

wherein the circuit breaker and the load are connected between a first node and a second node, and a third node is defined between the circuit breaker and the load, the circuit breaker having status output contacts which, when the circuit breaker is tripped, are selectively switched to output a status of the circuit breaker as being tripped, said passive network comprises:

a first resistor connected between the first node and a fourth node;

a second resistor connected between the third node and a fifth node;

a rectifier connected in series with said second resistor between the third node and said fifth node for limiting current flow to one direction between the third and said fifth node;

said indicator connected between said fourth node and said fifth node;

said fourth node connected to a first one of the status output contacts of the circuit breaker;

said fifth node connected to a second one of the status output contacts of the circuit breaker;

a third one of the status output contact being connected to the second node, and being switched between the first one and the second one of the status output contacts according to whether the circuit breaker is passing current to the load or interrupting current to the load due to an overload; and wherein said first and second resistors are sized, and said rectifier is aligned for current to flow in a first direction through said indicator when said current is passing through the circuit breaker and in a second direction when the circuit breaker is interrupting current flow to the load.

3. The circuit according to claim 2, further comprising a test switch having a normally open contact connected to said fifth node, and a normally closed contact connected to said fourth node, and a center contact connect to the second node, wherein said test switch is selectively actuated to selectively activate said indicator.

4. The circuit according to claim 3, further comprising a second rectifier connected between said fifth node and said normally open contact of said test switch, and said test switch connected to a plurality of second rectifiers which are each connected in parallel circuits, with said plurality of second rectifiers in said parallel circuits each being connected in series with nodes of respective one of a plurality of circuit breakers to simultancously lest respective indicators connected to respective ones of the plurality of circuit breakers.

5. The circuit according to claim 4, further comprising a normally open relay, a first end of a coil of said relay connected to the second node and a second end of said coil of said relay connected in series with a third resistor to the first node, said second end of said coil of said relay and said resistor connected to a sixth node;

a third rectifier connected between said sixth node and a seventh node, said seventh node being defined between said fifth node and the second one of the status output contacts of the circuit breaker;

a fourth rectifier connected in the circuit between the fifth node and the seventh node, wherein said fourth rectifier is connected between said seventh node and said fifth node for passing current in the same direction as current from said seventh node to said sixth node, and in the same direction as said second rectifier passes current from said normally open contact of said test switch to said seventh node;

a fifth rectifier connected across said first end and said second end of said coil of said relay, wherein said fifth rectifier is connected for passing current from the sixth node to the second node in the same direction as the third rectifier passes current from the seventh node to the sixth node; and said output contacts of said normally open relay being connected to contact of a status connector.

6. A circuit in which a circuit breaker is connected to interrupt current to a load, comprising:

an indicator providing an indication of whether current to is coupled to the load by the circuit breaker;

a passive network connected between the circuit breaker and the indicator, said passive network biasing said indicator to provide a first indication of when current is flowing to the load, and a second indication of when current is interrupted by the circuit breaker; in an AC or DC circuit, for positive or negative ground;

wherein the circuit breaker and the load are connected between a first node and a second node, and a third node is defined between the circuit breaker and the load, the circuit breaker having status output contacts which, when the circuit breaker is tripped, are selectively switched to output a status or the circuit breaker as being tripped, said passive network comprises:

a first resistor connected between the first node and a fourth node;

a rectifier connected between the third node and a fifth node for limiting current flow to one direction between the third node and said fifth node;

said indicator connected between said fourth node and said fifth node;

a second resistor connected between said fourth node and a first one of the status output contacts of the circuit breaker;

said fifth node connected to a second one of the status output contacts of the circuit breaker;

a third resistor connected between a third one of the status output contacts and the second node;

the third one of the status output contacts being switched between the first one and the second one of the status output contacts according to whether the circuit breaker is passing current to the load or interrupting current to the load due to an overload; and wherein said first, second and third resistors are sized, and said rectifier is aligned for current to flow in a first direction through said indicator when said current is passing through the circuit breaker and in a second direction when the circuit breaker is interrupting current flow to the load.

7. A circuit in which a circuit breaker is connected to interrupt current to a load comprising:

an indicator providing an indication of whether current is coupled to the load by the circuit breaker;

a passive network connected between the circuit breaker and the indicator, said passive network biasing said indicator to provide a first indication of when current is flowing to the load, and a second indication of when current is interrupted by the circuit breaker, in an AC or DC circuit, for positive or negative ground;

wherein the circuit breaker and the load are connected between a first node and a second node, and a third node is defined between the circuit breaker and the load, the circuit breaker having power contacts which, when the circuit breaker is tripped, are selectively switched from a normally closed to normally open such that a center power contact is switched from connecting to the first one of the power contacts to a second one of the power contacts, and wherein the first one of the power contacts of said circuit breaker is connected to the third node and the center power contact is connected to the first node, said passive network comprising:

a first resistor connected between the first node and a fourth node;

a rectifier connected between the third node and said fourth node for limiting current flow to one direction between the third node and said fourth node;

an indicator connected between said fourth node and a fifth node;

a second resistor connected between said fifth node and the second node, said fifth node connected to a second one of the power output contacts of the circuit breaker; and wherein said first and second resistors are sized, and said rectifier is aligned for current to flow in a first direction through said indicator when said current is passing through the circuit breaker and in a second direction when the circuit breaker is interrupting current flow to the load due to said circuit breaker being tripped.

8. An apparatus for determining whether a circuit breaker connected between a power supply and a load is interrupting current to the load, wherein the circuit breaker and the load are connected between a first node and a second node, and a third node is defined between the circuit breaker and the load, the circuit breaker having status output contacts which, when the circuit breaker is tripped, are selectively switched to output a status of the circuit breaker as being tripped, said apparatus comprising:

a first resistor connected between the first node and a fourth node;

a second resistor connected between the third node and a fifth node;

a first rectifier connected in series with said second resistor between the third node and said fifth node for limiting current flow to one direction between the third and said fifth node;

an indicator connected between said fourth node and said fifth node;

said fourth node connected to a first one of the status output contacts of the circuit breaker;

said fifth node connected to a second one of the status output contacts of the circuit breaker;

a third one of the status output contact being connected to the second node, and being switched between the first one and the second one of the status output contacts according to whether the circuit breaker is passing current to the load or interrupting current to the load due to an overload; and wherein said first and second resistors are sized, and said first rectifier is aligned for current to flow in a first direction through said indicator when said current is passing through the circuit breaker and in a second direction when the circuit breaker is interrupting current flow to the load.

9. The apparatus according to claim 8, further comprising a first current limiting device in series with said first resistor between the first node and said fourth node and a second current limiting device in series with said first rectifier and said second resistor between the third node and said fifth node.

10. The apparatus according to claim 8, further comprising a second rectifier in series with said first resistor connecting between the first node and said fourth node.

11. The apparatus according to claim 10, further comprising a first current limiting device in series with said first resistor and said second rectifier between the first node and said fourth node and a second current limiting device in series with said first rectifier and said according resistor between the third node and said fifth node.

12. The apparatus according to claim 8, wherein said indicator is a bicolor LED.

13. The apparatus according to claim 8, wherein said rectifier is a diode.

14. The apparatus according to claim 9, wherein said first and second current limiting devices are current limiting diodes.

15. The apparatus according to claim 8, wherein said circuit breaker is one of a switch or a fuse.

16. The apparatus according to claim 8, wherein said power supply is one of an AC current source or a DC current source.

17. The apparatus according to claim 8, wherein the first one of the status output contacts of the circuit breaker to which said fourth node is connected is normally closed, being closed when the circuit breaker is passing current to the load, and the second one of the status output contacts of the circuit breaker to which said fifth node is connected is normally open, being closed when the circuit breaker is interrupting current flow to the load due to a circuit trip condition.

18. The apparatus according to claim 8, further comprising a test switch having a normally open contact connected to said fifth node, and a normally closed contact connected to said fourth nodes and a center contact connect to the second node, wherein said test switch is selectively actuated to selectively activate said indicator.

19. The apparatus according to claim 18, further comprising a second rectifier connected between said fifth node and said normally open contact of said test switch, and said test switch connected to a plurality of second rectifiers which are each connected in parallel circuits, with said plurality of second rectifiers in said parallel circuits each being connected in series with nodes of respective one of a plurality of circuit breakers to simultaneously test respective indicators connected to respective ones of the plurality of circuit breakers.

20. The apparatus according to claim 19, further comprising a normally open relay, a first end of a coil of said relay connected to the second node and a second end of said coil of said relay connected in series with a third resistor to the first node, said second end of said coil of said relay and said resistor connected to a sixth node;

a third rectifier connected between said sixth node and a seventh node, said seventh node being defined between said fifth node and the second one of the status output contacts of the circuit breaker;

a fourth rectifier connected in the circuit between the fifth node and the seventh node, wherein, said fourth rectifier is connected between said seventh node and said fifth node for passing current in the same direction as current from said seventh node to said sixth node, and in the same direction as said second rectifier passes current from said normally open contact of said test switch to said seventh node;

a fifth rectifier connected across said first end and said second end of said coil of said relay, wherein said fifth rectifier is connected for passing current from the sixth node to the second node in the same direction as the third rectifier passes current from the seventh node to the sixth node; and said output contacts of said normally open relay being connected to contact of a status connector.

21. An apparatus for determining whether a circuit breaker connected between a power supply and a load is interrupting current to the load, wherein the circuit breaker and the load are connected between a first node and a second node, and a third node is defined between the circuit breaker and the load, the circuit breaker having power contacts which, when the circuit breaker is tripped, are selectively switched from a normally closed to normally open such that a center power contact is switched from connecting to the first one of the power contacts to a second one of the power contacts, and wherein the first one of the power contacts of said circuit breaker is connected to the third node and the center power contact is connected to the first node, said apparatus comprising:

a first resistor connected between the first node and a fourth node;

a first rectifier connected between the third node and said fourth node for limiting current flow to one direction between the third node and said fourth node;

an indicator connected between said fourth node and a fifth node;

a second resistor connected between said fifth node and the second node, said fifth node connected to a second one of the power output contacts of the circuit breaker; and wherein said first and second resistors are sized, and said rectifier is aligned for current to flow in a first direction through said indicator when said current is passing through the circuit breaker and in a second direction when the circuit breaker is interrupting current flow to the load due to said circuit breaker being tripped.

22. The apparatus according to claim 21, further comprising a second rectifier connected between the second power contact of the circuit breaker and said fifth node, aligned for passing current in the same direction from said fifth node to said second power contact as said first rectifier is aligned for passing power from said fourth node to said third node.

23. The apparatus according to claim 22, further comprising a circuit test switch connected between said fifth node and said first node for selectively closing to test the indicator, and a circuit member provided by one of a rectifier, a diode, or a resistor connected in series with said first rectifier between said third node and said fourth node, such that said indicator will activate when said circuit test switch is closed.

24. The apparatus according to claim 21, wherein said indicator is a bicolor LED.

* * * * *